United States Patent [19]

Strunc et al.

[11] 4,128,887

[45] Dec. 5, 1978

[54] MICROPROCESSOR CONTROLLED PHOTOGRAPHIC PAPER CUTTER

[75] Inventors: Gerald R. Strunc, Maple Grove; Francis M. Laciak, Brooklyn Park, both of Minn.

[73] Assignee: Pako Corporation, Minneapolis, Minn.

[21] Appl. No.: 838,064

[22] Filed: Sep. 29, 1977

[51] Int. Cl.[2] ..... B26D 5/38

[52] U.S. Cl. ..... 364/475; 83/371

[58] Field of Search ..... 364/475; 83/365, 371, 83/211, 72–76

[56] References Cited

U.S. PATENT DOCUMENTS

| | | | |
|---|---|---|---|
| 3,811,768 | 5/1974 | Zahn et al. | 83/371 X |
| 3,813,976 | 6/1974 | Greer | 83/371 X |
| 3,933,069 | 1/1976 | Tall et al. | 83/371 X |
| 3,992,965 | 11/1976 | Hell et al. | 83/371 X |
| 4,020,406 | 4/1977 | Tokuno et al. | 83/74 X |
| 4,034,635 | 7/1977 | Woolston | 83/73 X |

*Primary Examiner*—Edward J. Wise

*Attorney, Agent, or Firm*—Kinney, Lange, Westman and Fairbairn

[57] ABSTRACT

The operation of an automatic photographic paper cutter is controlled by a programmable digital processor such as the microprocessor. The microprocessor controls the paper feed, the knife assembly, the display, and other related operations of the automatic paper cutter as a function of a step status signal which indicates whether the stepper motor paper drive has taken a step, a cut status signal which indicates whether a cut mark on the paper has been sensed, and stored control information.

25 Claims, 52 Drawing Figures

FIG. 17
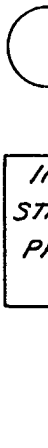
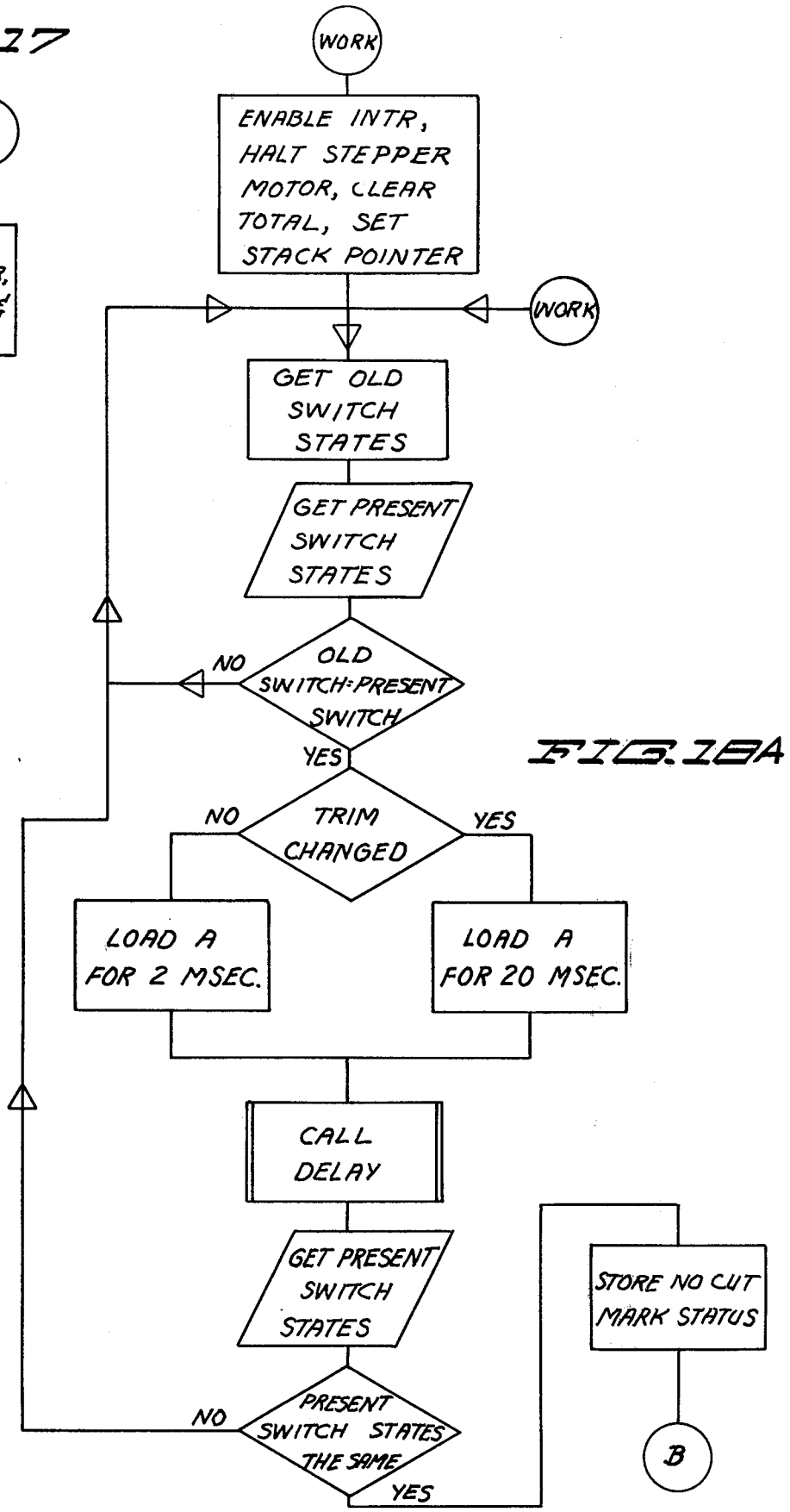
FIG. 18A

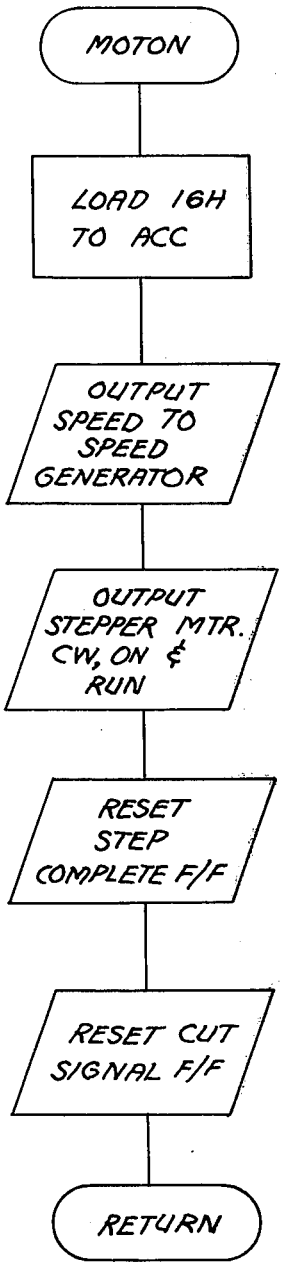
FIG. 20A
FIG. 26C
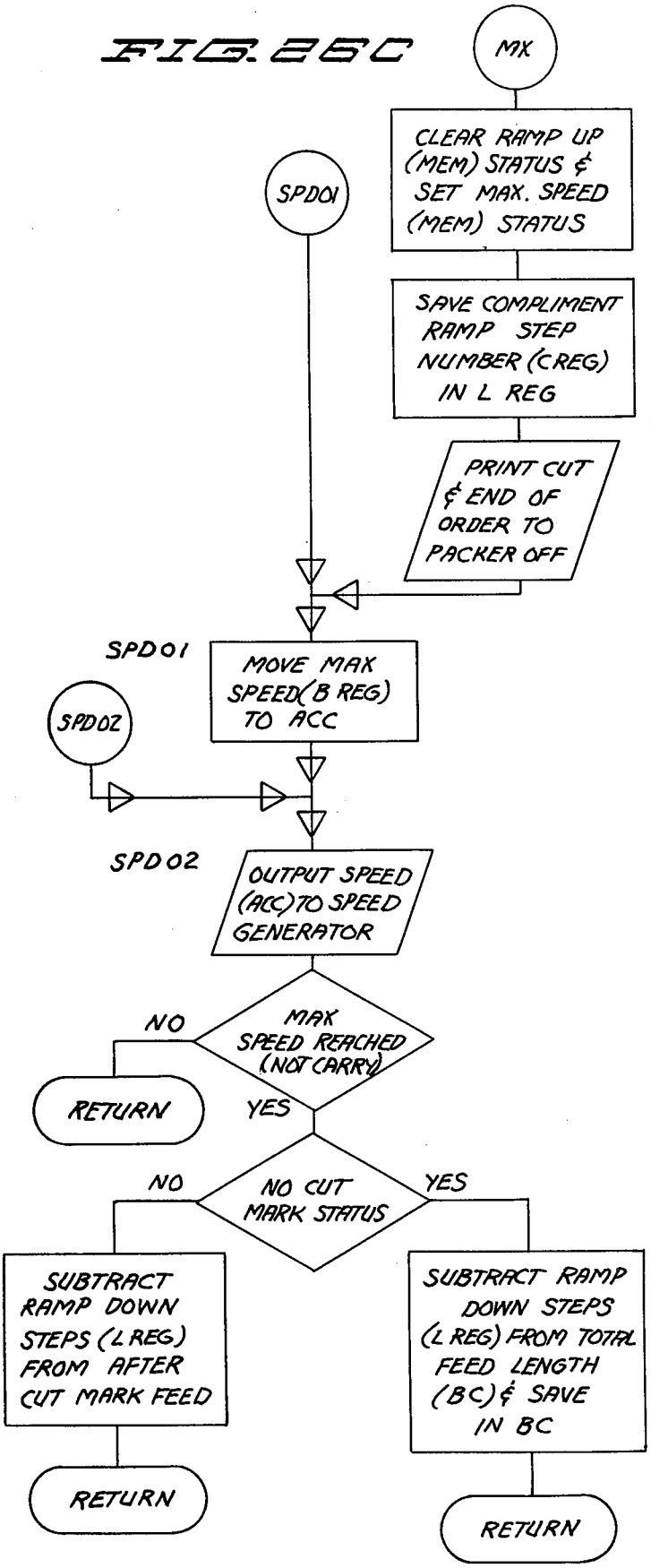

TEST 1

NO CUT MARK SELECTED
YES
RAMPD
NO
READY TO RAMP ON
YES
NO
AFTER CUT MARK
YES
END PR
NO
CUT MARK VALID
YES
NOCTM
NO
LOAD CUT WINDOW TO TEST COUNTER & SET CUT MARK VALID
CTCHK
RAMPD
RAMPD
CLEAR READY TO RAMP DOWN
GET NUMBER OF STEPS UNTIL END OF PRINT
NUMBER OF STEPS = Ø
YES
ENDPR
NO
CLEAR MAX SPEED
NO
CUT EARLY
YES
CUT SOLENOID ON
CTCHK

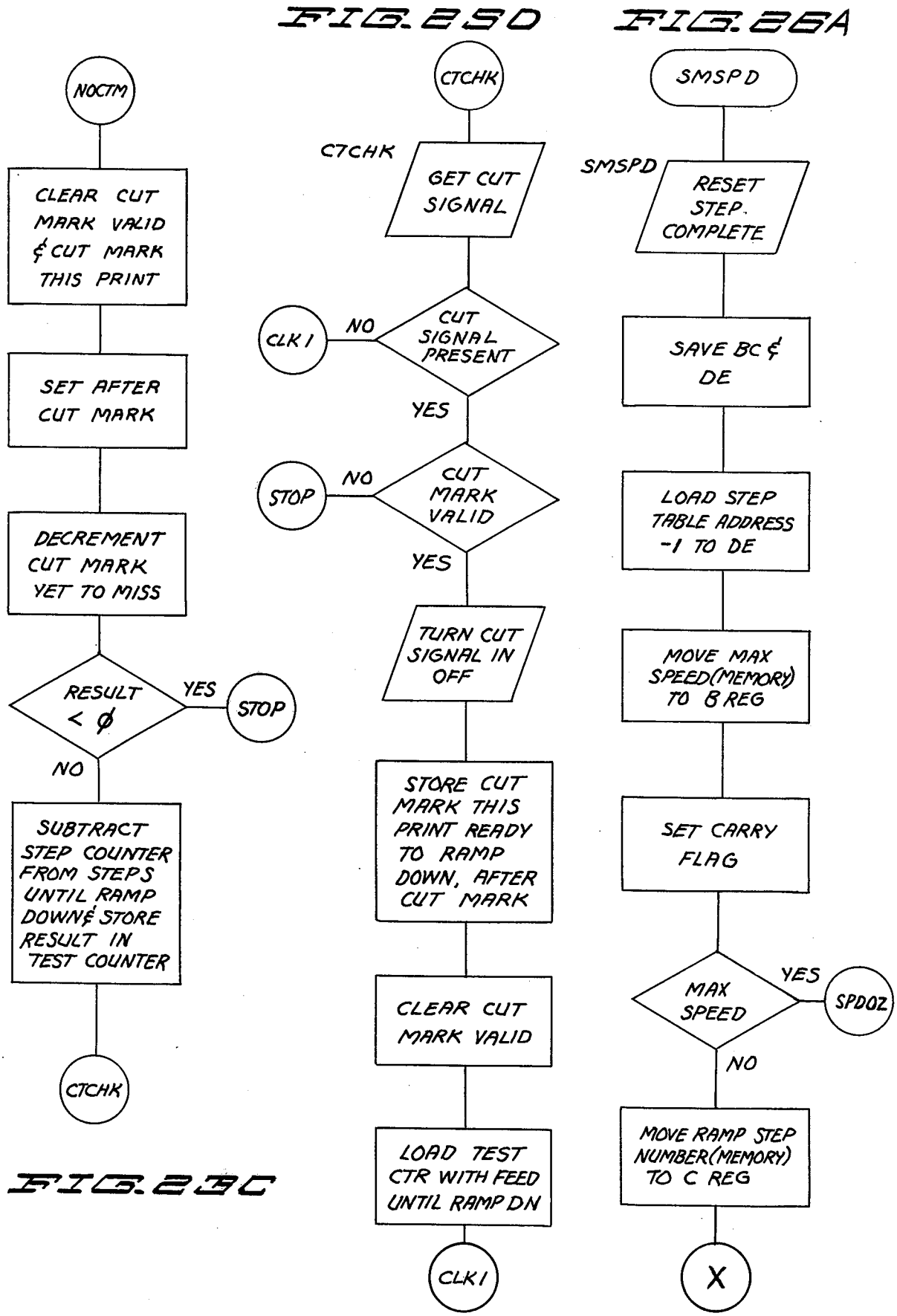
FIG. 25D
FIG. 26A
NOCTM
CLEAR CUT MARK VALID & CUT MARK THIS PRINT
SET AFTER CUT MARK
DECREMENT CUT MARK YET TO MISS
RESULT < Ø
YES
STOP
NO
SUBTRACT STEP COUNTER FROM STEPS UNTIL RAMP DOWN & STORE RESULT IN TEST COUNTER
CTCHK
FIG. 23C
CTCHK
CTCHK
GET CUT SIGNAL
CLK 1
NO
CUT SIGNAL PRESENT
YES
STOP
NO
CUT MARK VALID
YES
TURN CUT SIGNAL IN OFF
STORE CUT MARK THIS PRINT READY TO RAMP DOWN, AFTER CUT MARK
CLEAR CUT MARK VALID
LOAD TEST CTR WITH FEED UNTIL RAMP DN
CLK1
SMSPD
SMSPD
RESET STEP. COMPLETE
SAVE BC & DE
LOAD STEP TABLE ADDRESS -1 TO DE
MOVE MAX SPEED(MEMORY) TO B REG
SET CARRY FLAG
MAX SPEED
YES
SPDOZ
NO
MOVE RAMP STEP NUMBER(MEMORY) TO C REG
X

MICROPROCESSOR CONTROLLED PHOTOGRAPHIC PAPER CUTTER

REFERENCE TO CO-PENDING APPLICATIONS

Reference is made to the following co-pending patent applications which are filed on even date with this application and are assigned to the same assignee as this application: "Paper Drive Mechanism for Automatic Photographic Paper Cutter" Ser. No. 837,987 by R. Diesch; "Multichannel Indicia Sensor for Automatic Photographic Paper Cutter" Ser. No. 837,986 by R. Diesch and G. Strunc; "Stepper Motor Control" Ser. No. 837,988 by G. Strunc; "Print and Order Totalizer for Automatic Photographic Paper Cutter" Ser. No. 838,065 by G. Strunc; "Paper Feed Control for Automatic Photographic Paper Cutter" Ser. No. 838,000 by R. Diesch and G. Strunc; "Photographic Paper Cutter with Automatic Paper Feed in the Event of Occasional Missing Cut Marks" Ser. No. 837,999 by G. Strunc; and "Knife Assembly for Photographic Strip Cutter" Ser. No. 837,998 by R. Diesch. Subject matter disclosed but not claimed in the present application is disclosed and claimed in these co-pending applications.

BACKGROUND OF THE INVENTION

The present invention relates to photographic processing equipment. In particular, the present invention relates to an improved automatic photographic system which is controlled by a digital processor, such as a microprocessor.

In commercial photographic processing operations, very high rates of processing must be achieved and maintained in order to operate profitably. To expedite the photographic processing, orders containing film of similar type and size are spliced together for developing. As many as 500 to 1000 rolls of 12, 20, and 36 exposure film may be spliced together for processing and printing purposes.

After developing, the photographic images contained in the film negatives are printed in an edge-to-edge relationship on a continuous strip of photosensitive paper by a photographic printer. The photographic printer causes high intensity light to be passed through a negative and imaged on the photographic print paper. The photographic emulsion layer on the print paper is exposed and is subsequently processed to produce a print of the image contained in the negative.

After the strip of print paper has been photoprocessed to produce prints, a photographic paper cutter cuts individual prints from the strip. The prints are then sorted by customer order and ultimately packaged and sent to the customer.

Automatic print paper cutters have been developed which automatically cut the print paper into individual prints. These automatic paper cutters are controlled by indicia which are placed along the print paper by the photographic printer. Typically the indicia are of two types: cut marks and end-of-order marks. The cut marks indicate the desired location of a cut between adjacent prints. The end-of-order marks, which typically appear along the opposite edge of the print paper from the cut marks, indicate the end of a customer's order. The automatic paper cutter includes a sensor which senses the cut mark and causes the individual prints to be cut from the strip at the desired locations. The separated prints are passed to an order packaging or grouping device, which groups the prints in response to the end-of-order marks which are sensed by the automatic cutter.

The desire for high rates of processing within commercial photographic processing operations has led to the development of extremely high speed automatic paper cutters. Automatic paper cutters capable of cutting over 25,000 prints per hour (i.e. over 7 prints per second) are needed, and are being developed.

In addition to the desire for high speed operation, the users of automatic paper cutters have desired increasingly sophisticated controls and options which permit greater flexibility of operation of the automatic paper cutter. The high operating speeds together with the desire for more flexibility have placed severe demands on the electronic controls of existing automatic paper cutters. Each increase in operating speed and flexibility of operation has necessitated further electronic circuitry and generally increased the cost of the automatic paper cutter.

SUMMARY OF THE INVENTION

The present invention provides extremely flexible control and high speed operation for an automatic cutter, notcher, or printer of photographic strip material (i.e. paper or film). The present invention utilizes a programmable digital processor, which in preferred embodiments is a microprocessor, to control and coordinate the operations of the cutter. The digital processor provides these controls as a function of a step status signal which indicates whether the strip drive stepper motor has taken a step, a cut status signal which indicates whether a cut indicium on the strip has been sensed, and control information which has been stored by storage means. In preferred embodiments of the present invention, the control information and the status signals are used by the digital processor to determine the number of steps to be taken, the rate at which steps are to be taken, the time at which the paper drive will be terminated, and the time at which the knife (or other intermittently operable device) will be enabled.

BRIEF DESCRIPTION OF THE DRAWINGS

FIG. 1 is a perspective view of the automatic paper cutter of the present invention.

FIG. 3 is an electrical block diagram of the automatic paper cutter of FIG. 1.

FIG. 6 is an electrical schematic diagram of a portion of the paper cutter control of FIG. 4 including random access memories and associated memory select circuitry.

FIG. 8 is an electrical schematic diagram of the programmable input/output (I/O) device shown in FIG. 4.

FIG. 11 is an electrical schematic diagram of the stepper motor phase generator shown in FIG. 4.

FIG. 15 is an electrical schematic diagram of a portion of the auxiliary control panel.

FIGS. 17–30C are flow charts illustrating the operation of the present invention.

DETAILED DESCRIPTION OF PREFERRED EMBODIMENTS

Figure 7:
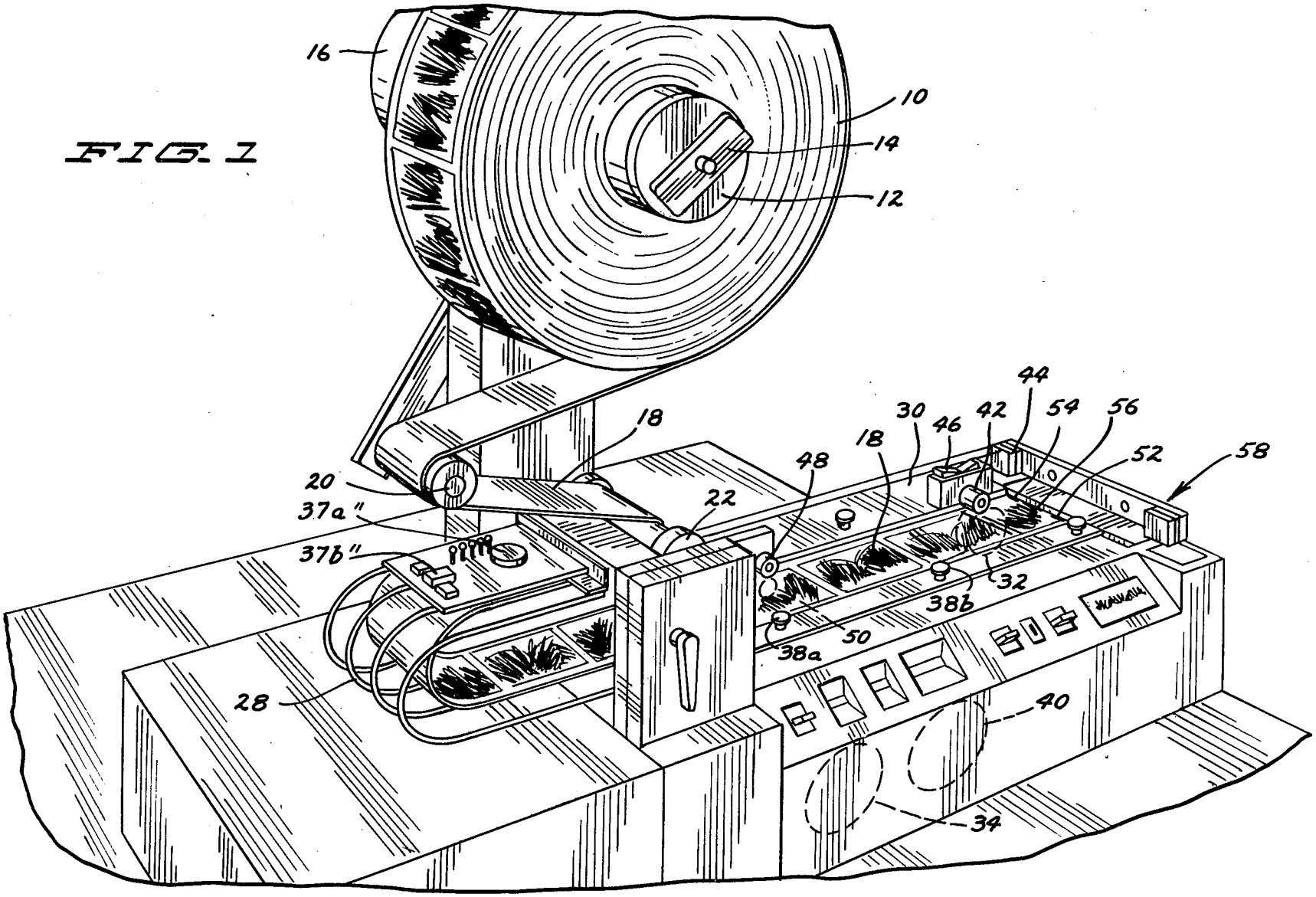
FIG. 7 is an electrical schematic diagram of a portion of the paper cutter control of FIG. 4 including read-only memories and associated memory select circuitry.

The present invention is a control system which provides efficient and flexible control of a high speed automatic cutter, notcher, or printer of photographic strip material (either paper or film). Although the present invention has application to a variety of photographic systems, it will be described in the specific context of an automatic paper cutter.

The present invention takes advantage of the processing and controlling capabilities of a programmable digital processor such as a microprocessor. All functions of the automatic cutter may be controlled by the microprocessor as a function of the stored control information together with control settings on the control panels and various status signals which indicate the status of functions being performed by the automatic cutter. Among these status signals are the step status signal, which indicates whether the paper drive system has taken a step, the cut status signal which indicates whether a cut mark has been sensed, and the end-of-order status signal which indicates whether an end-of-order cut mark has been sensed.

The following section which is entitled "System Overview", generally describes the operation of a high speed, microprocessor controlled, automatic paper cutter built in accordance with the present invention. The following section entitled "Electrical System Description" describes in detail the electrical control system of the automatic paper cutter. Finally, the section entitled "Operation" describes in detail the entire operation of the automatic paper cutter with reference to the various electrical circuits shown in the Figures and to operation flow charts and assembler listings which describe the operations of the microprocessor.

The present application describes the entire electrical control system and all of the various functions of the system in order to permit the reader a complete appreciation of the various functions and activities coordinated by the microprocessor. As a result, various features of the automatic paper cutter which are not the subject of the present invention, but rather are the subject matter of the previously mentioned copending applications, are described in this application. These features and functions of the automatic paper cutter which are the subject of the co-pending applications are included in the present application only for the sake of completeness and to permit the reader a full appreciation of the operation of the automatic paper cutter.

In the following discussion, the mechanical portions of the paper supply and paper drive system of the automatic paper cutter are described only briefly, since the present invention is directly concerned with the electrical control system of the automatic paper cutter. A more detailed description of paper supply and drive system may be found in the previously mentioned patent application entitled "Paper Drive Mechanism for Automatic Photographic Paper Cutter."

Paper Cutter System Overview

FIG. 1 is a perspective view of the high speed, microprocessor controlled, automatic paper cutter of the present invention. The paper cutter includes five major portions: a paper supply, a paper drive mechanism, a knife assembly, main and auxiliary control panels, and control electronics.

The paper supply is an integral part of the paper cutter A paper roll 10 is loaded from the front on to hub 12, and a lever 14 is tightened to hold paper roll 10 in place. By tightening lever 14, an elastomer material is expanded to give a press fit on the inside diameter of the core of paper roll 10. The rotation of hub 12 is controlled by electro-mechanical brake 16.

Paper strip 18 from roll 10 is trained over bale arm assembly 20 and guide roller 22, between drive and idler pinch rollers (not shown), into wire form retainer 28, and then to paper guides 30 and 32 of the paper drive mechanism. The drive pinch roller is driven by the same AC motor 34 which drives the knife assembly of the paper cutter. The motor 34 drive is transmitted to the drive pinch roller through a belt drive and electro-mechanical clutch 36 (shown schematically in FIG. 4).

The paper drive mechanism includes paper guides 30 and 32, which receive paper strip 18 from the paper supply assembly. Rear guide 30 is fixed and front guide 32 is movable so that various paper widths can be accommodated. Front paper guide 32 is adjusted by loosening thumscrews **38*a* and 38*b* and moving front guide 32** to the desired position.

Paper strip 18 is driven by stepper motor 40 through idler and drive pinch rollers 42 and 44. Idler roller 42 has a lever 46 to locate idler roller 42 in the engaged position for operation and in the disengaged position for loading paper, shipping, and other non-operating modes. Rollers 42 and 44 are located at the rear edge of strip 18 so that entire print is visible to the operator. Additional guidance of paper strip 18 is provided by another set of idler rollers 48 and 50, which are located near the end of the paper cutter.

Front and rear indicia sensor assemblies 52 and 54 are mounted below top plate 56 and sense all types of marks which appear on the back side of paper strip 18. Cut marks sensed by front or rear sensor assemblies 52 or 54 are used to indicate the location of a desired paper cut.

The knife assembly 58 includes a base, a spring-wrap clutch mechanism 60 (shown schematically in FIG. 4), AC motor 34 (which also drives the drive pinch roller of the paper supply), a main drive shaft, two crank arm assemblies, two vertical drive shafts, and interchangeable blades. One blade is used for cutting straight-bordered and straight-borderless prints, and another blade is used for cutting round-cornered borderless prints.

Figure 2:
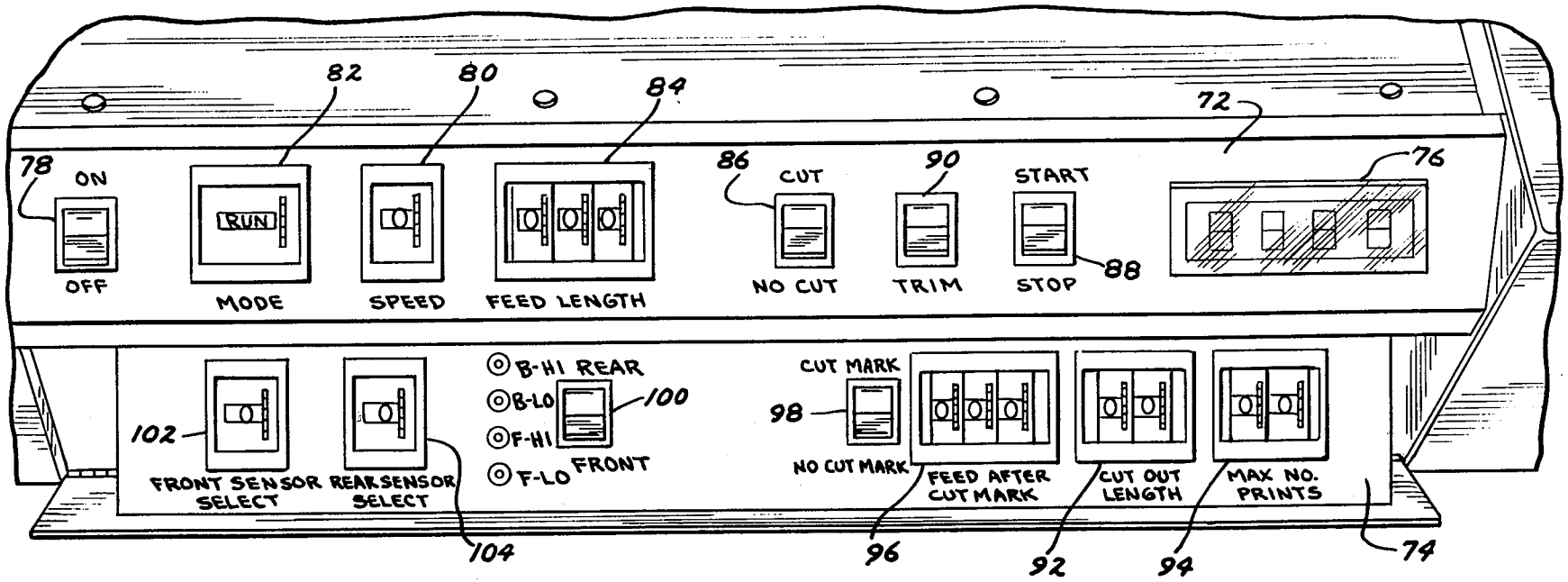
FIG. 2 shows the main and auxiliary control panels of the automatic paper cutter of FIG. 1.

FIG. 2 shows the main and auxiliary control panels 72 and 74. Main control panel 72, which is located at the front of the paper cutter, has a display 76 and seven switches. These seven switches are Power switch 78, Speed Select switch 80, Mode Select switch 82, Feed Length switch 84, Cut/No Cut switch 86, Start/Stop switch 88, and Trim switch 90.

The remaining seven switches of the automatic paper cutter are located on auxiliary panel 74, which is located below main control panel 72 and is accessible through a hinged cover. The seven switches are Length of Cutout switch 92, Maximum Number of Prints switch 94, Feed After Cut Mark switch 96, Cut Mark-/No Cut Mark switch 98, Front/Rear Cut Sensor switch 100, Front Sensor Select switch 102, and Rear Sensor Select switch 104.

The automatic paper cutter operation is commenced by turning on Power switch 78. Front paper guide 32 is then set to the appropriate paper width, paper roll 10 is installed on hub 12, and paper strip 18 is threaded through the paper supply and into the paper cutter.

The operator then selects the proper sensor assembly (either front sensor 52 or rear sensor 54) to sense cut marks by switching Front/Rear Cut Sensor switch 100 to the "Front" or the "Rear" position. The sensor assembly which is not selected is automatically used to sense end-of-order marks, which appear along the opposite edge of paper strip 18 from the cut marks.

The next step involves selecting a proper segment of the sensor assembly so that the largest sensor signal is provided. Mode switch 82 is placed in the SENSOR SELECT mode, and a portion of print paper strip 18 bearing a cut mark or end-of-order mark is oscillated back and forth past the sensor assembly. The operator sets the Front and Rear Sensor Select switches 102 and 104 to the settings which select the proper segments of sensor assemblies 52 and 54 so that the largest sensor signals are provided.

Mode switch 82 is then set to the FEED LENGTH CALIBRATE mode, Start switch 88 is actuated and one print is fed from cut mark to cut mark. The feed length is displayed on display 76 and that value is set into Feed Length switch 84 by the operator.

The operator then sets Mode switch 82 to the FEED AFTER SENSE mode. The edge of a print is aligned with a calibration mark on one of the paper guides 30 and 32. Start switch 88 is actuated and the paper advances to the next cut mark and stops. The feed after sense length is displayed on display 76, and the operator sets that value into Feed-After-Sense switch 96.

The operator then sets Mode switch 82 to the RUN mode and sets Speed switch 80 to the desired cycle rate. If bordered or round-cornered borderless prints are being cut, the paper cutter is then ready to operate. If straight borderless prints are being cut, the length of cutout must be set in Length of Cutout switch 92.

Automatic operation of the paper cutter can then be commenced by actuating Start switch 88. At the end of a shift or the end of a day, summary modes are available in which the total prints cut and total orders cut during that shift or that day are displayed on display 76.

Electrical System Description

FIG. 3 is an electrical block diagram of the automatic photographic paper cutter. As shown in FIG. 3, power supply 150 supplies power to the various circuits and motors contained in the paper cutter. Power supply 150 is controlled by Power switch 78.

Paper cutter control 154 controls the operation of the paper cutter. Paper cutter control 154 receives inputs from the various switches of main control panel 72 and auxiliary panel 74 through control panel logic circuit 156. In addition, signals from reject/remake sensor 158, front indicia sensor 52 and rear indicia sensor 54 are processed by sensor amplifier circuit 160 and supplied through auxiliary panel 74 and control panel logic 156 to paper cutter control 154. Paper cutter control 154 also may receive inputs from optional foot switch 162 and print packer 164. Foot switch 162 is connected in parallel with the start contacts of start/stop switch 88 of main control panel 72 and allows the operator to initiate a feed-and-cut cycle without the use of hands. Packer 164 may be a photographic print sorter and packer such as the PAKOMP II photopacker manufactured by PAKO Corporation. If the paper cutter is to be used in conjunction with packer 164, inter connection is necessary in order to coordinate the operation of the two devices.

The outputs of paper cutter control 154 control the operation of stepper motor 40. Control of AC motor 34 is achieved by means of knife clutch 60, paper clutch/-brake driver assembly 166, paper brake 16, and paper clutch 36. Paper cutter control 154 also supplies signals to control panel logic 156 which control display 76 on the main control panel 72, and supplies output signals to packer 164 if the paper cutter is being used in conjunction with packer 164.

Figure 4:
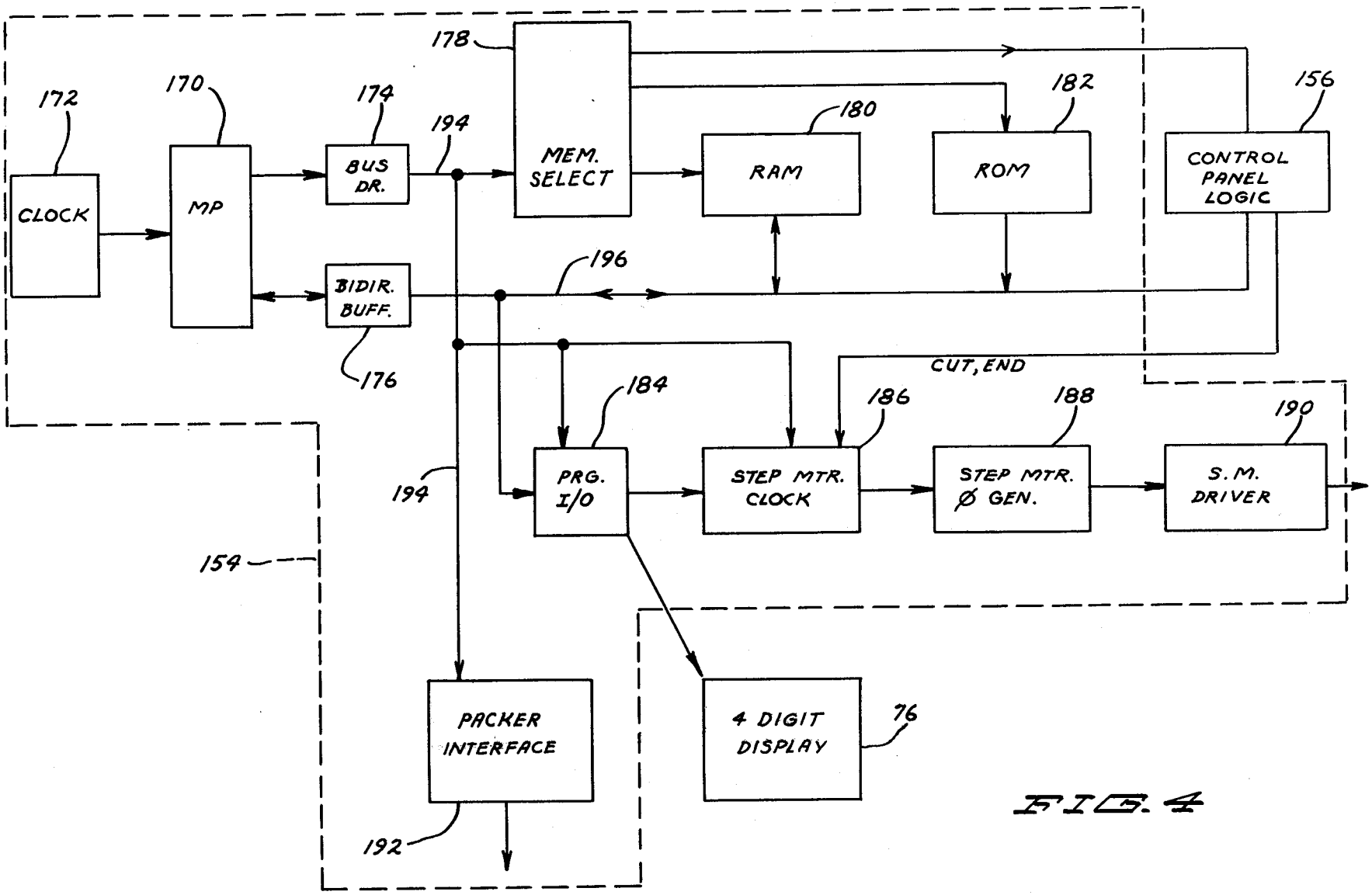
FIG. 4 is an electrical block diagram of the paper cutter control shown in FIG. 3.

FIG. 4 shows an electrical block diagram of paper cutter control 154. The paper cutter control includes microprocessor 170, clock 172, bus driver 174, bidirectional buffer 176, memory select circuit 178, random access memory (RAM) 180, read only memory (ROM) 182, programmable input/output (I/O) device 184, stepper motor clock 186, stepper motor phase generator 188, stepper motor driver 190, and packer interface circuit 192.

In one preferred embodiment, microprocessor 170 is an 8-bit microprocessor such as the Intel 8080A. Clock circuit 172 supplies clock signals, together with some other related signals, to microprocessor 170. Bus driver 174 receives outputs from microprocessor 170 and drives various lines of address bus 194. Memory select circuit 178 receives the signals from address bus 194 and addresses selected locations of RAM 180 and ROM 182. In addition, memory select circuit 178 may address the control panel logic 156 shown in FIG. 3 to interrogate the various switches of main and auxiliary control panels 72 and 74. In the system shown in FIG. 4, the switches of main and auxiliary panels 72 and 74 are addressed in the same manner as a memory location. Data to and from RAM 180 and data from ROM 182 and control panel logic 156 is supplied over data bus 196. Bidirectional buffer 176 interconnects microprocessor 170 with data bus 196.

Programmable I/O device 184 is also connected to data bus 196 and receives data from microprocessor 170. This data is used to control operation of stepper motor 40 through stepper motor clock 186, stepper motor phase generator 188, and stepper motor driver 190. In addition to the output signals from programmable I/O device 184, stepper motor clock receives the CUT and END signals from control panel logic 156.

Programmable I/O device 184 also controls the operation of display 76. Depending upon the particular mode selected by mode switch 82 on main control panel 72, display 76 may display the feed length, the feed-after-sense length, the number of prints in the previous order, the total number of prints since the cutter was turned on, or the total number of orders since the cutter was turned on.

As shown in FIG. 4, packer interface circuit 192 is also connected to address bus 194. Packer interface circuit 192 supplies the necessary signals to packer 164 of FIG. 3 to coordinate the operation of packer 164 with the operation of the automatic paper cutter.

Figure 5:
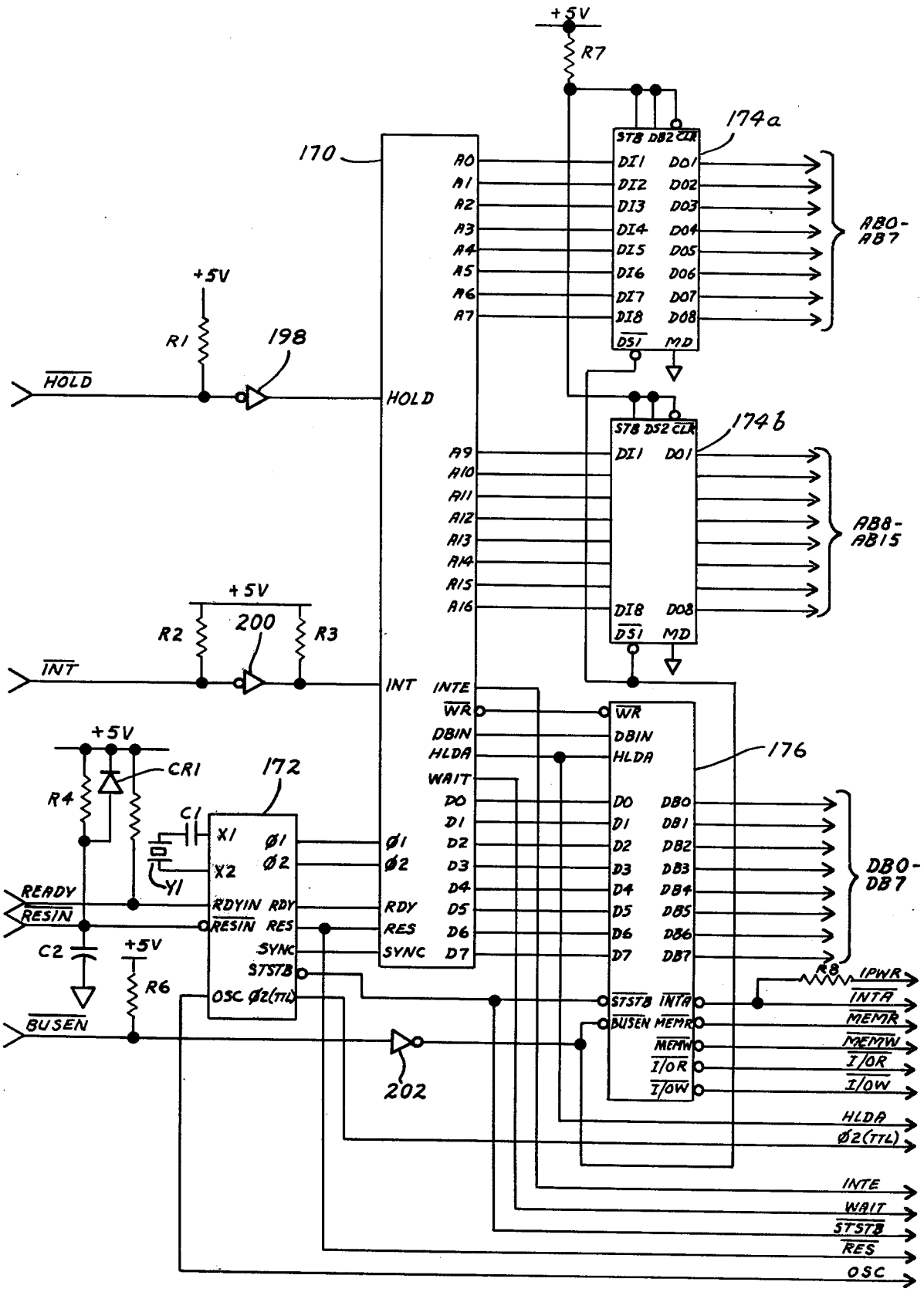
FIG. 5 is an electrical schematic diagram of a portion of the paper cutter control of FIG. 4 including a microprocessor, a clock, bus drivers, and a bidirectional buffer.
Figure 5:
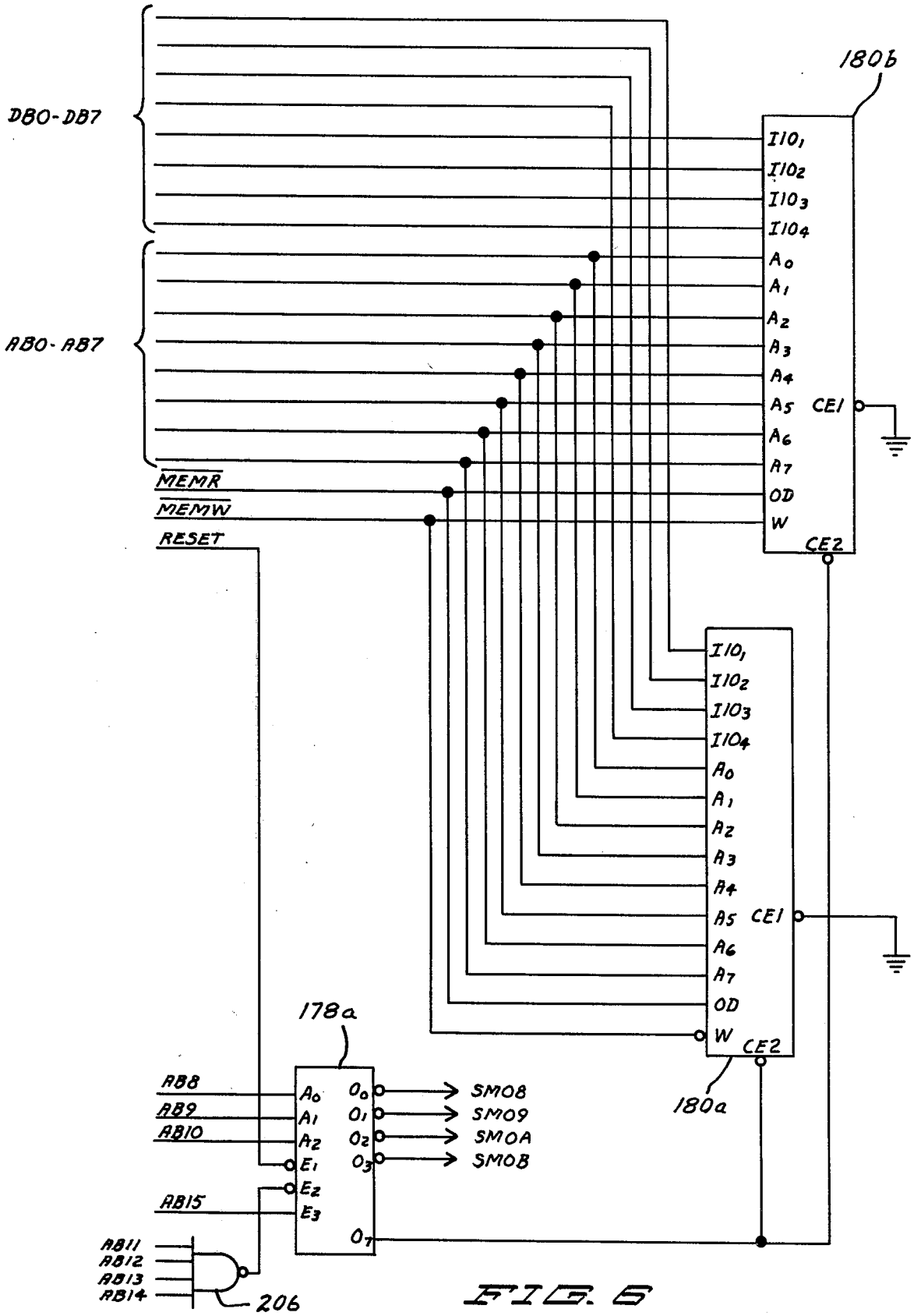
Figure 7:
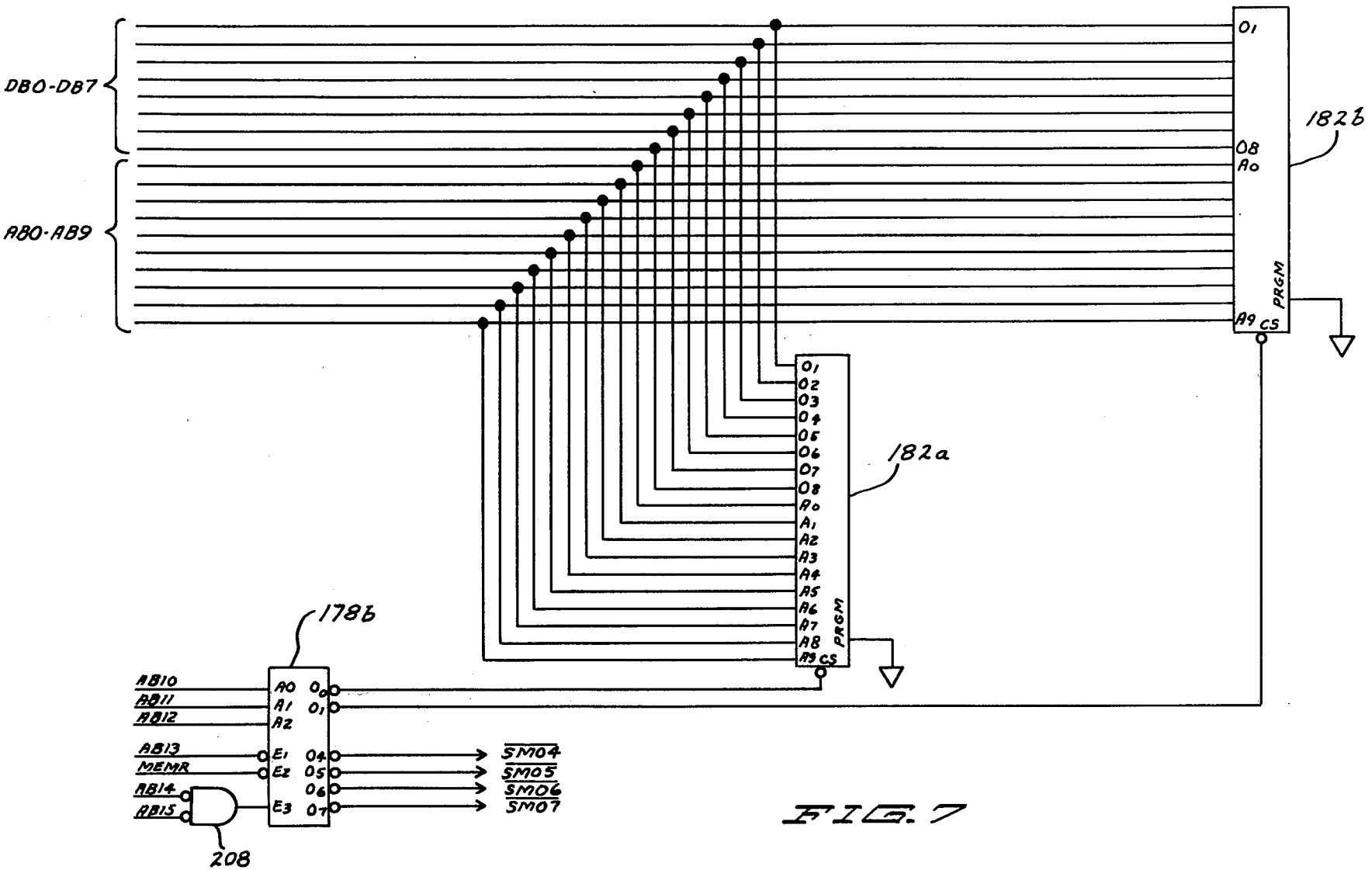

FIG. 5 shows a portion of cutter control 154 including microprocessor 170, clock 172, bus drivers 174a and 174b, and bidirectional buffer 176. Also included in the circuit of FIG. 8 are resistors R1-R8, capacitors C1 and C2, diode CR1, and inverters 198, 200, 202, and 204.

Clock 172, which in one preferred embodiment is an Intel 8224 integrated circuit, provides the $\phi 1$ and $\phi 2$ clock signals to microprocessor 170. The frequency of the $\phi 1$ and $\phi 2$ clock signals is determined by oscillator crystal Y1 and capacitor C1. In one preferred embodiment, crystal Y1 is selected to provide an 18.432 MHz oscillation.

In addition to the $\phi 1$ and $\phi 2$ clock signals, clock generator 172 also provides the RDY, $\overline{\text{RES}}$, and SYNC signals to microprocessor 170, the $\overline{\text{STSTB}}$ signal to bidirectional buffer 176, and the $\phi 2$ (TTL) and OSC signals to other circuits within cutter control 154.

In addition to the signals supplied by clock 172, microprocessor 170 receives the HOLD signal from inverter 198 and the interrupt (INT) signal from inverter 200. The outputs of microprocessor 170 include address lines A0-A15, which are supplied to bus drivers 174a and 174b. The outputs of bus drivers 174a and 174b are address bus lines AB0-AB15, which form a 16 line address bus 194. Bus drivers 174a and 174b are enabled by the BUSEN signal from inverter 202.

Microprocessor 170 includes input/output ports D0-D7 for receiving and supplying data. D0-D7 are connected to bidirectional buffer 176, which also receives the WR, DBIN, and HLDA signals from microprocessor 170, the STSTB signal from clock 172, and the BUSEN signal from inverter 202.

Data lines DB0-DB7 of data bus 196 are connected to bidirectional buffer 176, which permits bidirectional flow of data on data bus 196 to and from microprocessor 170. In addition, bidirectional buffer 176 generates the $\overline{\text{INTA}}$, IPWR, $\overline{\text{MEMR}}$, $\overline{\text{MEMW}}$, $\overline{\text{I/OR}}$, and $\overline{\text{I/OW}}$ signals which determine the direction of flow of data on data bus 196 and control the operation of the various circuits connected to data bus 196.

The remaining signals generated by the circuit shown in FIG. 5 are generated by microprocessor 170. These signals are the HLDA, INTE, and WAIT signals.

FIG. 6 shows random access memories 180a and 180b, together with NAND gate 206 and memory select circuit 178a. In a preferred embodiment, random access memories 180a and 180b are Intel 8111-4 integrated circuits and memory select 178a is an Intel 8205 integrated circuit.

Depending upon the states of address bus lines AB8-AB15, memory select 178a provides an enable signal to either RAM 180a or 180b, or will generate an enable signal on lines SM08, SM09, SM)A, or SMOB.

If either RAM 180a or RAM 180b is selected, data will either be written into or read from memory locations of the RAM. The state of the MEMW signal, which is supplied to the W inputs of RAMs 180a and 180b determines whether data is written or read.

As shown in FIG. 6, the random access memory includes only two RAM integrated circuits 180a and 180b. If further storage is required, as many as six additional RAM integrated circuits may be connected and addressed by memory select 178a. In the embodiment of the automatic paper cutter described in the present application, however, two RAM integrated circuits is sufficient to provide the necessary storage.

FIG. 7 shows ROMs 182a and 182b, memory select circuit 178b, and NAND gate 208. Memory select circuit 178b enables either ROM 182a or 182b depending upon the state of address bus lines AB10-AB15 and the $\overline{\text{MEMR}}$ signal. In addition, memory select circuit 178b produces the $\overline{\text{SMO4}}$ - $\overline{\text{SMO7}}$ signals.

In a preferred embodiment, ROMs 182a and 182b are erasable programmable read-only memories (EPROM) such as the Intel 8708. When either ROM 182a or 182b is enabled, address bus lines AB0-AB9 select the particular memory location, and data read from that location is supplied on data bus lines DB0-DB7.

As in the case of the random access memory shown in FIG. 6, the read-only memory of FIG. 7 may include additional memory circuits if additional storage is required. With the configuration shown in FIG. 7, two additional Intel 8708 EPROMs may be added without requiring additional memory select circuitry.

FIG. 8 shows programmable I/O device 184 together with NAND gates 210 and 212 and inverter 214. In a preferred embodiment, programmable I/O device 184 is an Intel 8255 integrated circuit and NAND gates 210 and 212 and inverter 214 and TTL logic gates. Except where otherwise specifically indicated, all logic gates shown in the Figures are CMOS integrated circuit devices.

Programmable I/O device 184 receives data bus lines DB0-DB7, address bus lines AB0 and AB1, and the $\overline{\text{I/OW}}$, $\overline{\text{I/OR}}$ and RES lines. In addition, address bus lines AB2 and AB3 are NANDed by NAND gate 210, whose output is NANDed with address bus line AB13 by NAND gate 212. The output of NAND gate 212 is inverted by inverter 214 and supplied to the $\overline{\text{CS}}$ input of programmable I/O device 184.

Programmable I/O device 184 has two 8-line outputs. The first set of 8 outputs, which are designated PA0-PA7, are supplied to the inputs of stepper motor clock generator 186. The 8-bit number supplied on lines PA0-PA7 is used to control the frequency of the output of the stepper motor clock generator 186 and, therefore, the speed of stepper motor 40.

The PB0-PB7 outputs from programmable I/O device 184 are supplied to the main control panel 72. Lines PB0-PB7 are decoded and are used to drive display 76.

Figure 9:
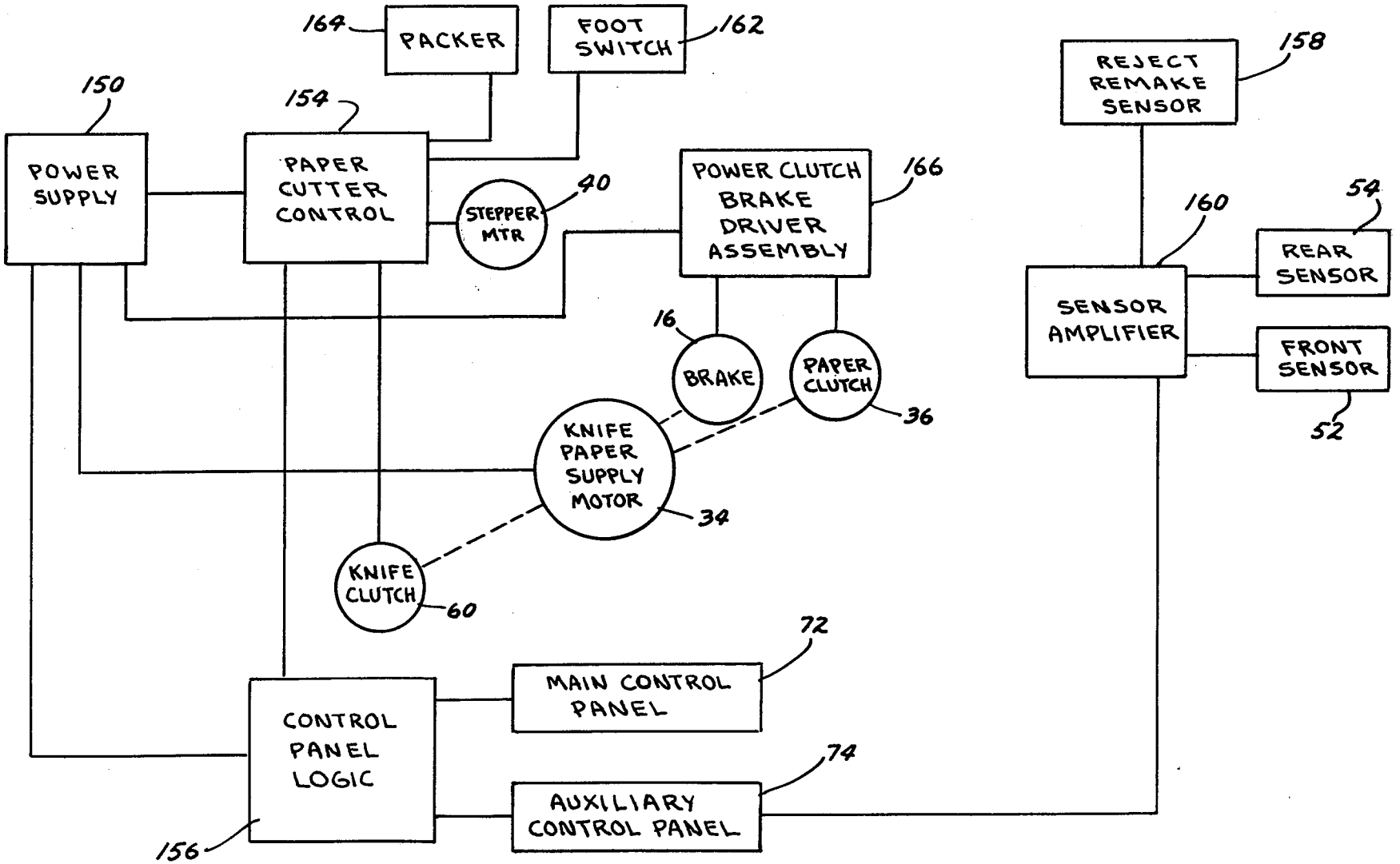
FIG. 9 is an electrical schematic diagram of the packer interface shown in FIG. 4.

FIG. 9 shows circuitry which is primarily the packer interface 192 as shown in FIG. 4. This circuitry is used to provide the necessary signals to packer 164 shown in FIG. 3 in order to coordinate the operation of the automatic paper cutter with packer 164.

The interface circuitry of FIG. 9 includes an 8-bit adjustable latch 216, TTL NAND gates 218 and 220, and driver circuits 222, 224, 226, and 228 for producing the P SORT MARK + and −, ADVANCE COMPLETE + and −, END OF ORDER + and −, PRINT CUT + and − signals which are supplied to packer 164. In addition, FIG. 9 includes circuit 230 which receives the START + and − signals from packer 164 and supplies the START signal to control panel logic 156. Finally, FIG. 9 includes driver circuit 232 which produces the CTSEG signal which energizes the cutter knife.

The A0, A1, and A2 inputs of latch 216 receive the AB8, AB9, and AB10 address bus lines. The D input of latch 216 is connected to AB11, the R input receives the $\overline{\text{RES}}$ signal, and the E input receives an enable signal which results from the NANDing of $\overline{\text{I/OW}}$, AB12, and AB14 by NAND gates 218 and 220.

The Q0 output of latch 216 is supplied through resistor R9 to stepper motor driver 190 as the OFF - signal. The Q1 output of latch 216 is the CTSON signal which is supplied to driver circuit 232. When the CTSON and LPP12 signals are high and the CUT signal is low, driver circuitry 232 provides the CTSEG signal which controls the operation of the cutter knife assembly.

Outputs Q2-Q5 of latch 216 are used to generate signals for packer 164. The Q2 output is supplied to driver circuit 222, which generates the P SORT MARK + and P SORT MARK - signals. Driver circuit 222 also receives the RRS signal from sensor amplifier 160. The RRS signal is high if reject/remake sensor 158 senses a mark on a print indicating that the print is a reject or a remake print.

The Q3 output of latch 216 is supplied to driver circuit 224, which provides the ADVANCE COMPLETE + and ADVANCE COMPLETE − signals to packer 164. Similarly, the Q4 output is supplied to driver circuit 226, and a Q5 output is supplied to driver circuit 228. Driver circuit 226 supplies the END OF ORDER + and END OF ORDER − signals to packer 164, while driver circuit 228 supplies the PRINT CUT + and PRINT CUT − signals to packer 164.

Circuit 230 shown in FIG. 9 receives the START + and START − signals from packer 164 and generates a START signal which is supplied to control panel logic 156. The START signal allows packer 164 to initiate a paper feed and cut cycle independent of start switch 88 on main control panel 72.

Figure 10A:
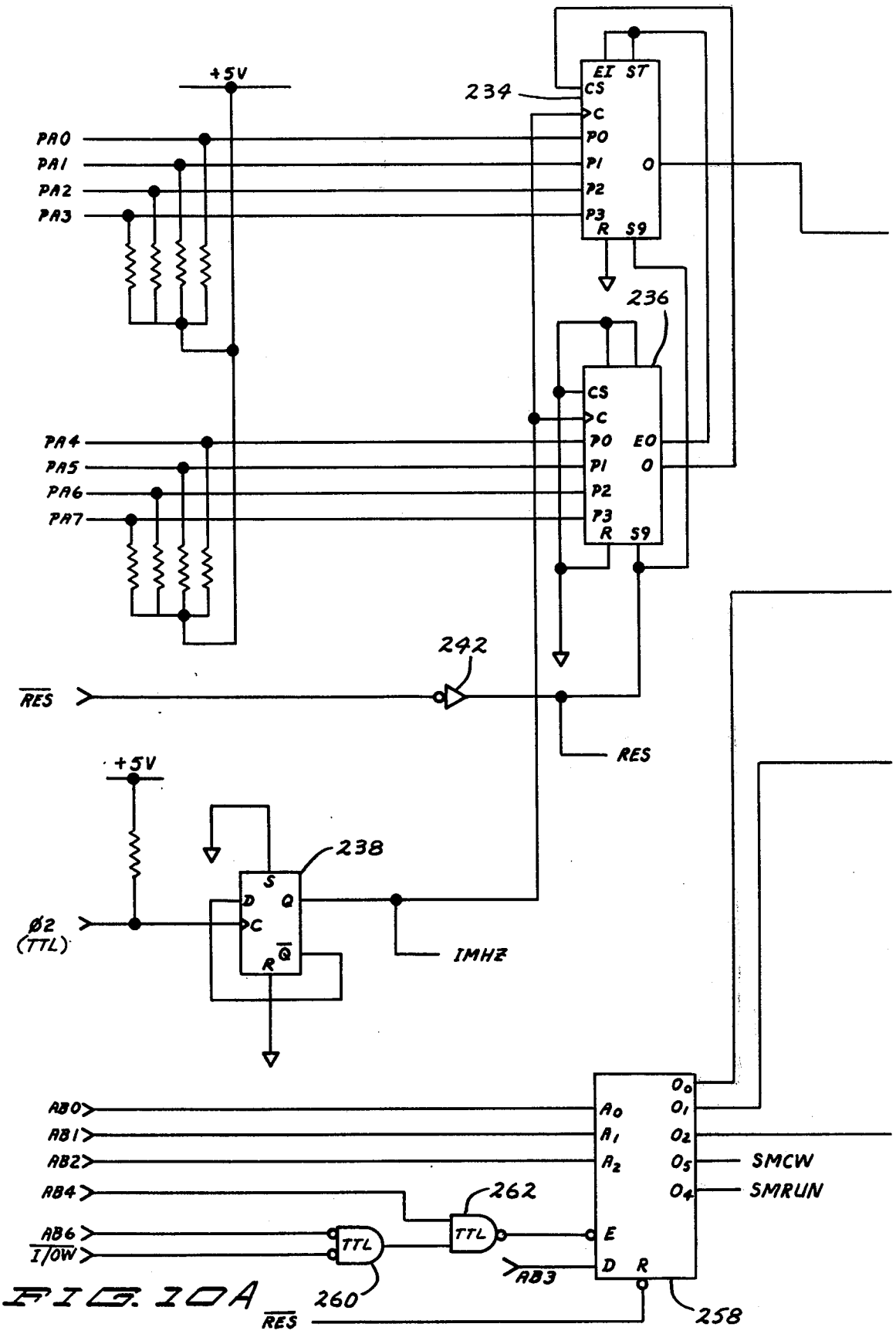
FIGS. 10A and 10B are an electrical schematic diagram of the stepper motor clock shown in FIG. 4.
Figure 10B:
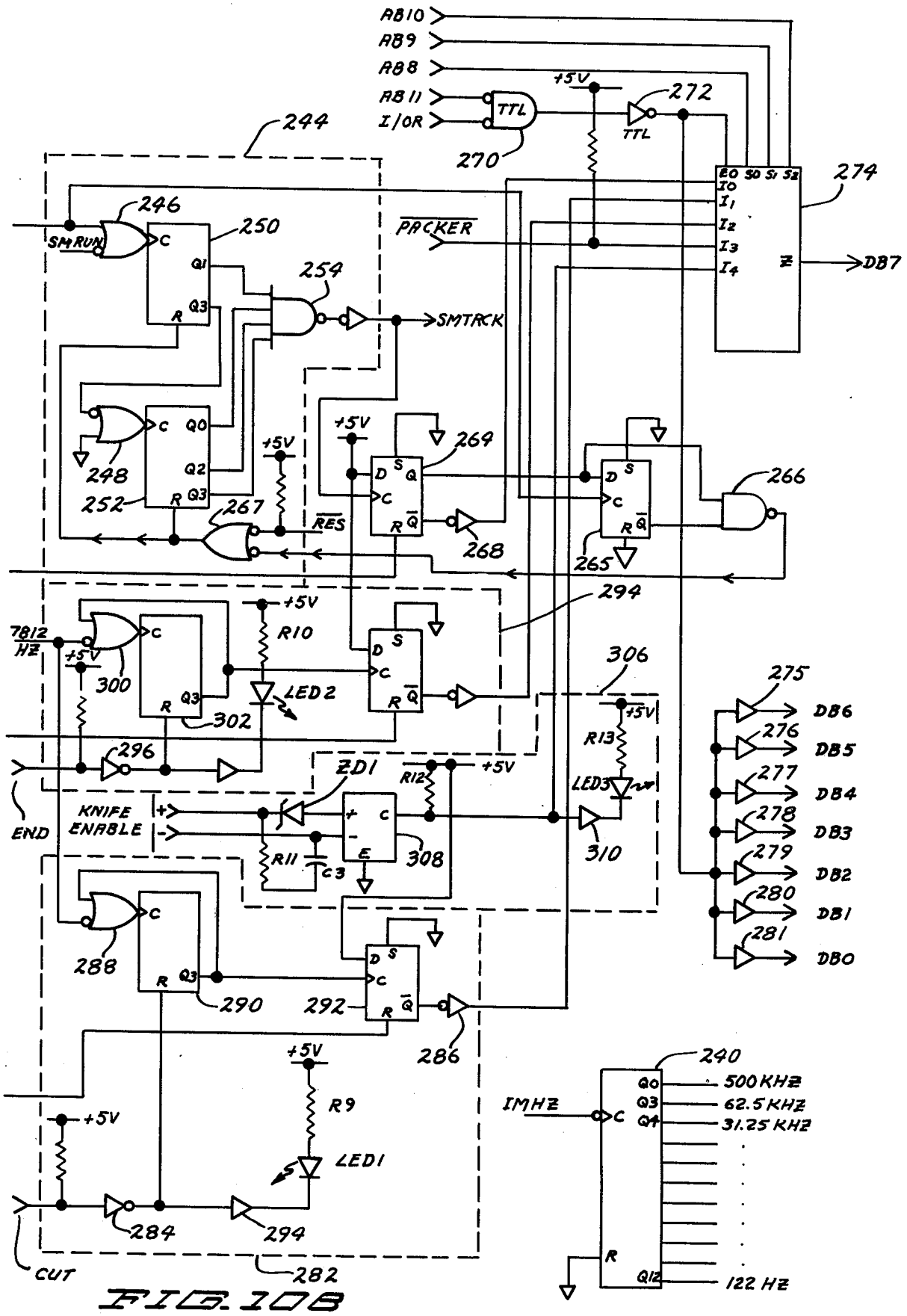

FIGS. 10A and 10B show stepper motor clock 186, which produces the SMTRCK and SMCW signals. The SMTRCK signal is a stepper motor clock signal, and each pulse of the SMTRCK signal corresponds to one step of stepper motor 40. The SMCW signal determines whether stepper motor will be driven clockwise or counter-clockwise. Both the SMTRCK and SMCW signals are provided to stepper motor phase generator 188.

The frequency of the SMTRCK signal is determined by inputs PA0-PA7, which are received from programmable I/O device 184. These inputs represent a two-digit binary coded decimal (BCD) number. Inputs PA0-PA3 represent the least significant bit, and PA4-PA7 represent the most significant bit. BCD rate multiplier 234 receives inputs PA0-PA3, and BCD rate multiplier 236 receives input PA4-PA7. The two-bit BCD numbers supplied to rate multipliers 234 and 236 represent the number of output pulses produced by the 0 output of rate multiplier 234 per one hundred clock pulses from flipflop 238. In the embodiment shown in FIGS. 10A and 10B, flipflop 238 receives the $\phi 2$ signal which has a frequency of 2MHz from clock 172 and divides the frequency in half to produce a 1MHz clock signal. In addition to supplying the 1MHz signal to rate multipliers 234 and 236, flipflop 238 also supplies the signal to the clock input of counter 240, which divides the frequency to generate other needed clock frequencies.

The $\overline{\text{RES}}$ signal, which is low when power is turned on, is inverted by TTL inverter 242. The RES signal, which is the output of inverter 242, is supplied to the S9 inputs of rate multipliers 234 and 236 to enable them.

The output of rate multiplier 234 is a pulse signal. The number of pulses per one hundred clock pulses is determined by the BCD number supplied on lines PA0-PA7. This number may vary from 0 to 99.

The output of rate multiplier 234 is supplied to a smoothing circuit 244 formed by OR gates 246 and 248, counters 250 and 252, NAND gate 254, and inverter buffer 256. The output of smoothing circuit 244 is the SMTRCK signal. The purpose of smoothing circuit 244 is to smooth variations in spacing between output pulses of rate multiplier 234. The SMTRCK signal is a signal whose spacing between pulses is relatively uniform and whose frequency is determined by the BCD inputs to rate multipliers 234 and 236.

It can be seen that stepper motor clock 186 shown in FIGS. 10A and 10B permits control of the frequency of the SMTRCK signal and, therefore, control of the speed of stepper motor 40 by microprocessor 170. The desired values for the BCD inputs to rate multipliers 234 and 236 are preferably stored in "look-up tables". These lookup tables contain numbers which control the maximum frequency of the SMTRCK signal, as well as a set of frequencies used to generate an up ramp in frequency at the beginning of stepper motor operation or a down ramp in frequency at the end of stepper motor operation.

The remaining circuitry shown in FIGS. 10A and 10B allow microprocessor 170 to monitor status of a number of important signals and to control generation of the SMTRCK as a function of the status of these signals. The first portion of this circuitry includes 8-bit adjustable latch 258, TTL NAND gates 260 and 262, flipflops 264 and 265, NAND gate 266, NOR gate 267, and inverter 268. Latch 258 is enabled when AB4 is high, AB6 and I/OW are low, and power is on so that the reset signal ($\overline{\text{RES}}$) is low. The output states of latch 258 are determined by address bus lines AB0-AB3.

The $O_0$ and $O_4$ outputs of latch 258 directly control the production of the SMTRCK signal. The $O_4$ output is the SMRUN signal, which is supplied to the inverting input of OR gate 246 and which must be high for the SMTRCK signal pulses to be produced.

When a SMTRCK signal pulse is produced, it clocks flipflop 264 and causes the $\overline{Q}$ output of flipflop 264 to go low. This causes a high reset signal to be supplied to counters 250 and 252 by NOR gate 266. Further SMTRCK pulses are inhibited, therefore, until the $O_0$ output of latch 258 resets flipflop 264. The stepper motor clock, therefore, produces only one pulse at a time and microprocessor 170 must cause flipflop 264 to be reset before the next SMTRCK pulse (and therefore the next stepper motor step) is produced.

Microprocessor 170 periodically interrogates the status of flipflop 264, as well as the status of several other signals. This interrogation is achieved by TTL NAND gate 270, TTL inverter 272, 8-bit multiplexer 274, and buffers 275-281.

The state of the $I_0$ input to multiplexer 274 indicates the state of flipflop 264. This input, therefore, indicates whether a SMTRCK pulse has been produced and a step of the stepper motor has been taken.

The $I_1$ input to multiplexer 274 is received from the CUT signal status circuit 282, which includes inverters 284 and 286, OR gate 288, counter 290, flipflop 292, and an indicator circuit formed by buffer 294, resistor R9, and light emitting diode LED1. Prior to receiving the CUT signal, which indicates that a cut mark has been sensed, the $\overline{Q}$ output of flipflop 292 is high and the $I_1$ input to multiplexer 274 is low. When the CUT signal goes high, the output of inverter 284 goes low, thereby removing the reset from counter 290 and causing LED 1 to turn on. If the CUT signal remains high for the time required for counter 290 to count until its $Q_3$ output goes high, flipflop 292 will be clocked and the $\overline{Q}$ output will go low. A high input at the $I_1$ input to multiplexer 274, therefore, indicates a cut mark has been sensed. The $I_1$ input remains high until flipflop 292 is reset by the O2 output of latch 258.

The $I_2$ input to multiplexer 274 is received from the END signal status circuit 294. END signal status circuit 294 is essentially identical to cut signal status circuit 282 and contains inverters 296 and 298, OR gate 300, counter 302, flipflop 304, and an indicator circuit including buffer 306, resistor R10, and LED2. The $I_2$ input to multiplexer 274 is low until the END signal goes high, at which time input $I_2$ goes high. It remains high until flipflop 304 is reset by the $O_1$ output of latch 258.

The $I_3$ input to multiplexer 274 is the $\overline{\text{PACKER}}$ signal. This signal indicates whether the automatic paper cutter is being operated in conjunction with a photo packer.

The $I_4$ input to multiplexer 274 is received from KNIFE ENABLE status circuit 306, which includes resistors R11 and R12, capacitor C3, Zener diode ZD1, optoisolator 308, and an indicator circuit formed by buffer 310, LED3, and resistor R13. KNIFE ENABLE status circuit 306 receives the KNIFE ENABLE + and − signals from packer 164. The $I_4$ input to multiplexer 274 is high when the KNIFE ENABLE + and − signals from packer 164 call for enabling of the paper cutter knife assembly.

Microprocessor 170 interrogates multiplexer 274 when the AB11 and I/OR signals are low. This causes multiplexer 274 to be enabled and also causes the outputs of buffers 275-281, which are connected to data bus lines DB0-DB6, to be low. Only DB7, which is the output of the multiplexer 274, supplies data to microprocessor 170. Address lines AB8-AB10 select the particular input of multiplexer 274 which is connected to DB7.

Stepper motor phase generator circuit 188 receives the SMTRCK and SMCW signals from stepper motor clock 186 of FIGS. 10A and 10B. Stepper motor phase signals are generated in response to the SMTRCK signal and supplied to stepper motor driver 190. Each pulse of the SMTRCK results in one step of stepper motor 40. The SMCW signal determines the direction of the stepper motor steps by controlling the phase relationship of the stepper motor phase signals produced by stepper motor phase generator circuit 188.

FIG. 11 shows stepper motor phase generator circuit 188, which includes flipflops 312, 314, 316, and 318; NAND gates 320, 322, 324, and 326; inverters 328, 330, 332, 334, and 336; resistors R14-R17; and quad 2-bit multiplexer 338. The stepper motor phase generator circuit receives the SMTRCK, SMCW, and RES signals and supplies the $\phi$AD-, $\overline{\phi\text{AD}}$-, $\phi$BD-, and $\overline{\phi\text{BD}}$- signals to stepper motor driver 190.

The stepper motor phase generator circuit shown in FIG. 11 is a half-step phase generator, which provides greater accuracy in stepper motor operation at the expense of some torque. The $\phi$AD-, $\overline{\phi\text{AD}}$-, $\phi$BD- and $\overline{\phi\text{BD}}$- signals are generated in response to the SMTRCK signal from stepper motor clock 186. The phase relationship of these signals determines the direction in which the stepper motor steps. This phase relationship is controlled by the SMCW signal, which is supplied to quad 2-bit multiplexer 338. The outputs of quad 2-bit multiplexer 338 are supplied to the D inputs of flipflops 312, 314, 316, and 318.

Figure 12:
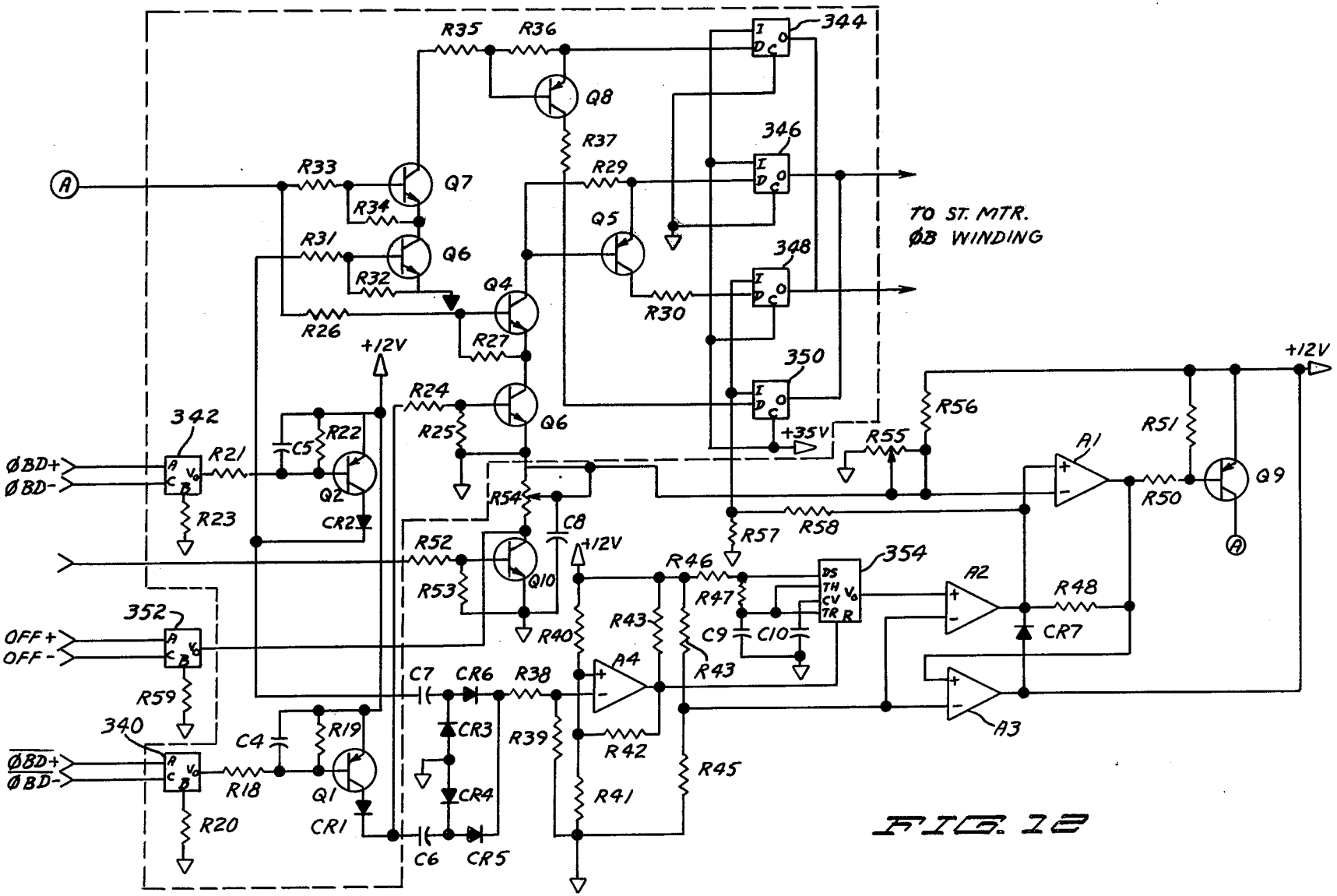
FIG. 12 is an electrical schematic diagram of a portion of the stepper motor driver shown in FIG. 4.

FIG. 12 is a schematic diagram of the portion of the stepper motor driver 190 which receives the $\phi$BD- and $\overline{\phi\text{BD}}$- and OFF-signals. This portion of stepper motor driver 190 controls the $\phi$B windings of stepper motor 40. An identical circuit receives the $\phi$AD-, $\overline{\phi\text{AD}}$- and OFF- and controls the $\phi$A windings of stepper motor 40.

The stepper motor driver circuit is shown in FIG. 12 includes two major parts. The first part is driver circuitry which generates the $\phi$BM1 and $\phi$BM2 signals. The second part controls the current levels supplied to the stepper motor winding to prevent the $\phi$BM1 and $\phi$BM2 signals from supplying excessive current. The first part of the circuit includes optoisolators 340 and 342, transistors Q1-Q8, resistors R18-R37, capacitors C4 and C5, diodes CR1-CR2, and coil drivers 344, 346, 348, and 350.

The second part of the circuit includes optoisolator 352, transistors Q9 and Q10, comparators A1-A4, oscillator 354, diodes CE3-CR7, capacitors C6-C10, and resistors R38-R59. The output of the second part of the circuit is derived from the collector of transistor Q9 and is supplied to the bases of transistors Q5 and Q6 of the first part of the circuit.

As shown in FIG. 12, the $\phi$BD+ and $\overline{\phi\text{BD}}$+ signals are maintained at a constant voltage of +5 volts. The outputs of optoisolators 340 and 342, therefore, are controlled by the $\phi$BD- and $\overline{\phi\text{BD}}$- signals. When the $\overline{\phi\text{BD}}$- signal goes high, the output of optoisolator 340 goes low, thereby turning on transistor Q1. At the same time, the $\phi$BD- signal goes low, thereby causing output of optoisolator 342 to go high and turning transistor Q2 off.

When transistor Q1 turns on, it supplies current through diode CR1 to the base of transistor Q3. Because transistor Q4 is also turned on, the signal to the base of transistor Q3 will turn it on, which turns transistor Q5 on. At the same time, since transistor Q2 is turned off, transistors Q6 and Q8 are turned off.

Transistors Q5 and Q8 control the signals at the D inputs of drivers 344, 346, 348, and 350. The outputs of drivers 344, 346, 348, and 350 are connected to provide the $\phi$BM1 and $\phi$BM2 signals to the $\phi$B windings of stepper motor 40.

The second part of the circuitry shown in FIG. 12 controls the amount of current supplied to the stepper motor windings. This control is provided through transistors Q4 and Q7. Then these transistors are turned off, no current may be supplied to the stepper motor windings.

Transistors Q4 and Q7 are controlled by the signal at the collector of transistor Q9. When transistor Q9 is turned on, transistors Q4 and Q7 are turned on. Conversely, when transsistor Q9 is turned off, transistors Q4 and Q7 are turned off.

Transistor Q9 is controlled by the output of comparator A1. The noninverting input of comparator A1 received a signal from resistors R57 and R58 which is indicative of the current being supplied to the stepper motor windings. The inverting input of comparator A1 receives a reference signal which is controlled by a run current adjust circuit formed by resistor R55 and potentiometer R56 and a hold current adjust circuit formed by optoisolator 352, resistors R52, R53, and R59, potentiometer R54, transistor Q10, and capacitor C8. Whenever the signal at the noninverting input of comparator A1 exceeds the reference signal at the inverting input, the output of the comparator A1 goes high, and transistor Q9 turns off. This provides a current limiting function.

The outputs of comparators A2 and A3 are also connected to the noninverting input of comparator A1. The output of comparator A2 is directly connected to the noninverting input, while the output of comparator A3 is connected through diode CR7 to the noninverting input.

The output state of comparator A2 is controlled by oscillator 354, which in a preferred embodiment is a 20KHz oscillator. Oscillator 354 has its reset input connected to the output of comparator A4. When the output of comparator A4 is high, oscillator 354 is inhibited from oscillating. Conversely, when the output of comparator A4 is low, the reset is removed from oscillator 354, and oscillator 354 is allowed to oscillate.

The noninverting input to comparator A4 is a reference voltage established by resistors R40 and R41. The inverting input to comparator A4 receives a signal which is controlled by the transistors Q1 and Q2. Comparator A4, therefore, sense a phase change when $\phi$BD- and $\overline{\phi BD}$- change state because the input voltage at the inverting input is less than the reference voltage at the noninverting input at the time of a phase change. The output of comparator A4 will be high, thereby holding the output of oscillator 354 in a low state. The outputs of comparators A1, A2, and A3, therefore, will all be low, and transistor Q9 will be turned on.

When the voltage at the inverting input of comparator A4 exceeds the reference voltage, oscillator 354 is enabled, and transistor Q9 is turned off and on at the oscillator frequency. The total current supplied to the $\phi$B stepper motor winding, therefore, is limited to a predetermined amount.

Figure 13A:
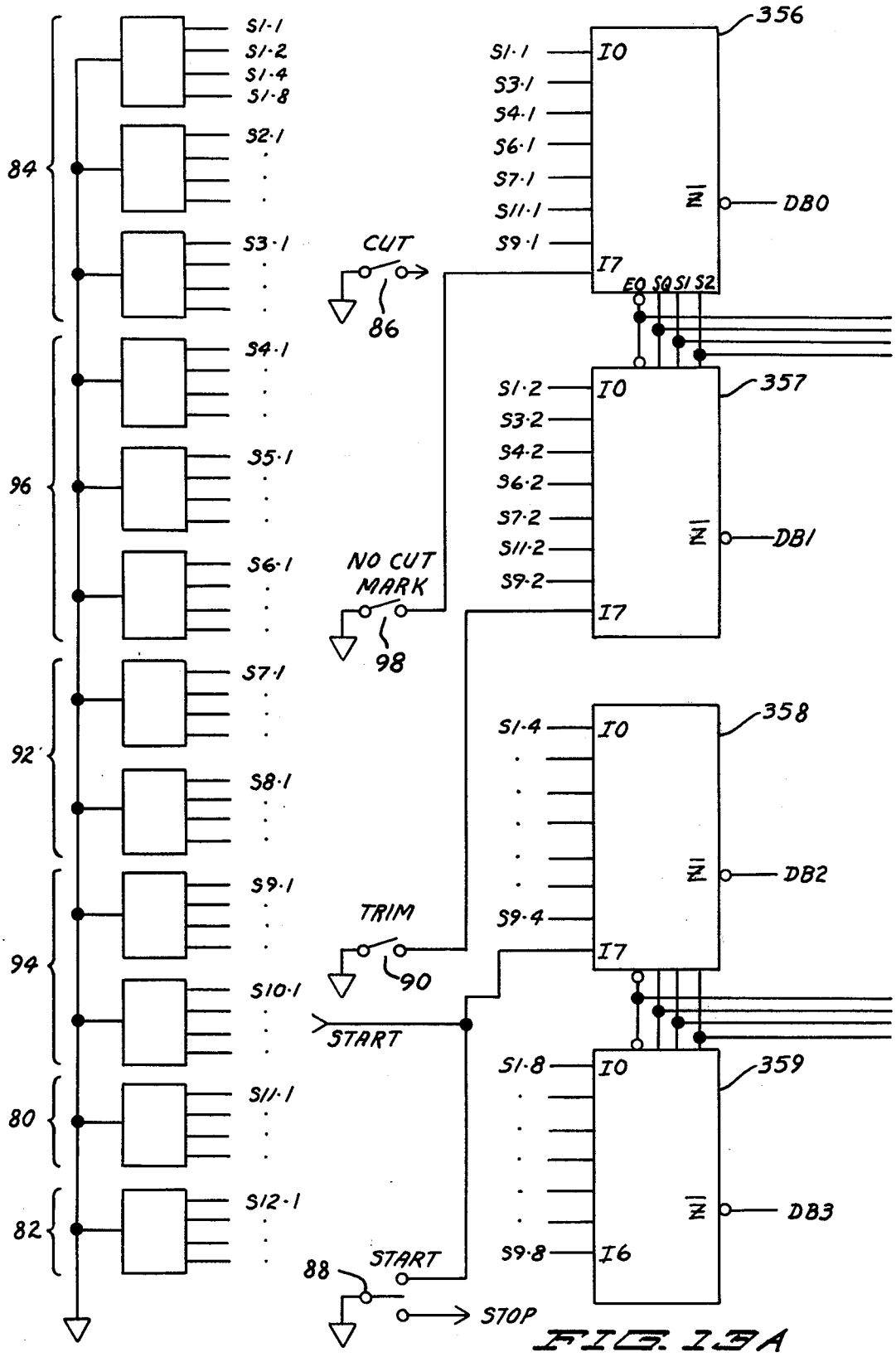
FIGS. 13A and 13B are an electrical schematic diagram of some of the switches of the main and auxiliary control panel, together with associated control panel logic.
Figure 13B:
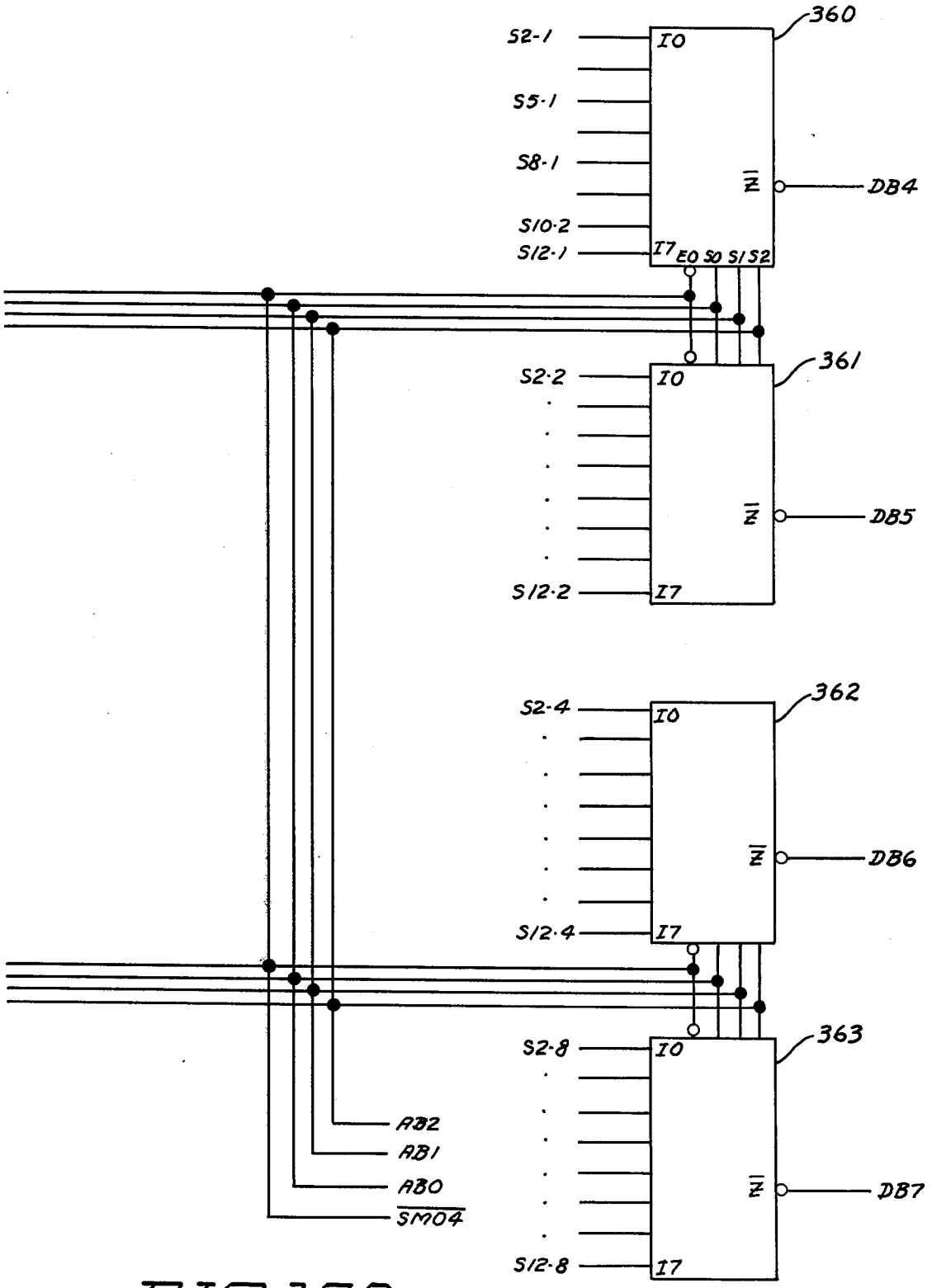
Figure 25:
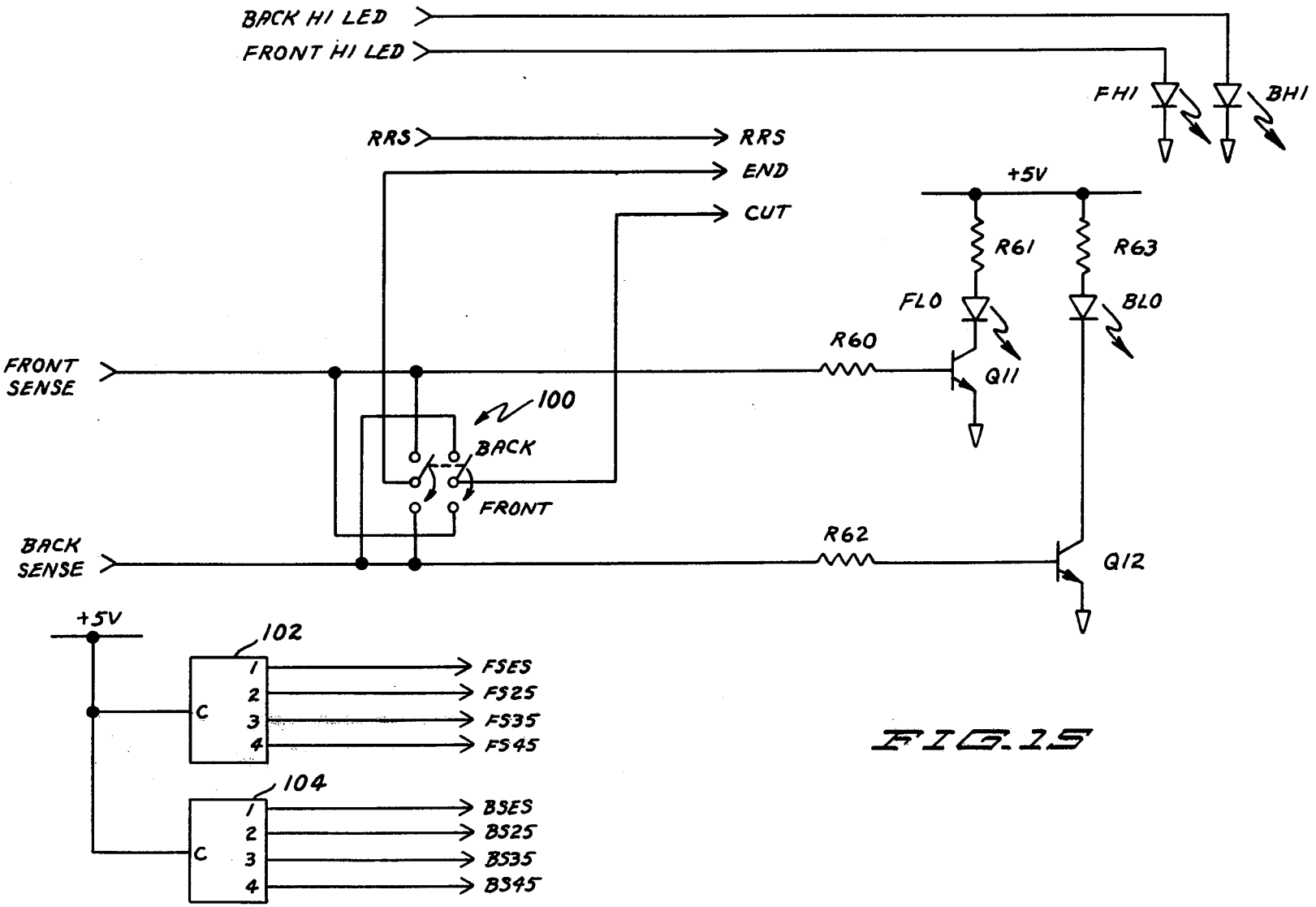

FIGS. 13A and 13B are a schematic diagram showing switches of main and auxiliary control panels 72 and 74 and control panel logic 156. As shown in FIGS. 13A and 13B, the control panel logic 156 includes eight multiplexers 356-363, each capable of receiving eight inputs. The outputs of multiplexers 356-363 are connected to data bus lines DB0 through DB7, respectively. The particular signals supplied by the multiplexers to the data bus are selected by the $\overline{SM04}$, AB0, AB1, and AB2 lines.

The inputs to multiplexers 356-363 are derived from the various switches contained on the main and auxiliary panels 72 and 74. The configuration shown in FIGS. 13A and 13B allows microprocessor 170 to address the various switches as memory locations.

Feed Length switch 84 is a three digit, ten position digital thumbwheel switch which allows the feed length to be selected in 0.012 inch nominal increments from 0 to 999 steps. The outputs of switch 84 are in binary coded decimal (BCD) format.

Feed-After-Cut Mark switch 96 is a three digit, ten position digital thumbwheel switch. Because in the present invention the paper cutter has fixed rather than adjustable sensors, the length that the paper advances after a mark is sensed must be varied depending upon the cut mark location on the prints. The length of advance after sensing is selected in 0.012 inch nominal increments from 0 to 999 steps using switch 96.

Length of Cut Out switch 92 is a two digit, ten position digital thumbwheel switch which allows the operator to select the length of cut out in 0.012 inch nominal increments from 0 to 99 steps. This switch is used primarily for straight borderless prints to control the length of slug cut out between prints.

Maximum Number of Prints switch 94 is a two digit, ten position digital thumbwheel switch. The number set into switch 94 (which may vary from 0 to 99) establishes the number of prints that will be cut before the paper cutter stops.

Speed Select switch 80 is a one digit, ten position digital thumbwheel switch. Ten discrete paper cutter cycle speeds can be selected, depending upon the position of switch 80. The speed is varied from 800 to 4200 steps per second in nine increments. Each increment is 20% larger than the previous speed.

When Speed Select switch 80 is at the highest speed position, it also causes paper cutter control 154 to coordinate the operation of the stepper motor 40 and the knife assembly in order to achieve highest possible operating speed. In particular, when the highest speed is selected by Speed Select switch 80, paper cutter control 154 causes the knife assembly to energize slightly before the paper comes to a complete stop. This allows higher speed operation, because there is a slight time delay between the time that the knife assembly receives an energizing signal and the time that the knife actually begins to cut. This coordination of operation allows the highest possible cutter speeds when Speed Select switch 80 has selected the highest speed available.

Mode Select switch 82 is a double width, ten position digital thumbwheel switch that allows the operator to select different operating modes such as RUN, TEST, FEED LENGTH CALIBRATE, and FEED AFTER SENSE. Mode Select switch 82, together with microprocessor 170, allow Start/Stop switch 88 to perform a variety of different functions, depending upon the particular mode selected.

Start/Stop switch 88 is a two position toggle switch which controls the operation of the paper cutter. When Mode Select switch 82 is in the RUN mode, the Start position of Start/Stop switch 88 initiates a paper cutter cycle, and the Stop position stops the paper cutter at the end of the present cycle. When Mode Select switch 82 is in a different mode, Start/Stop switch 88 similarly controls the operation of the cutter in that mode.

As shown in FIG. 11, a START signal may also be supplied independent of Start/Stop switch 88. The START signal is received from the packer interface circuitry and allows print packer 164 to initiate a paper cutter cycle if the automatic paper cutter is being used in conjunction with print packer 164.

Trim switch 90 is a pushbutton switch. It actuates the knife assembly for one cycle.

Cut Mark/No Cut Mark switch 98 is a two position toggle switch. The operator selects the proper mode which is dependent upon the print paper having or not having cut marks.

Cut/No Cut switch 86 is a two position toggle which controls the operation of the knife assembly.

Figure 14:
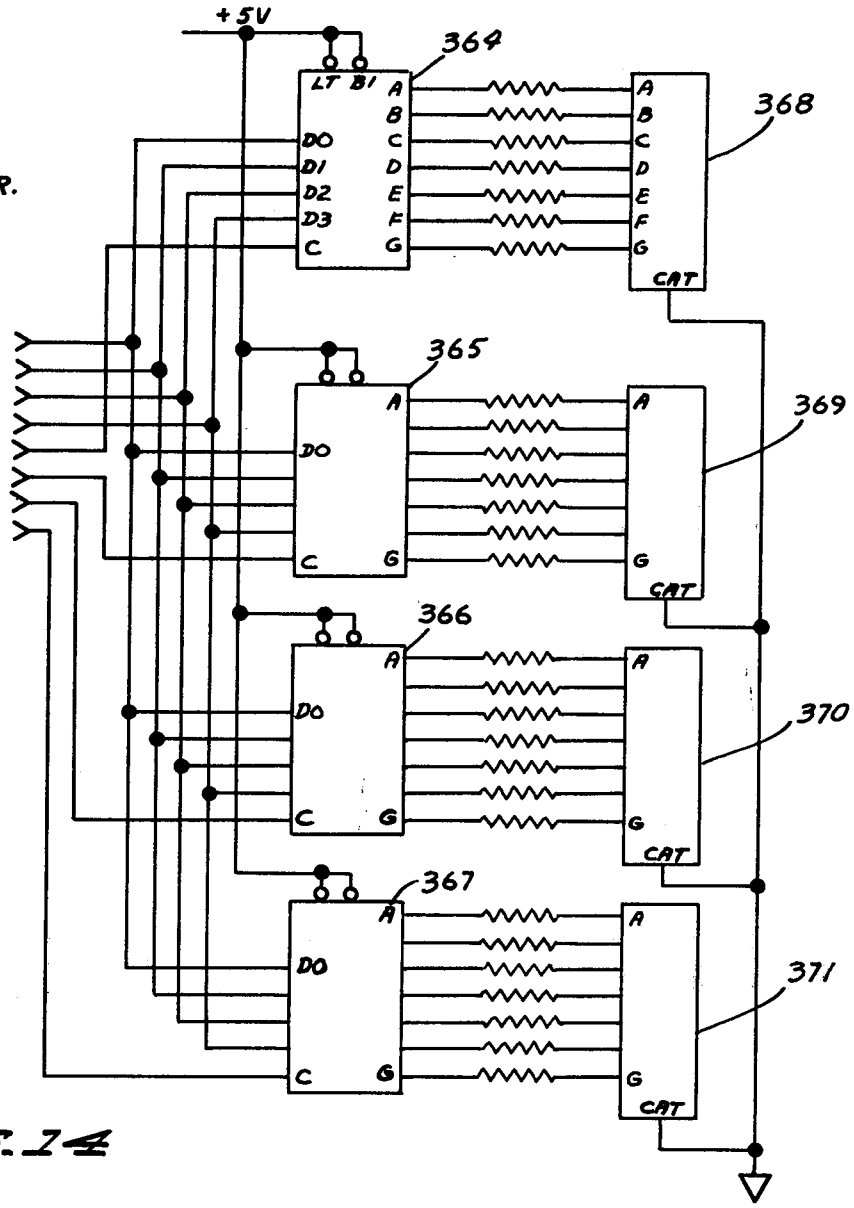
FIG. 14 is an electrical schematic diagram of the display of the main control panel.
Figure 9:
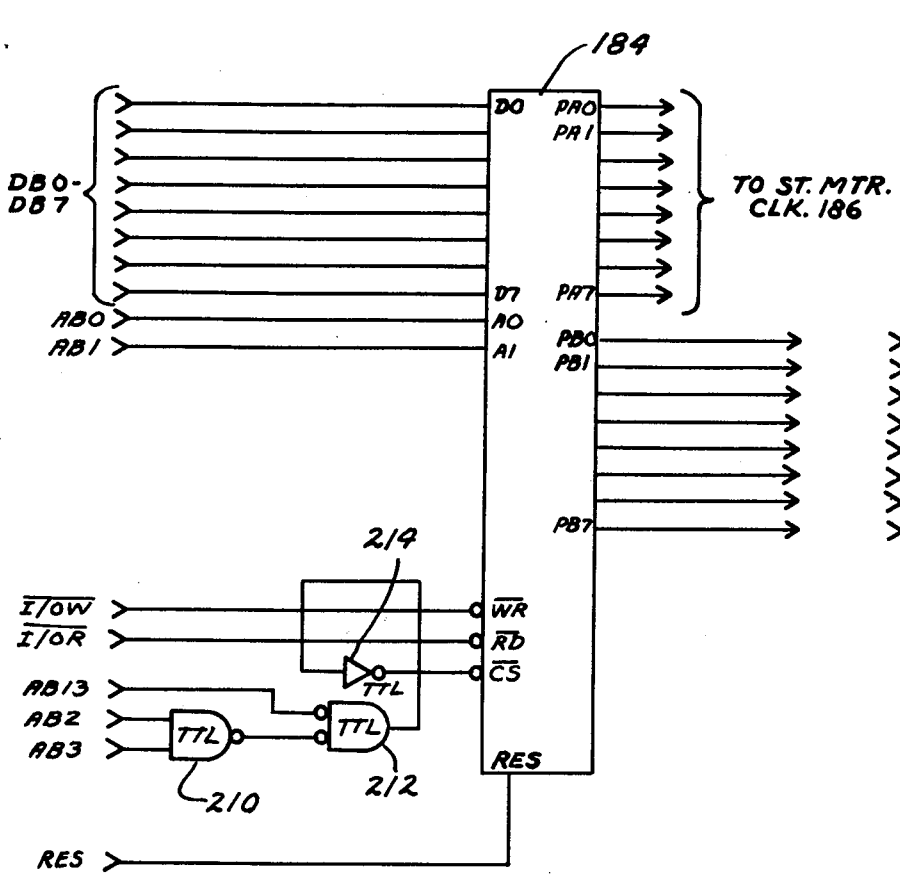
Figure 9:
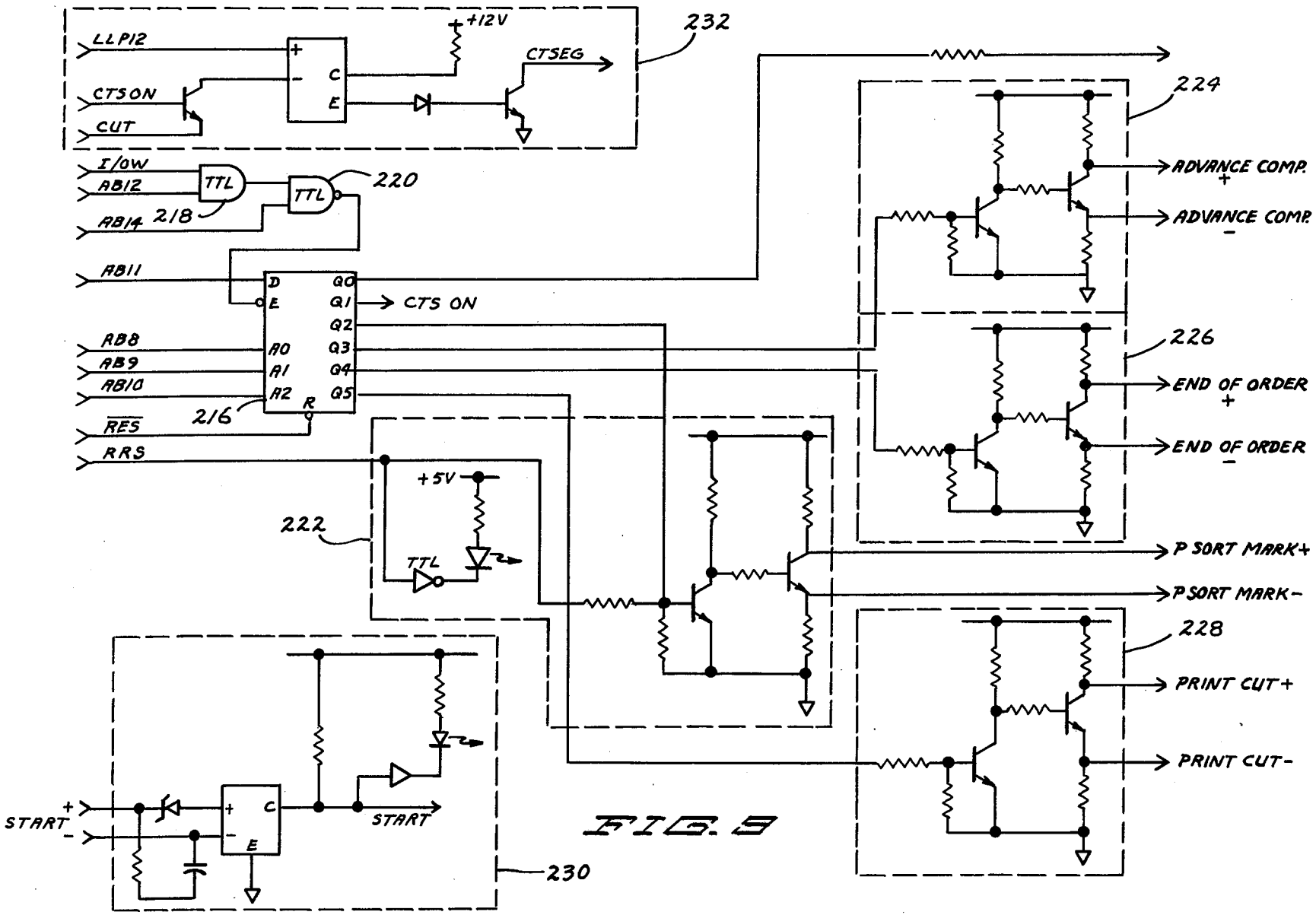

FIG. 14 shows the circuitry associated with four digit display 76 on main control panel 72. The circuitry includes four seven-segment decoder driver latches 364-367 and four seven-segment LED displays 368-371. Display 368 represents the most significant digit and display; 371 represents the least significant digit. Decoder driver latches 364-367 receive the PB0-PB7 signals from programmable I/O device 184 and drive displays 368-371 in accordance with those input signals.

Figure 16:
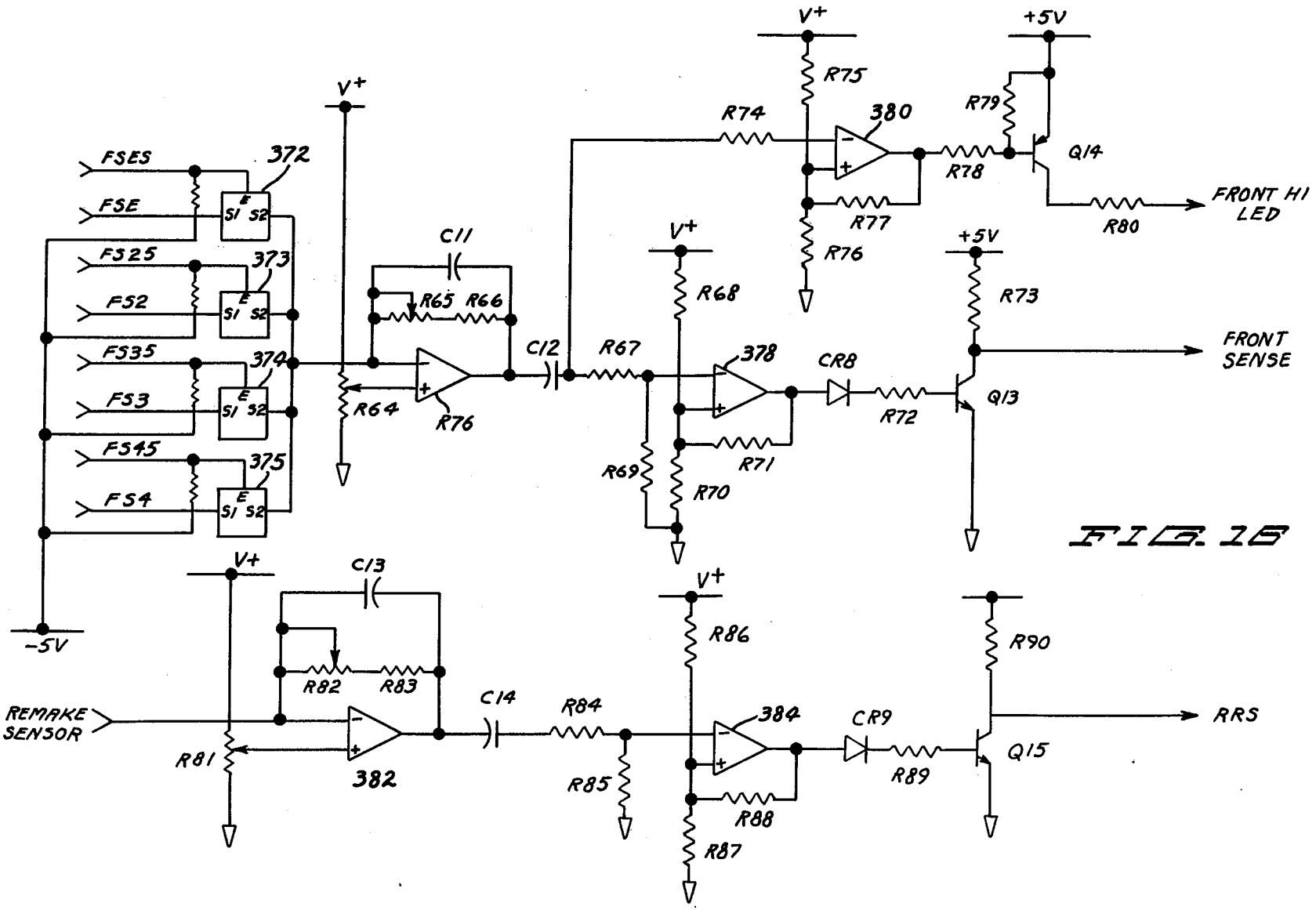
FIG. 16 is an electrical schematic diagram of a portion of the sensor amplifier circuit shown in FIG. 4.

FIGS. 15 and 16 show the electrical circuitry of auxiliary panel 74 and sensor amplifier circuit 160 which receives the signals from front indicia sensor assembly 52 and produces the CUT and END signals which are supplied to paper cutter control 154. The circuitry shown in FIG. 15 is associated with auxiliary panel 74 and is used to select which sensor assembly (front or rear) will be used for sensing cut marks and which sensor segment should be used. The circuitry of FIG. 16 is the portion of sensor amplifier 160 which is associated with front sensor assembly 52. The circuitry associated with rear sensor assembly 54 is identical and, therefore, is not shown. In addition, FIG. 16 includes the circuitry used to produce the RRS signal in response to signals from reject/remake sensor 158.

Front/Rear Cut Sensor switch 100 shown in FIG. 15 is a two-position toggle switch, which determines whether the front sensor assembly 52 or rear sensor assembly 54 will be used for sensing the cut marks. When Front/Rear Cut Sensor switch 100 is in the rear position, as shown in FIG. 15, the Back Sense signal from sensor amplifier 160 is supplied to paper cutter control 154 as the CUT signal, and the FRONT SENSE signal is supplied to paper cutter control 154 as the END signal. If switch 100 is in the Front position, the FRONT SENSE signal is supplied as the CUT signal and the BACK SENSE signal is supplied as the END signal.

Auxiliary panel 72 includes four light emitting diodes F HI, F LO, B H I, and B LO. Light emitting diode F LO is connected in an annunciator circuit including resistors R60 and R61 and transistor Q11, and is lit each time the FRONT SENSE signal goes high. Similarly, light emitting diode B LO is in an annunciator circuit including resistors R62 and R63 and transistor Q12, and is lit each time the BACK SENSE signal goes high.

The other two light emitting diodes are used to assist the operator in selecting the segment of the front and rear sensors 52 and 54 which produce the highest output signals. The F HI and B HI light emitting diodes are energized by the FRONT HI LED and BACK HI LED signals, respectively from sensor amplifier 160.

Front Sensor Select switch 102 is a one-digit, four-position digital thumbwheel switch. This switch individually selects the segment of front sensor assembly 52, so that the segment with the largest output signal can be used. Signals FSES, FS2S, FS4S from Front Select switch 102 are supplied to sensor amplifier 160. Only one of the four signals is high, depending upon the position of Front Sensor Select switch 102.

Rear Sensor Select switch 104 is a one-digit, four-position digital thumbwheel switch. Its function is the same as Front Sensor Select switch 102, except that it selects segments of rear sensor assembly 54.

FIG. 16 shows the portion of sensor amplifier 160 which produces the FRONT SENSE and FRONT HI LED signals. The portion of the sensor amplifier 160 which produces the BACK SENSE and BACK HI LED signals is identical to the circuit producing the FRONT SENSE and FRONT HI LED signals and it not shown.

The FSES, FS2S, FS3S, and FS4S signals from front Sensor Select switch 102 are supplied to the E inputs of bidirectional switches 372-375, respectively. Switches 372-375 also receive the FSE, FS2, FS3, and FS4 signals from individual segments of front sensor assembly 52. Depending upon which sensor segment is selected, one of the sensor signals is supplied to a current amplifier circuit formed by comparator amplifier 376, resistors R64-R66, and capacitor C11. The output of the current amplifier circuit is AC coupled through capacitor C12 and supplied to two discriminator networks.

The first discriminator network is formed by comparator 378 and resistors R67-R71. When the amplified sensor signal which is supplied to the inverting input of comparator 378 exceeds a first reference signal which is supplied to the noninverting input of comparator 378, the output of comparator 378 goes low. This causes the buffer circuit formed by diode CR8, resistors R72 and R73, and transsistor Q13 to produce a FRONT SENSE signal which goes high. The FRONT SENSE signal is only high when the amplified sensor signal exceeds the first reference signal.

The second discriminator network is formed by comparator 380 and resistors R74-R77. This second discriminator network works in essentially the same manner as the first discriminator network, except that the second reference signal which is supplied to the noninverting input of comparator 380 is higher than the first reference signal. The output of comparator 380 of the second discriminator network only goes low when the amplified sensor signal exceeds the higher second reference signal.

When the output of comparator 380 goes low, the buffer circuit formed by transistor Q14 and resistors R78-R80 produce the FRONT HI LED signal. This two-threshold system, therefore, allows the operator to select the sensor producing a signal which not only is acceptable (as determined by the first discriminator network) but also exceeds a second higher threshold (as determined by the second discriminator network). The sensor segment in the best position to sense indicia on the paper, therefore, is identified and selected.

The selection of the proper sensor segment is performed prior to commencement of normal paper cutting operation of the paper cutter. Mode switch 82 is set to the SENSOR SELECT position and the operator uses Front Sensor Select switch 102 (or Rear Sensor Select switch 104) to individually monitor the output signals from each of the sensor segments. By viewing the F HI and F LO (or B HI and B LO) light emitting diodes, the operator can determine which sensor segment is in the best position to sense the indicia on the paper. The operator then sets Front Sensor Select switch 102 (or Rear Sensor Select switch 104) to the desired segment, and that segment has its output signal supplied to sensor amplifier circuit 160.

The remaining circuitry shown in FIG. 16 receives the REMAKE SENSOR signal from reject/remake sensor 158 and produces the RRS signal, which is supplied to cutter control 154. The REMAKE SENSOR signal is received and amplified by a current amplifier circuit formed by comparator 382, resistors R81-R83, and capacitor C13. The output of comparator 382 is AC coupled through capacitor C14 to a discriminator network formed by resistors R84- R88 and comparator 384. The output of comparator 384 drives a buffer circuit formed by a diode CR9, resistors R89 and R90, and transistor Q15. The production of the RRS signal, therefore, is generally similar to the production of the FRONT SENSE signal discussed previously.

Operation

The electrical control system described in the preceding section provides efficient, flexible, accurate, and high-speed control of an automatic cutter of photographic strip material. The control system takes advantage of the processing and controlling capabilities of microprocessor 170. As shown in the previous section and in the preceding Figures, the functions of the automatic cutter may be controlled by microprocessor 170 as a function of stored control information contained in RAM 180, ROM 182, and the various switches of main and auxiliary control panels 72 and 74, together with the various status signals produced by the status circuits shown in FIGS. 10A and 10B. Microprocessor 170 retrieves the control information from main and auxiliary control panels 72 and 74 by addressing multiplexers 356-363 (FIGS. 13A and 13B). Similarly, microprocessor 170 monitors the various status signals by addressing multiplexer 274 (FIG. 10B).

Basically, the electrical control system controls stepper motor 40, knife assembly 58, and display 76. The present invention includes a stepper motor control (stepper motor clock 186, stepper motor phase generator 188, and stepper driver 190), a step status circuit (latch 258, gates 260, 262, 266, and 267, flipflops 264, 265, and inverter 268), a cut indicia sensor (52 or 54), a cut status circuit 282, storage means for storing control information (RAM 180, ROM 182, and control panels 72 and 74), a mode selector (Mode switch 82), a start switch (Start/Stop switch 88), and a digital processor (microprocessor 170). Operation of the cutter is controlled by the digital processor as a function of the mode selected, the state of Start/Stop switch 88, the step status signal, the cut status signal, and the control information.

Operation of the cutter is commenced by turning on power switch 78. Front paper guide 32 is then set to an appropriate paper width, paper roll 10 is installed on hub 12, and paper strip 18 is threaded through the paper supply and into the cutter.

The operator then selects the proper sensor assembly (either front sensor 52 or rear sensor 54) to sense the cut marks by switching Front/Rear Cut Sensor switch 100 to the "front" or the "rear" position. The sensor assembly which is not selected is automatically used to sense end-of-order marks, which appear along the opposite edge of the paper strip 18 from the cut marks.

The next step involves selecting the proper segment of the sensor assembly so that the largest sensor signal is provided. Mode switch 82 is placed in the SENSOR SELECT (or "SENSE") mode, and a portion of print paper strip 18 bearing a cut or end-of-order mark is oscillated back and forth past the sensor assembly. The operator sets the front and rear sensor select switches 102 and 104 to the setting which select the proper segments of sensor assemblies 52 and 54 so that the largest sensor signals are provided. The operation of the stepper motor paper drive during the SENSOR SELECT mode is controlled by microprocessor 170 in accordance with control information stored for use during the SENSOR SELECT mode and the step status and cut status signals.

After the proper sensor segments have been selected, Mode switch 82 is set to the FEED LENGTH CALIBRATE mode. Start switch 88 is actuated and one print is fed from cut mark to cut mark. The feed length is displayed on display 76 and that value is set into Feed Length switch 84 by the operator. During the FEED LENGTH CALIBRATE mode, miroprocessor 170 controls the operation of both stepper motor 40 and display 76 in accordance with control information stored for use during the FEED LENGTH CALIBRATE mode, together with the step status and cut status signals.

The operator then sets Mode switch 82 to the FEED AFTER SENSE mode. The edge of a print is aligned with a calibration mark on one of the paper guides 30 and 32. Start/Stop switch 88 is actuated to the Start position and paper strip 18 advances to the next cut mark and stops. The feed-after-sense length is displayed on display 76, and the operator sets that value into Feed After Cut Mark switch 96. During the FEED AFTER SENSE mode, microprocessor 170 (a) controls the operation of stepper motor 40; (b) derives the feed-after-sense length from the previously stored feed length, the known length from the calibration mark to the knife assembly, and the number of steps which were taken during the FEED AFTER SENSE mode; and (c) causes display 76 to display the derived feed-after- sense length. The operation of microprocessor 170 is controlled by the control information associated with the FEED AFTER SENSE mode, the step status signal, and the cut status signal.

The operator then sets Mode switch 82 to the RUN mode and sets Speed switch 80 to the desired cycle rate. If bordered or round-cornered borderless prints are being cut, the cutter is ready to operate. If straight borderless prints are being cut, the operator must set the length of the slug to be cut out between prints in Length of Cut Out switch 92.

Operation of the cutter is then commenced by actuating the Start/Stop switch 88 to the Start position. During a normal automatic feed-and-cut cycle, the microprocessor 170 begins the cycle in response to actuation of Start/Stop switch 88; causes stepper motor 40 to take steps; monitors the step status signal; counts the steps which have been taken; monitors the cut status signal; determines the distance that strip 18 will be fed based upon the cut status signal, the step status signal, the steps counted, and the control information; stops stepper motor 40 when strip 18 has been fed the distance determined; and enables knife assembly 58. If Length of Cut Out switch 92 contains a nonzero cut out length, microprocessor 170 causes stepper motor 40 to restart after the first cut has been made and drive strip 18 by the desired cutout length. Microprocessor 170 then enables knife assembly 58 a second time to cut out the slug between adjacent prints.

At the end of each cycle, microprocessor 170 may commence another feed-and-cut cycle depending upon the end-of-order status signal from end-of-order status circuit 294, the setting of Maximum Number of Prints switch 94, and the state of Start/Stop switch 88.

In the preferred embodiments of the present invention, microprocessor 170 controls not only the distance which stepper motor 40 drives strip 18, but also the rate at which stepper motor 40 takes steps. Up ramps and down ramps in stepper speed at the beginning and end of each cycle, respectively, are controlled by microprocessor 170 as a function of the control information, the step status signal, and the steps counted.

Another important function controlled by microprocessor 170 is the time at which the knife assembly 58 is enabled. In a preferred embodiment of the present invention, when speed switch 80 has selected the highest speed, microprocessor 170 enables knife assembly 58 before strip 18 is actually stopped. This early actuation of knife assembly 58 eliminates time delays which would otherwise be present and permits higher overall operating speed of the automatic paper cutter.

During the RUN mode, microprocessor 170 also controls display 76 to provide an indication of the number of prints which have been cut in an order. The particular fashion in which this information is displayed will depend on whether the automatic paper cutter is being used in conjunction with an automatic photo packer. Microprocessor 170 monitors the PACKER signal, which indicates whether the automatic paper cutter is connected to a photo packer, by interrogating multiplexer 274. The print count is generated by microprocessor 170 by counting the number of feed-and-cut cycles in each order.

When the TOTAL mode is selected by Mode switch 82, microprocessor 170 causes display 76 to display the total number of prints cut and total number of orders processed since power was turned on. These totals are determined by microprocessor 170 by counting the total number of feed-and-cut cycles and the total number of orders indicated by the end-of-order status signal produced by end-of-order status circuit 294.

In the following sections, the operation of microprocessor 170 will be described in detail with reference to flow charts shown in FIGS. 17-30C and assembler listings shown in Table 1. In order to provide a complete understanding of the operation of the automatic paper cutter, all of the functions of the cutter are described in the following discussion. As a result, the subject manner of several of the previously mentioned co-pending applications is included in the discussion. It will be recognized, however, the present invention may be implemented without using any of the specific functions which form the subject manner of these co-pending applications.

(1) Initiation of Operation

FIG. 17 illustrates the INIT routine. This routine is for initial startup and for interrupts. The initial conditions of the system are provided by this routine.

Figures 18B, 22:
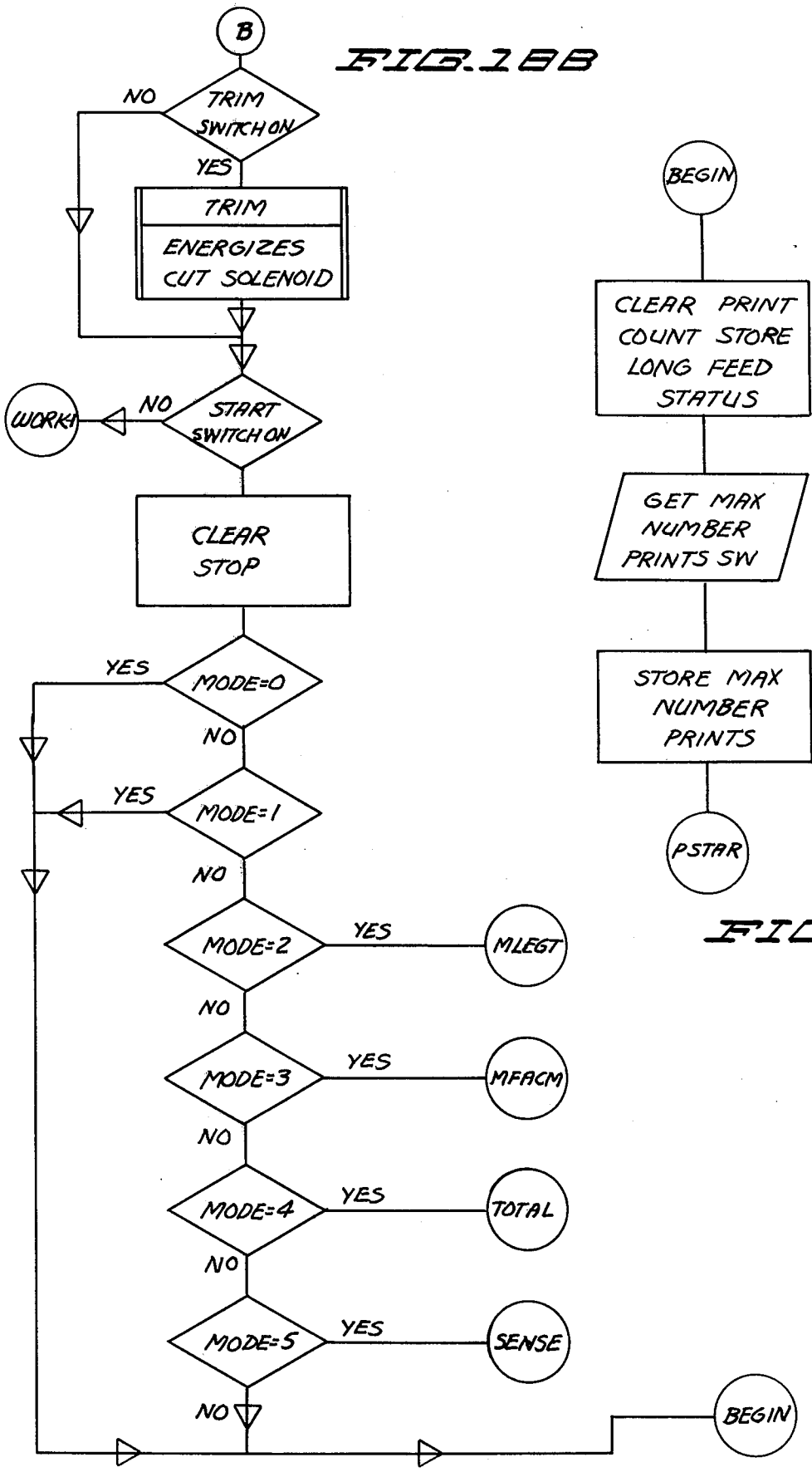

The next routine of microprocessor 170 is WORK. This routine reads the states of the various switches on main and auxiliary panels 72 and 74, and stores this information in appropriate locations of random access memory 180. FIGS. 18A and 18B are flow charts showing the WORK routine.

(2) Sensor Select Mode

Because the automatic paper cutter shown in the preceding Figures utilizes a multichannel sensor assembly of the type described in the previously mentioned co-pending application entitled "Multichannel Indicia Sensor for Automatic Photographic Paper Cutter", the operator must select the proper segment of each sensor assembly so that the largest sensor signal is provided. This is achieved by placing Mode switch 82 in the SENSOR SELECT mode (mode 5). When this mode is selected, microprocessor 170 performs the SENS routine shown in FIG. 19. This routine causes a cut mark to be moved back and forth in front of the sensor assembly so that the operator can monitor the strength of the signal from each of the sensor segments. This monitoring is permitted by the B HI, B LO, F HI, and F LO light emitting diodes on auxiliary control panel 74.

Figure 19:
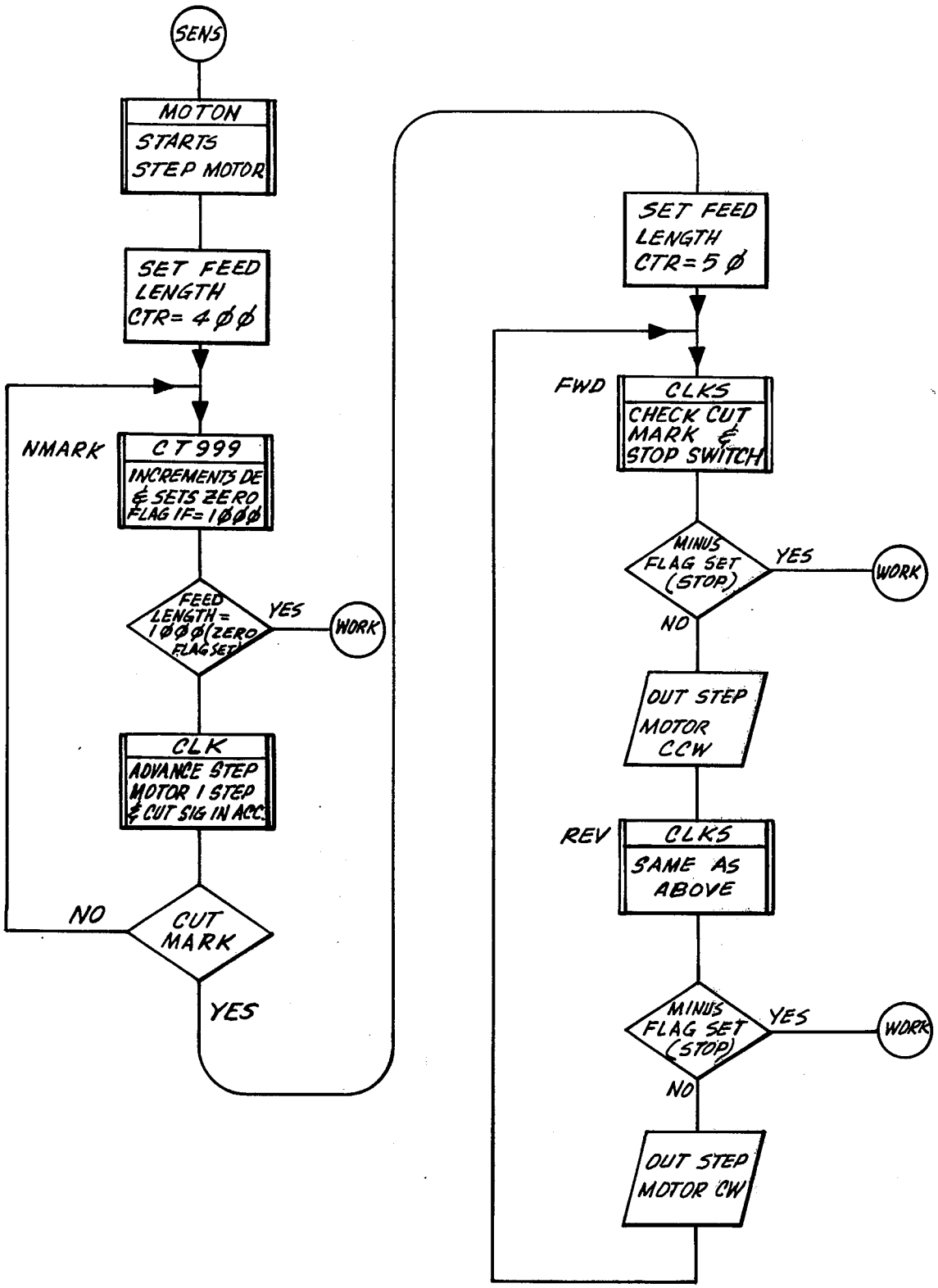
Figure 20B:
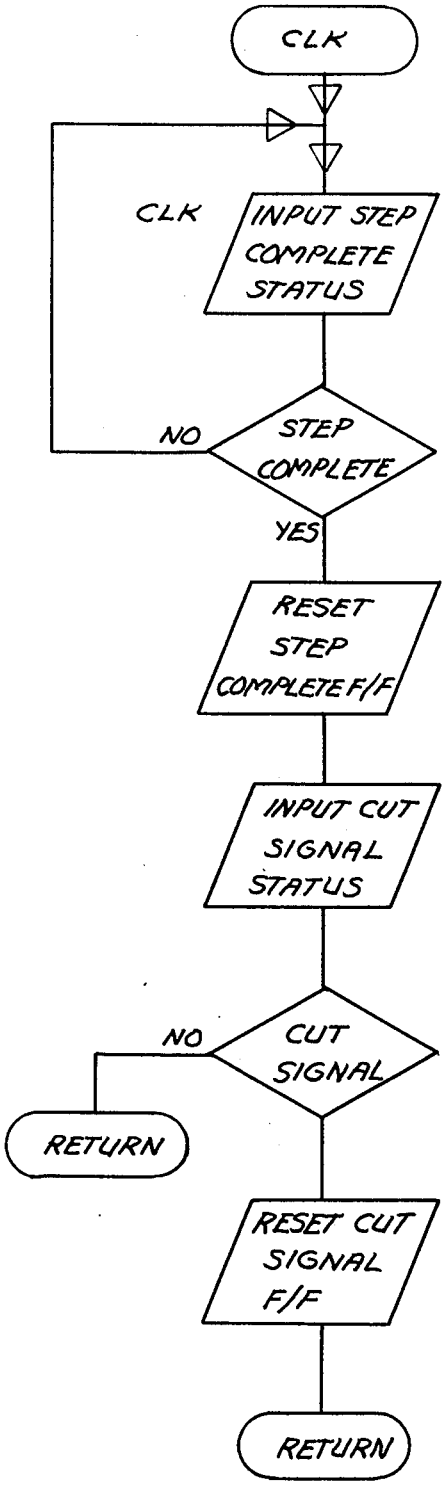
Figure 20C:
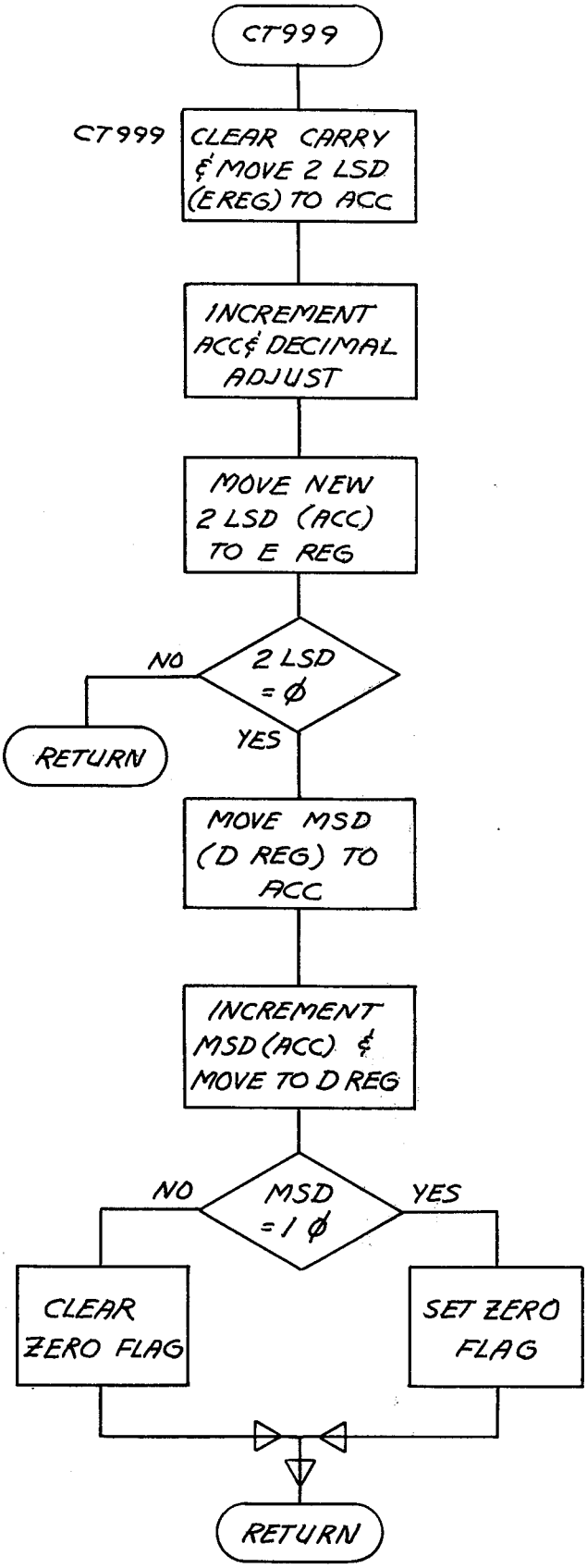
Figure 20D:
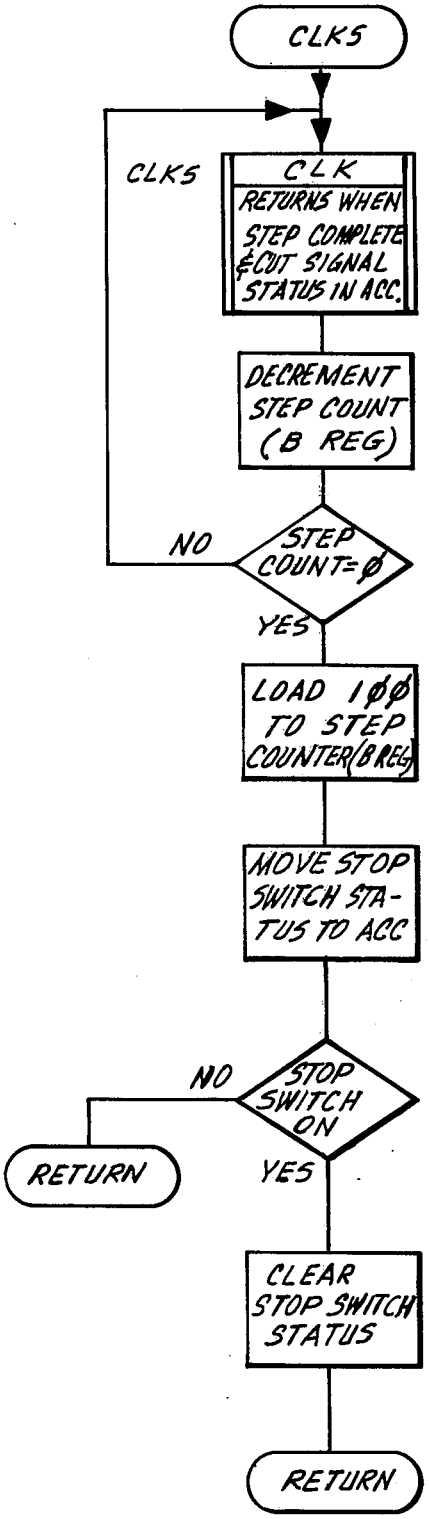

As shown in FIG. 19, once a cut mark has been found, microprocessor 170 causes stepper motor 40 to drive paper strip 18 back and forth by 100 steps (50 setps on each side of the sensed cut mark). This oscillation continues until the Start/Stop switch 88 is placed in the Stop position.

FIGS. 20A-20D show the MOTON, CLK, CT999, and CLKS calls which are used in the SENS routine. Some of these calls are also used in other routines performed by microprocessor 170.

(3) Feed Length Calibrate Mode

After the sensor segments have been selected, the operator sets Mode switch 82 first the FEED LENGTH CALIBRATE mode (mode 2) and then to the FEED AFTER SENSE mode (mode 3). As the WORK routine scans the states of the various switches, it checks the modes selected by Mode switch 82. When mode 2 is selected and Start switch 88 is actuated, the SETUP routine shown in FIGS. 21A-21C is commenced.

Figure 21A:
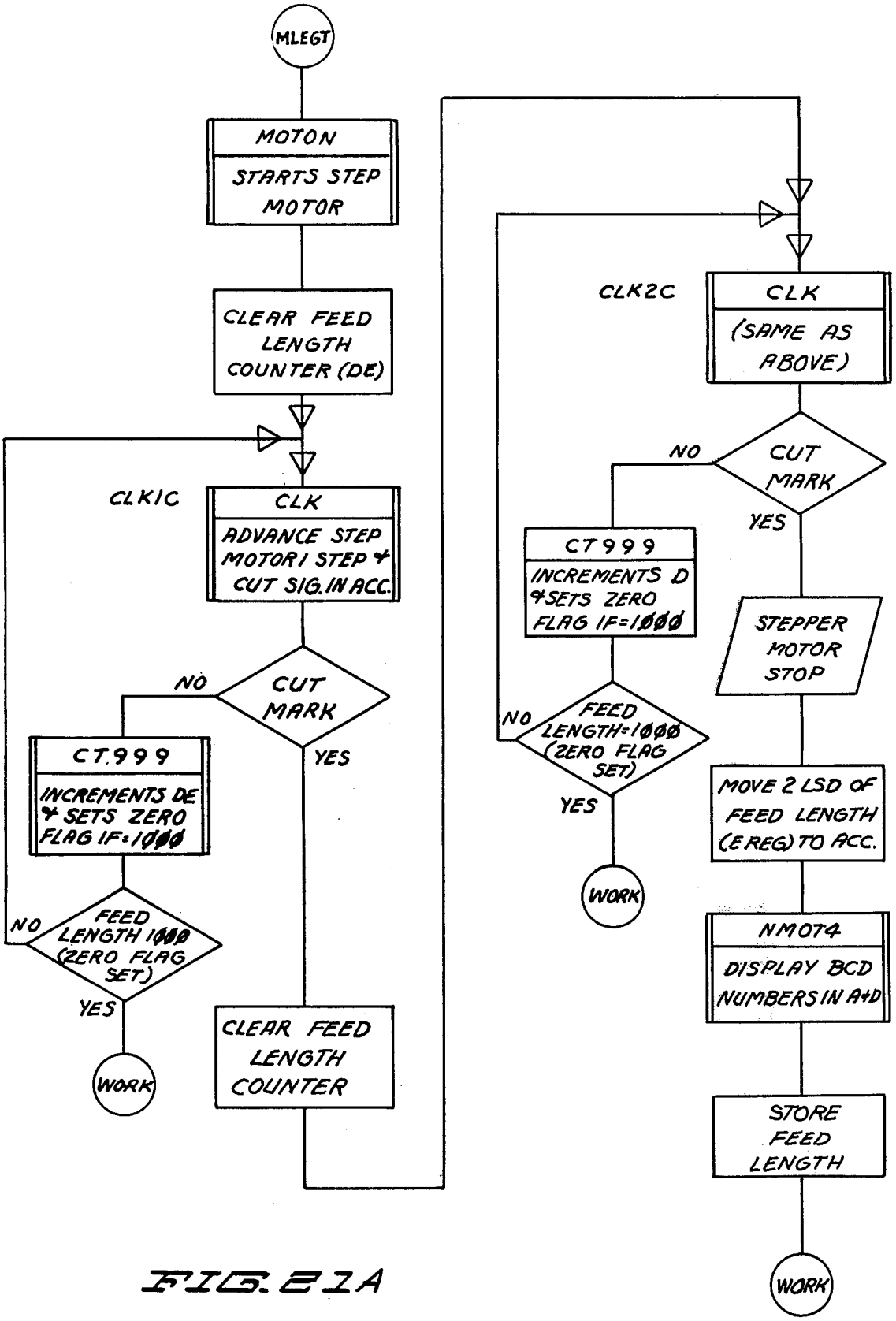
Figure 21B:
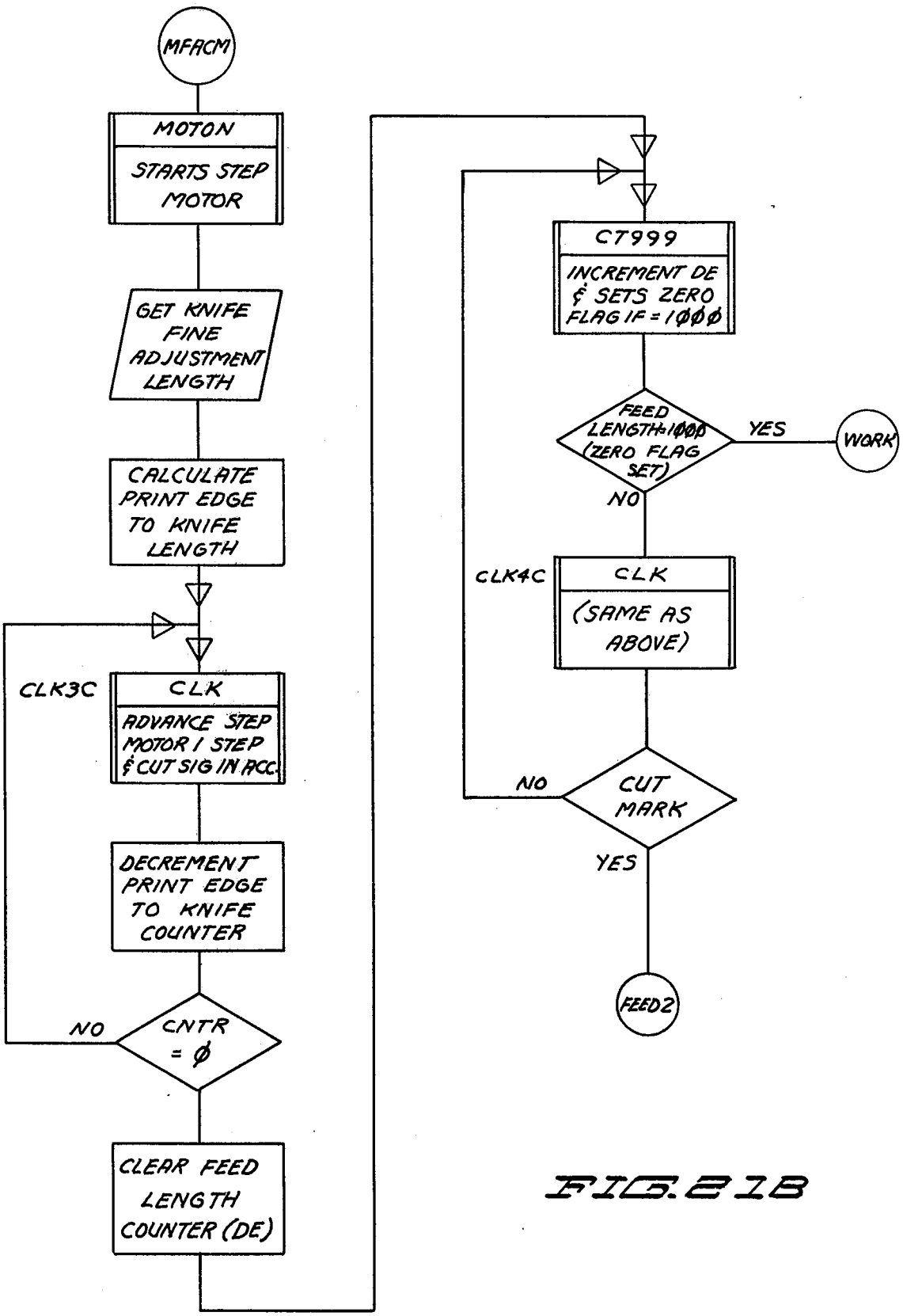
Figure 21C:
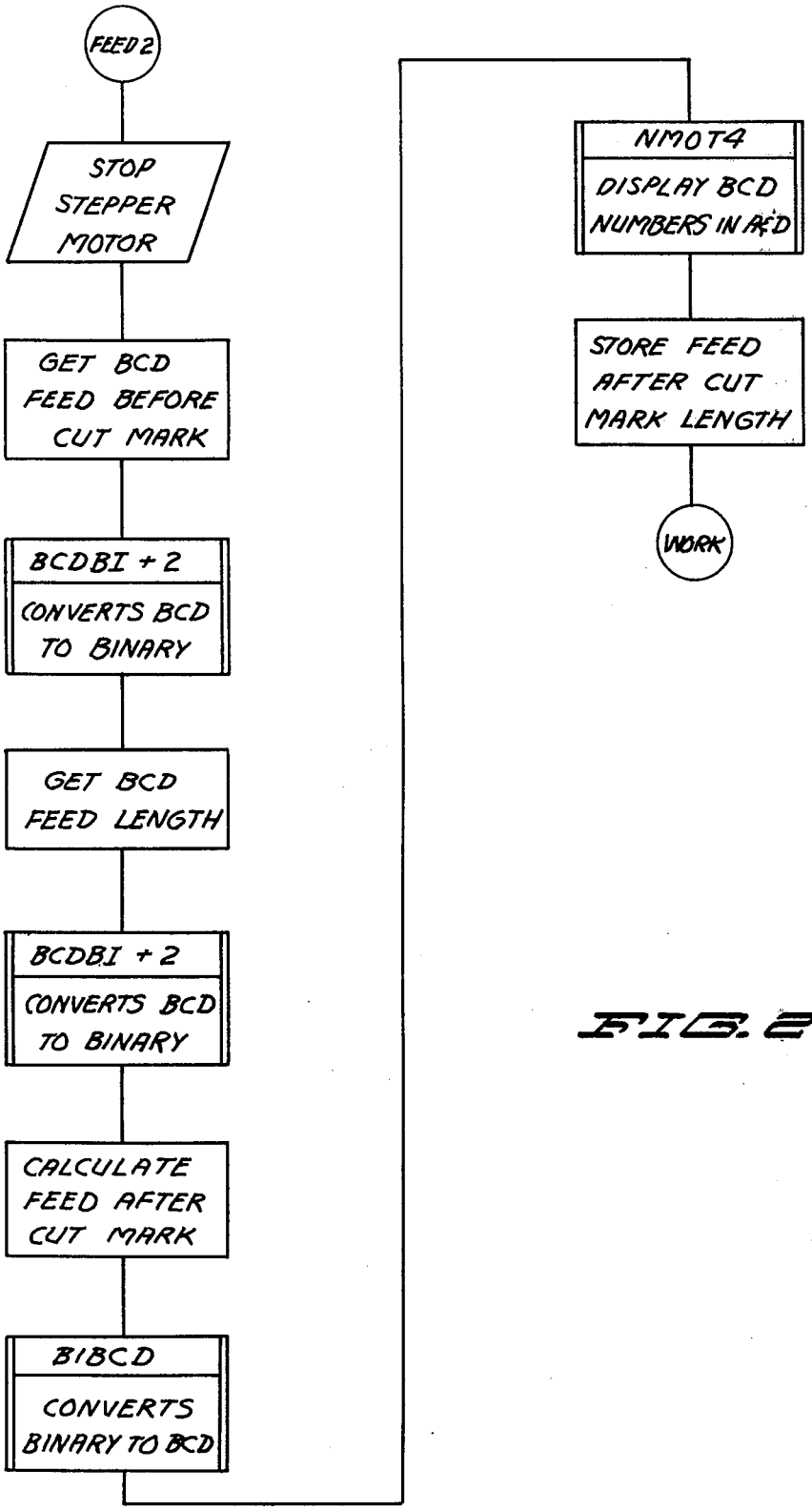

The MLEGT function shown in FIG. 21A measures the length of a print from cut mark to cut mark. The stepper motor 40 is turned on by the MOTON call and the feed length counter is cleared. Paper strip 18 is advanced, a step at a time, until a cut mark is sensed. At that time, the feed length counter is again cleared and the stepper motor is advanced a step at a time until the next cut mark is sensed. As the paper strip 18 is advanced, the count in the feed length counter is incremented until the cut mark is sensed. At that point, the stepper motor is stopped and the feed length from cut mark to cut mark is displayed by display 76. The operator stores the feed length which has been displayed by adjusting Feed Length switch 84 and sets Mode switch 82 to the FEED AFTER SENSE mode (mode 3).

(4) Feed After Sense Mode

As shown in FIG. 21A, after the feed length has been stored, microprocessor 170 returns to the WORK routine and scans the states of the various switches. Since mode 3 has now been selected, actuation of Start switch 88 will cause the MFACM function of the SETUP routine to be performed. This function is shown in FIGS. 21B and 21C.

When the FEED AFTER SENSE mode (mode 3) has been selected, the operator sets the edge of a print to a calibration mark on one of the paper guides (30 or 32). When start switch 88 is actuated, the MFACM function causes paper strip 18 to be advanced until a cut mark is sensed.

While the paper strip 18 is being advanced, each step of stepper motor 40 is sensed and counted. This counting is first used to decrement the print edge-to-knife counter until it reaches zero. The number initially in the print edge-to-knife counter represents the number of steps between the indicia sensor and the knife assembly. Once he print edge-to-knife counter reaches zero, the feed length counter is cleared until a cut mark is sensed. When the cut mark is sensed, the stepper motor is stopped and the feed-after-sense or feed-after-cut mark length is calculated and displayed. The feed-after-sense length equals the feed length stored in Feed Length switch 84 minus the length in the feed length counter. The operator then sets the displayed number into Feed-After-Cut Mark switch 96, and the SETUP routine is complted.

(5) RUN MODE - Commencement

Figure 22:
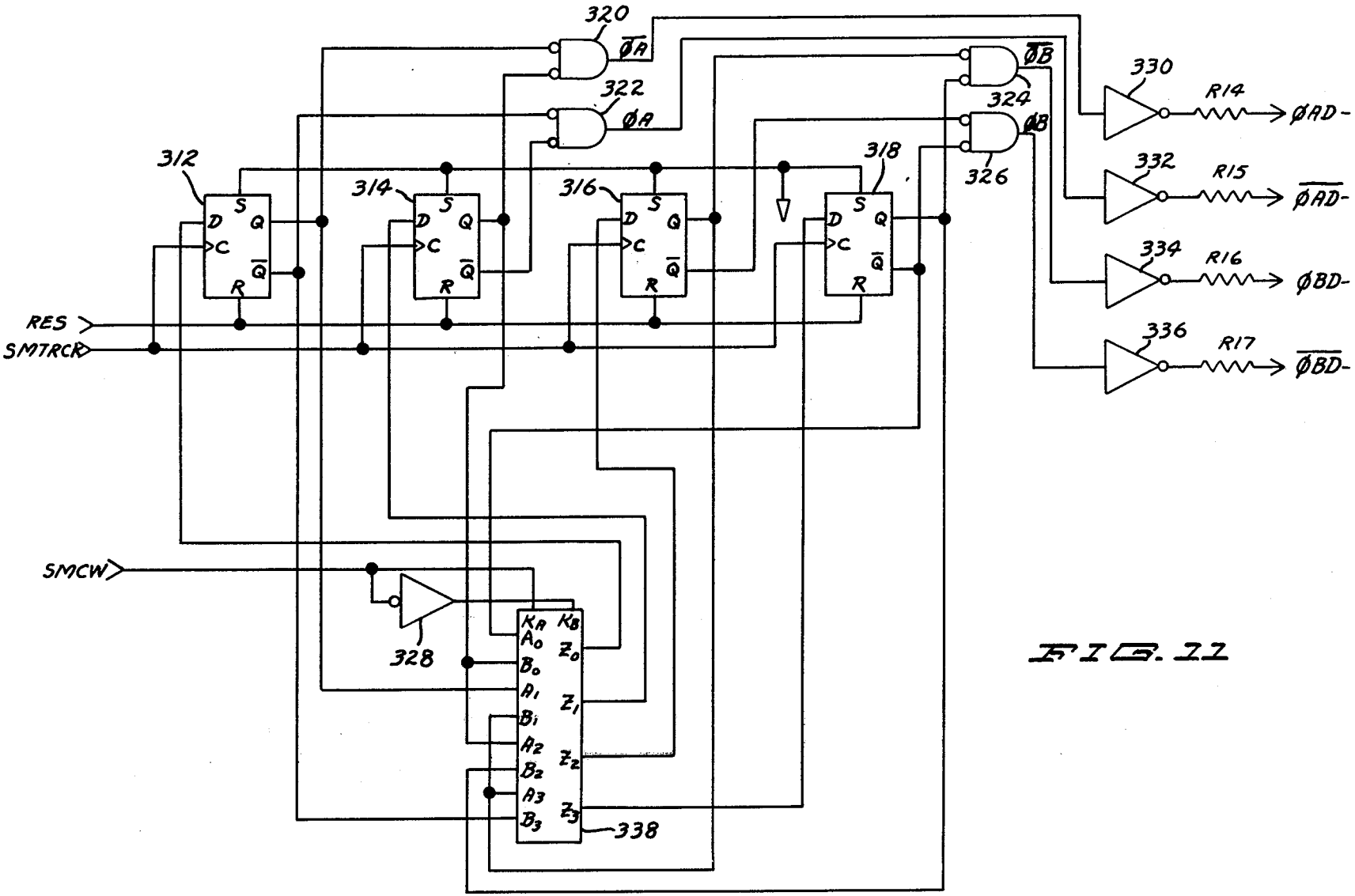

After the SETUP routine has been completed, the operator sets Mode switch 82 to the RUN mode, and the automatic photographic paper cutter is ready for automatic operation. When Start switch 88 is actuated, the BEGIN routine is commended. This routine is performed when the cutter is beginning an order. FIG. 22 shows the BEGIN routine.

Figure 23A:
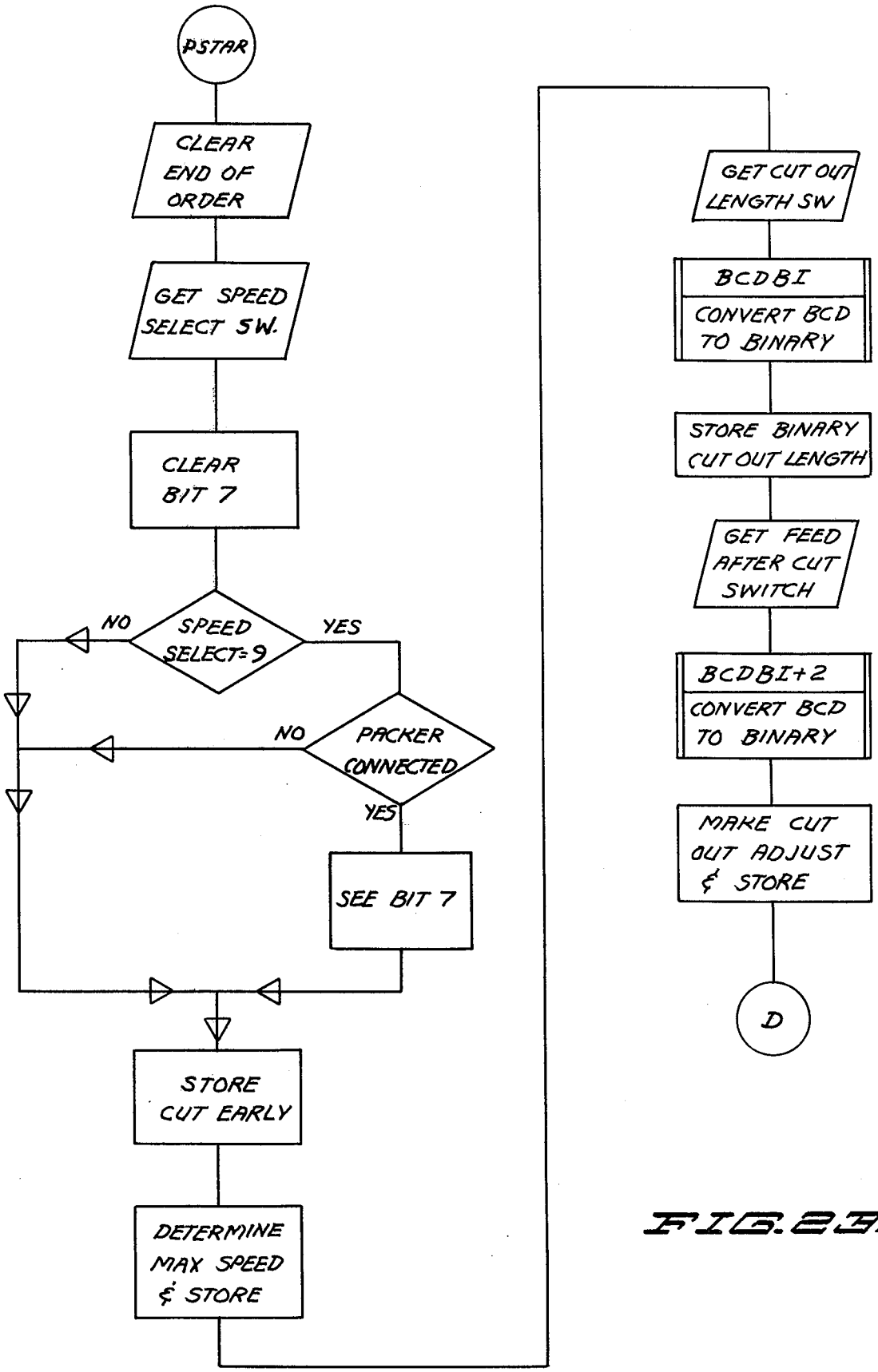
Figure 23B:
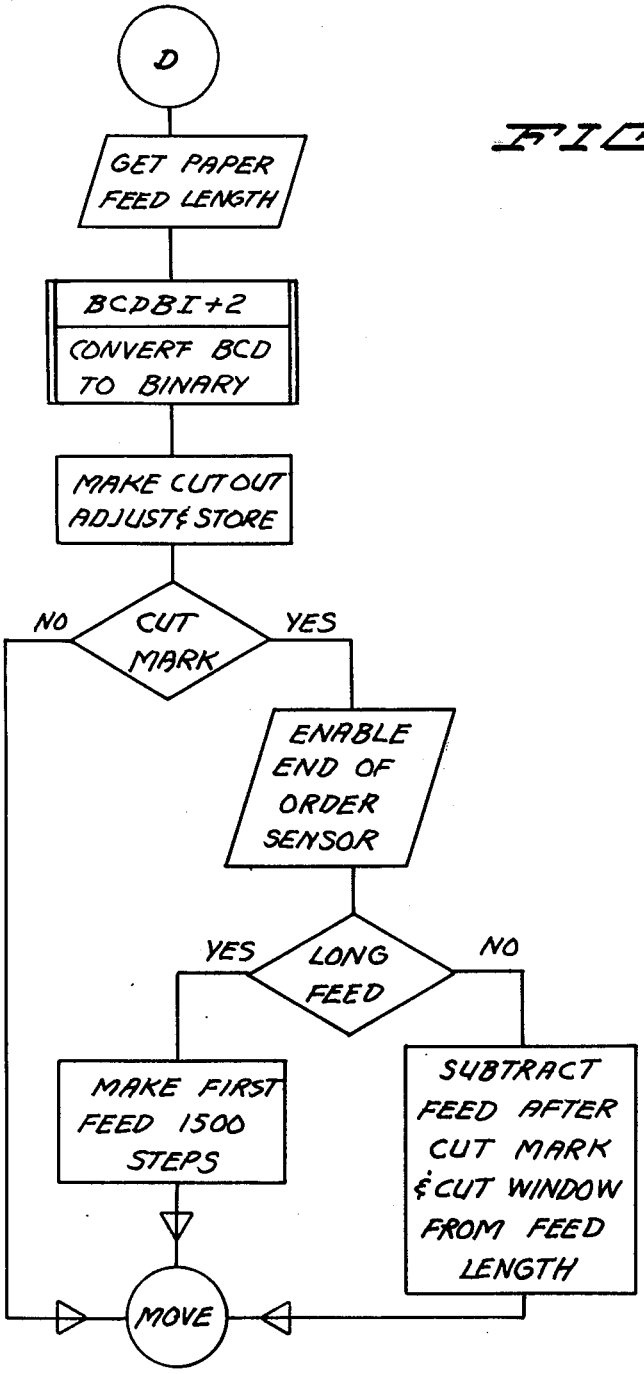

The next routine is the PSTAR routine illustrated in FIGS. 23A and 23B. PSTAR routine is a print/start routine and either follows the BEGIN routine if the cutter is beginning to cut prints from a new customer order, or is commenced at the end of a feed-and-cut cycle when prints from the same customer order have already been cut.

During the PSTAR routine the state of Speed switch 90 is interrogated and the maximum speed is determined and stored. As shown in FIG. 23A, if the highest speed is selected, the PSTAR routine stores an indication that the knife assembly should be energized early so that there is minimal delay time between the stopping of the print paper and the cutting of the paper by the knife.

The PSTAR routine also includes operations which are necessary to determine the proper feed length depending upon whether the cut marks will or will not be sensed. This involves a conversion of the BCD stored information contained in the feed length switch 84, cut out length switch 92, and feed-after-cut mark switch 96.

Figure 24A:
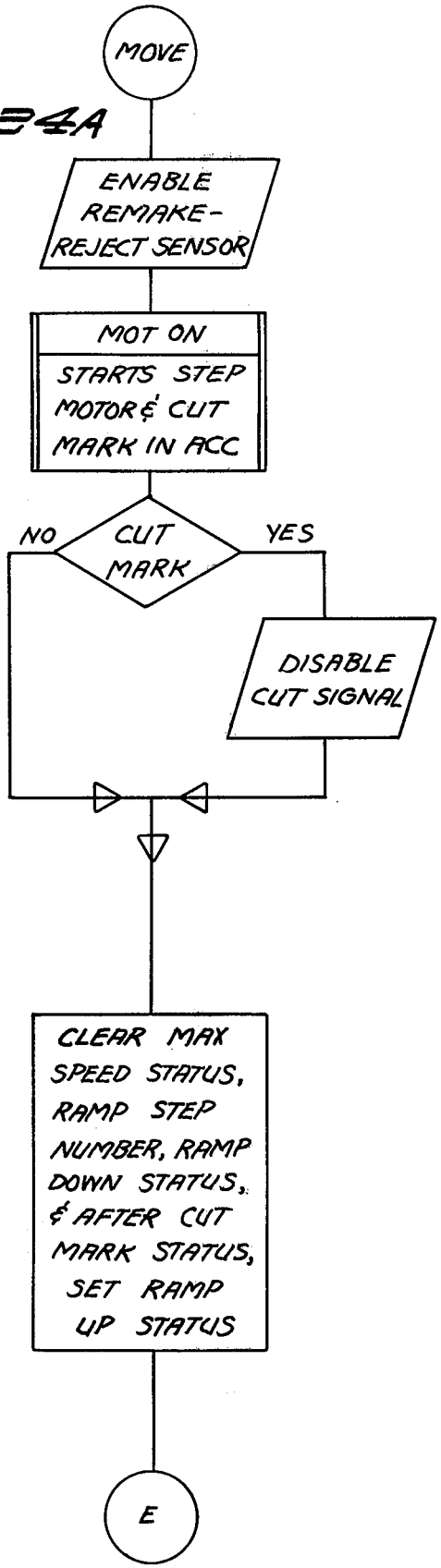
Figure 24B:
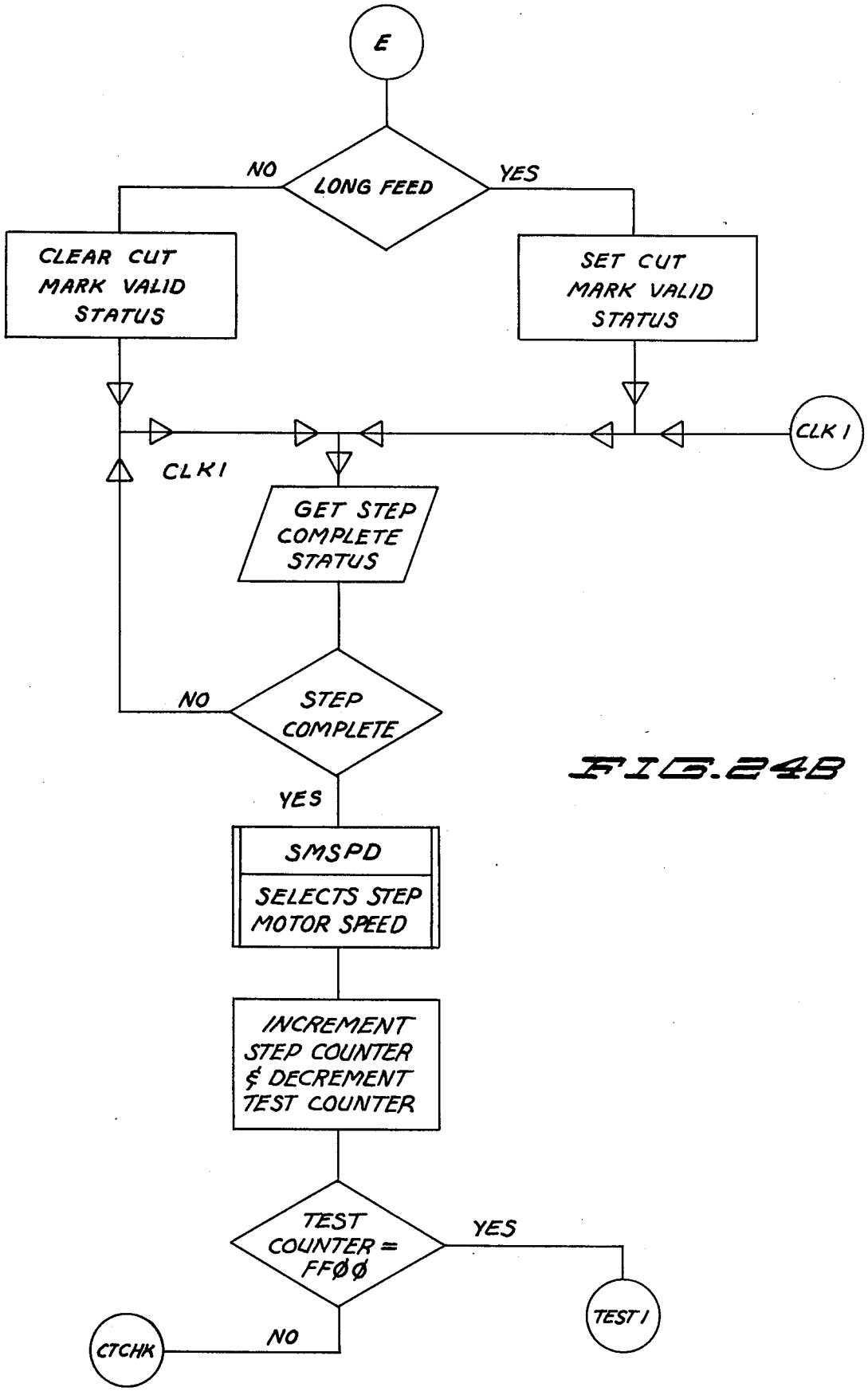

The next routines are the MOVE and the TEST routines, which actually determine the movement of stepper motor 40. FIGS. 24A and 24B illustrate the MOVE routine, and FIGS. 25A-25D illustrate the TEST routine. In the following discussion of the MOVE and TEST routines, both normal automatic operation of the paper cutter and operation in the event of a missing cut mark, as well as non-automatic operation when no cut marks are used, will be discussed. The determination of feed length under normal automatic operation of the paper cutter is the subject of the previously mention co-pending application entitled "Paper Feed Control for Photographic Paper Cutter". Similarly, determination of paper feed length in the case of an occasional missing cut mark is the subject of the previously mentioned co-pending application entitled "Photographic Paper Cutter with Automatic Paper Feed in the Event of Occasional Missing Cut Marks".

(6) RUN Mode - Paper Feed Under Normal Automatic Operation

In both normal automatic operation and operation with an occasional missing cut mark, a test counter is loaded at different times in a paper feed-and-cut cycle with four numbers; (1) the number of steps before a CUT signal is valid or acceptable; (2) the number of steps in a "window" during which a CUT signal is valid; (3) the number of steps before beginning the down ramp; and (4) the number of steps in the down ramp until the end of the print. The particular number (3) differs depending upon whether normal or missing cut mark operation occurs.

The MOVE routine monitors the number of steps that have been taken by incrementing a step counter and decrementing the test counter as each step is taken. With each step, the TEST routine is also performed. When the test counter has a non-zero count, the CTCHK subroutine checks whether a CUT signal has been received, and if not the microprocessor returns to the MOVE routine and allows another step to be taken. Each time the test counter reaches zero, the TEST routine determines the next number to be loaded into the test counter. If the ramp down is complete, the TEST routine causes the ENDPR routine to be commenced.

When the paper cutter is operating automatically, stepper motor 40 is started by the MOTON call (shown in FIG. 20A) and operates at speeds determined by the SMSPD routine (shown in the FIGS. 26A-26C and described in greater detail in a later section). The test counter first contains the number steps to be moved before a cut mark is valid. This first number is generated by the MINFD routine, which forms a part of the PSTAR routine shown in FIGS. 23A and 23B. The MINFD routine substracts the feed-after-sense length (stored in Feed-After-Cut Mark switch 96) and one half of the "window" within which a cut mark should be present (stored in RAM 180) from the feed length (stored by Feed Length switch 84).

When the test counter is decremented to zero for the first time, it means that the minimum feed before a cut mark is valid has been completed. Since to cut mark has been sensed up to that point, the test counter is loaded with a second number which represents the "window" during which a cut signal sould be received. In addition, the cut-mark-valid flipflop is set. Microprocessor 170 then proceeds to the CTCHK subroutine, which determines whether a CUT signal is present. If the CUT signal is not present, the CTCHK routine causes microprocessor 170 to return to the MOVE routine and permit stepper motor 40 to take another step.

Up to this point, both the "normal" and the "missing out mark" operations are identical. If a cut mark is sensed and a CUT signal is produced within the window (i.e. before the test counter is decremented from the second number to zero), normal operation proceeds. If, on the other hand, no CUT signal is produced during the window, missing cut mark operation is commenced. The following discussion will first describe normal operations, and then will describe missing cut mark operation.

In normal automatic operation, a CUT signal is produced within the window, and the CTCHK subroutine sets flipflops indicating that a cut mark has been sensed this print, that the system is ready to ramp down, and that the cycle is proceeding after a cut mark has been sensed. The CTCHK subroutine then loads the test counter with a third mumber, which is the number of steps to be taken until the down ramp is commenced. This third number was derived during the SMSPD routine (FIG. 26C) by subtracting the number of steps required for ramp down from the feed-after-sense number. The MOVE routine is repeated, and with each step the test counter is decremented.

Figures 25A, 25B:
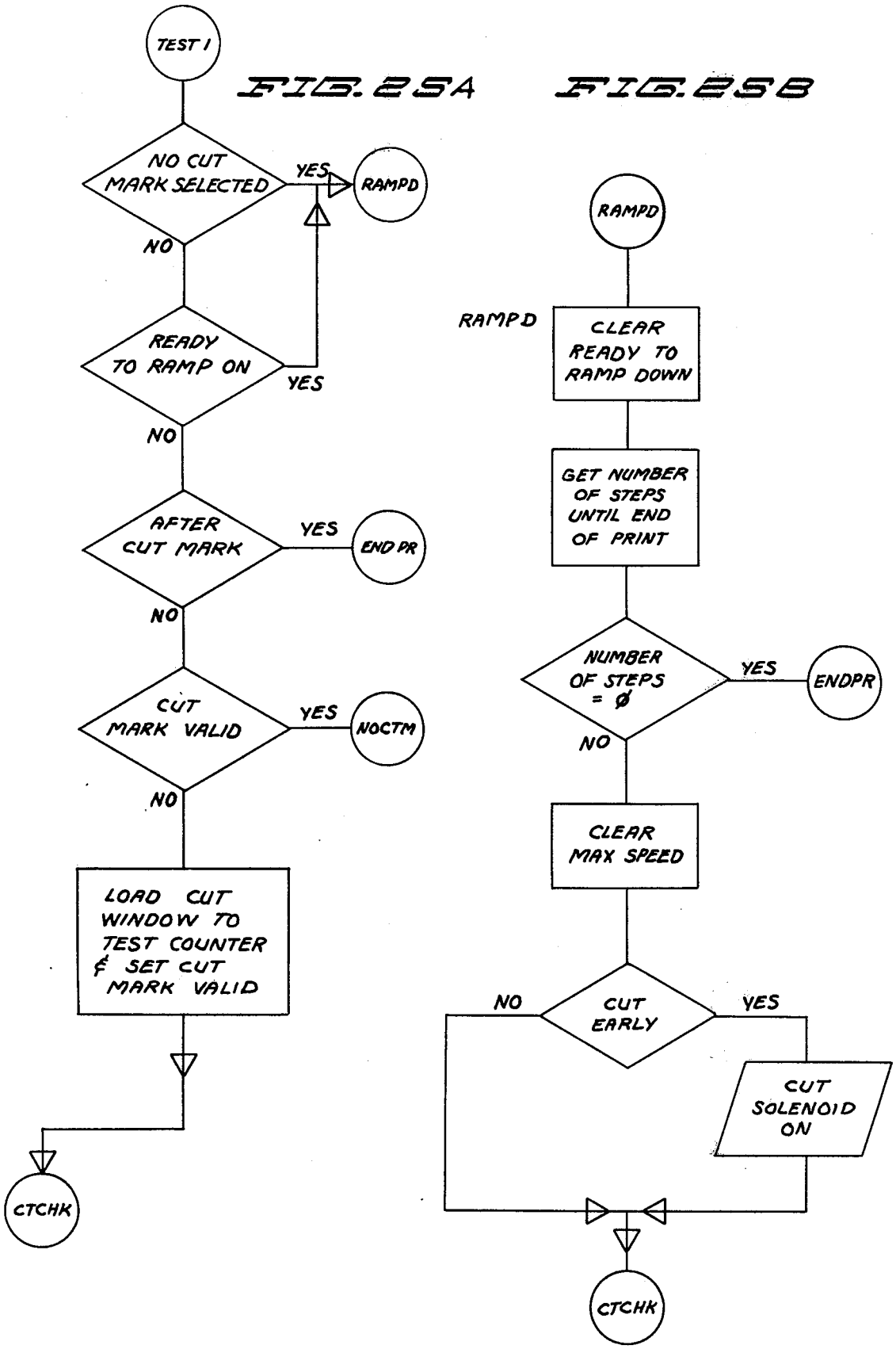

When the test counter again reaches zero, the TEST routine is performed and, because ready-to-ramp-down flipflop is set, the RAMPD subroutine shown in FIG. 25B is performed. In the RAMPD subroutine, the ready-to-ramp-down flipflop is cleared and a fourth number (i.e. the number of steps of the down ramp until the end of the print) is retrieved. If this number is zero, the ENDPR routine is commenced. If, on the other hand, the number of steps is greater than zero so that a down ramp is stepper motor frequency is to occur, the fourth number is loaded into the test counter and the CTCHK subroutine is again performed. Since the cut signal flipflop has been reset by the CTCHK subroutine after it has been received, the MOVE routine is again performed.

When the test counter again reaches zero, the ENDPR routine, shown in FIGS. 27A–27F, is performed. This routine, which is described in greater detail in a later section, performs the necessary functions required to complete a paper feed-and-cut cycle. These functions include enabling the knife assembly, determining whether the print which has been cut is the end of a customer order, and whether the maximim number of prints have been cut. If the end of an order has not been reached, and the maximum number of prints has not been cut, the ENDPR routine causes another paper feed-and-cut cycle to be commenced with the PSTAR routine shown in FIGS. 23A and 23B.

(7) RUN Mode - Paper Feed with Occasional Missing Cut Marks

In "missing cut Mark" operation, no cut signal is produced within the window. When the test counter has reached zero for the second time, the NOCTM subroutine shown in FIG. 25C is commenced.

The NOCTM subroutine clears the cut-mark-valid-flipflop and the flipflop which indicates that a cut mark has been selected for this print. In addition the NOCTM subroutine sets the after-cut-mark flipflop and decrements a counter which contains the number of cut marks which have been missing. If the results of the decrementing are less than zero, the paper cutter is stopped. In a preferred embodiment, the counter initially contains a count of two, so that two consecutive cut marks may be missing without stopping the paper cutter, but the occurrence of more than two consecutive missing out marks will cause the paper cutter to stop.

If two or less consecutive cut marks have been missing at the time the NOCTM routine is performed, the routine then subtracts the count contained in the step counter from the number of steps until ramp down and stores this result in the test counter. The number of steps until ramp down represents the total feed length of the last previous paper feed-and-cut cycle in which cut marks were sensed at both ends of the cycle less the number of steps in the ramp down.

The third number which is supplied to the test counter in missing cut mark operation is generally different than the third number which would be supplied to the test counter during normal automatic operation. The third number supplied during "missing cut mark" operation assures that the paper strip 18 will be fed by the same total feed length as the last print which had cut marks at both ends of the paper feed-and-cut cycle.

When the third number has been loaded into the test counter, the CTCHK subroutine shown in FIG. 25D is again performed and the MOVE routine again permits the stepper motor to take another step. The test counter is decremented with each step of the stepper motor until it again reaches zero. At that time, the RAMPD subroutine is performed and a fourth number (i.e. the number of steps of the down ramp until the end of the print) is retrieved. If this number is zero, the ENDPR routine is commenced. If, on the other hand, the number of steps is greater than zero so that a down ramp in stepper motor frequency is to occur, the fourth number is loaded into the test counter and the CTCHK subroutine is again performed. The CTCHK subroutine causes the MOVE routine to permit additional steps until the test counter again reaches zero. At this time, the ENDPR routine shown in FIGS. 27A–27F is commenced.

Figure 27F:
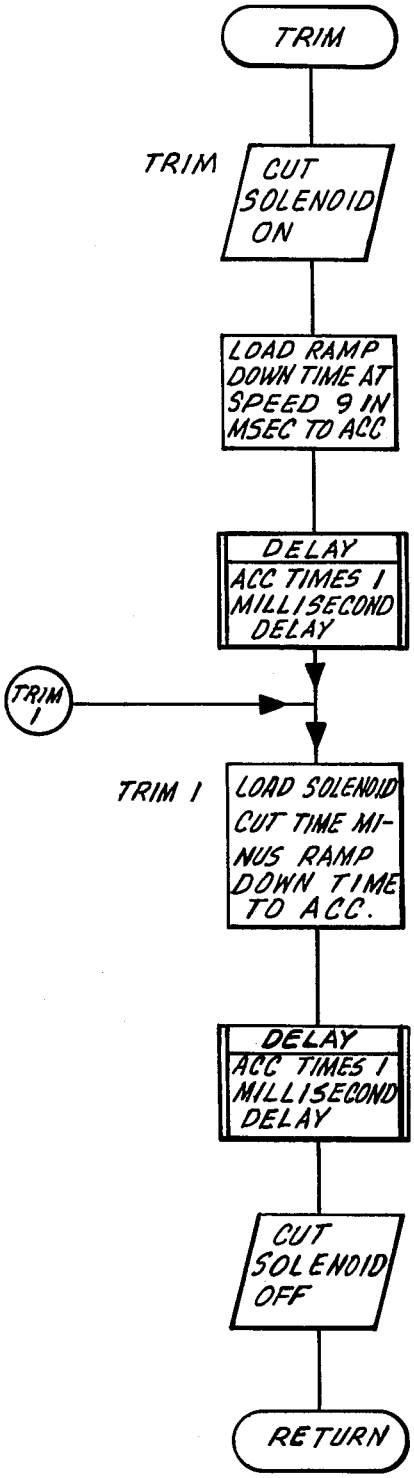
Figure 27A:
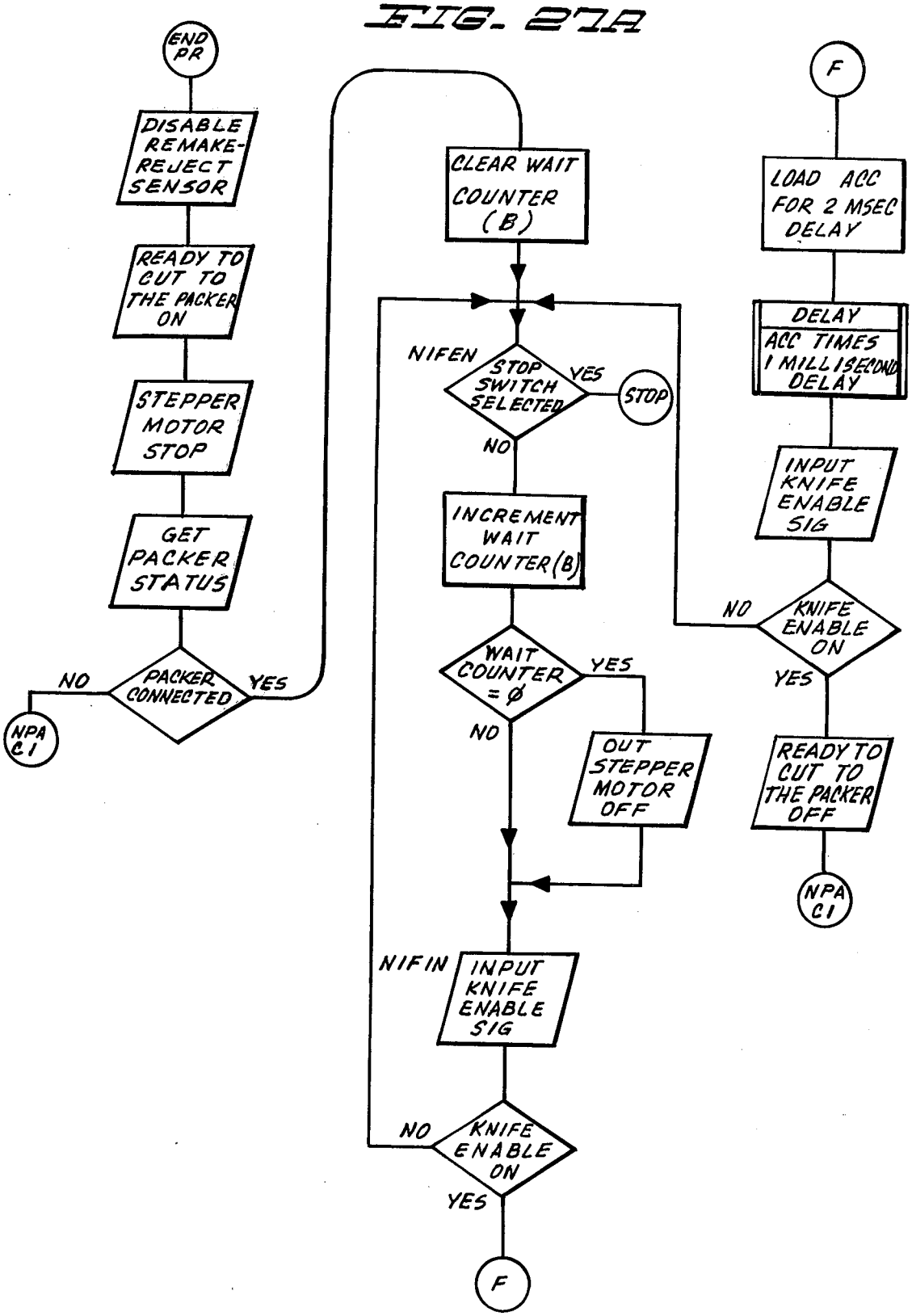
Figure 27B:
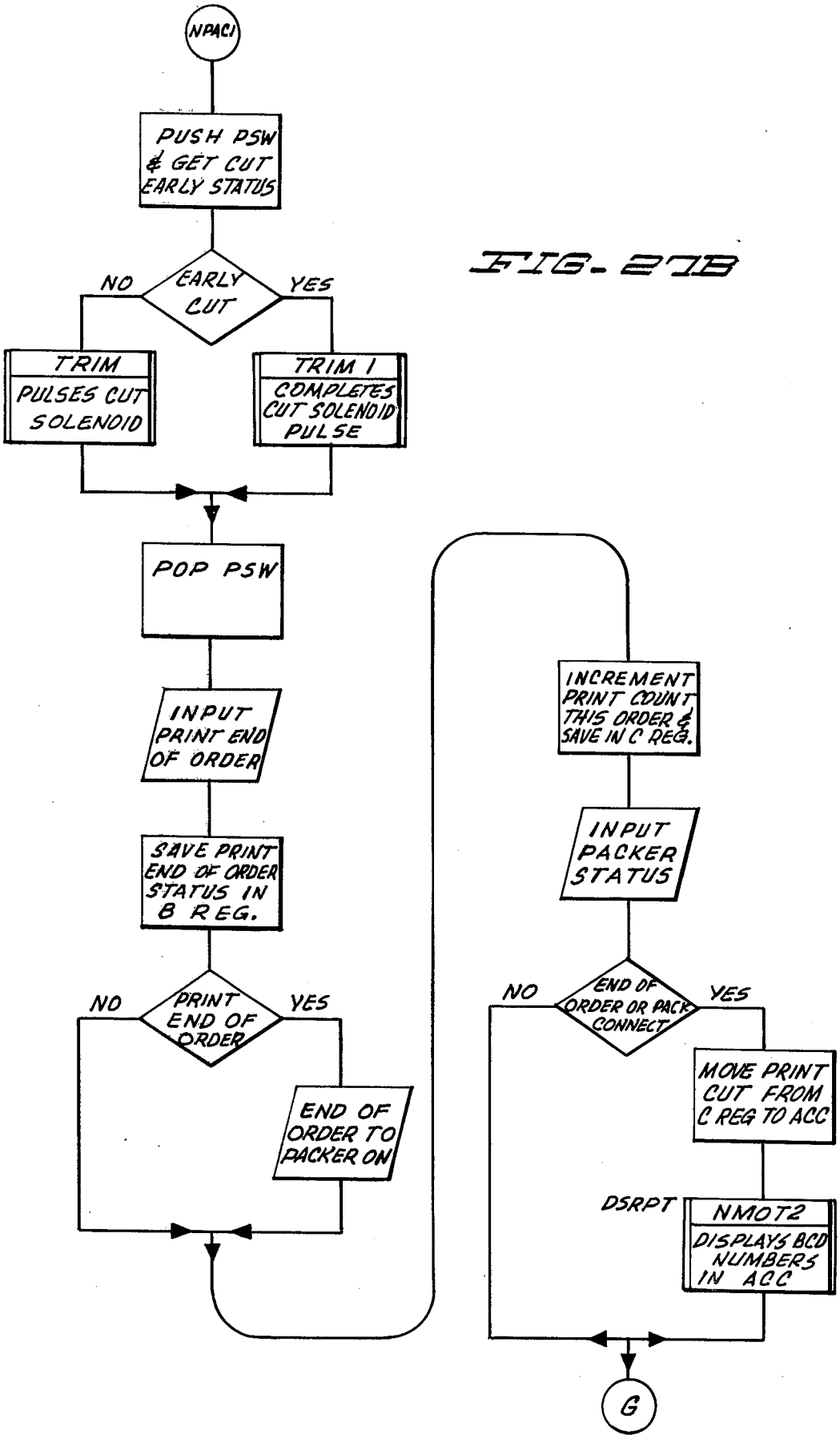
Figure 27C:
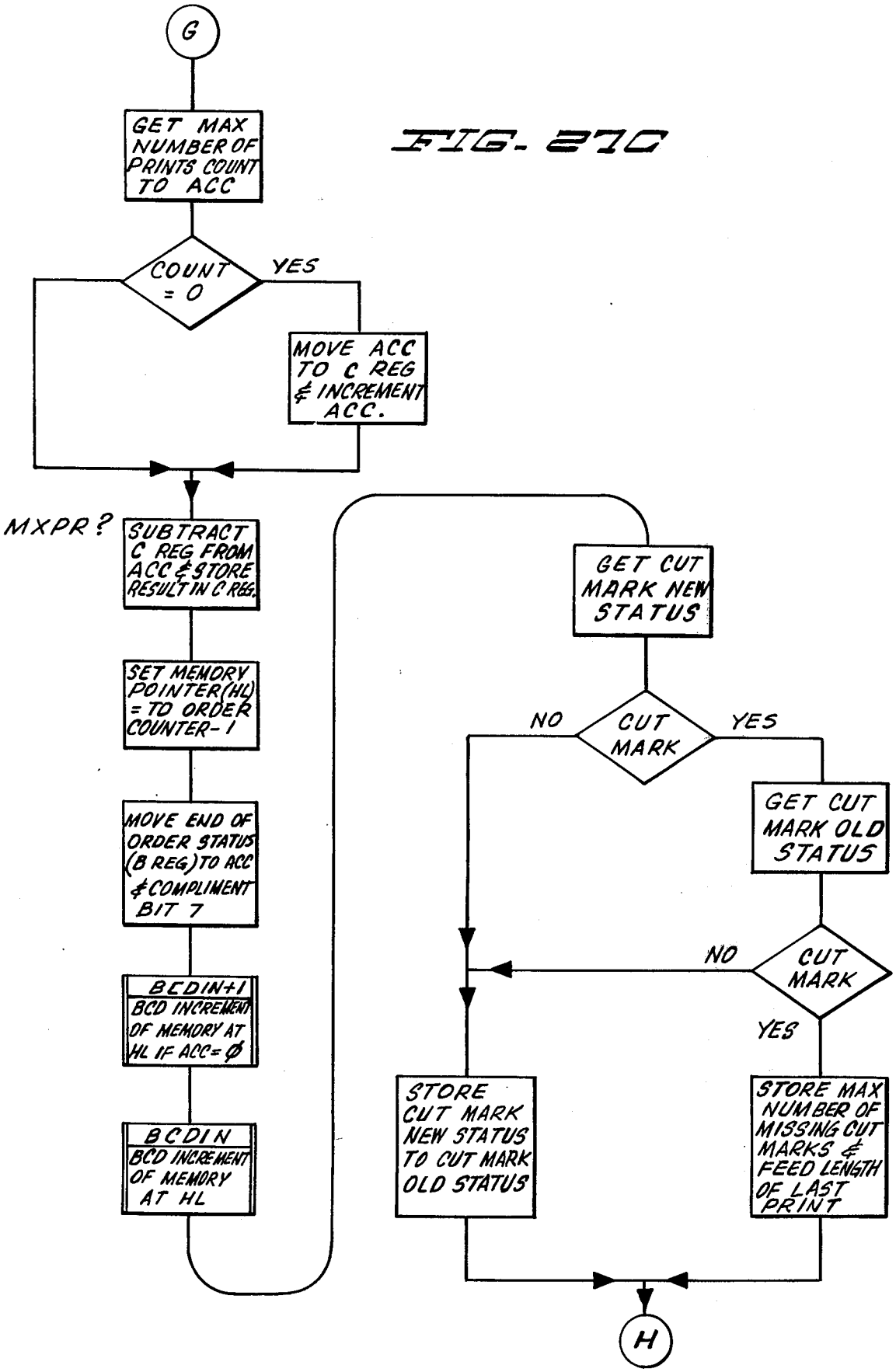

As shown in FIG. 27C, microprocessor 170 checks the "cut-mark-new" and "cut-mark-old" status. The "cut-mark-new" status indicates whether a cut mark was sensed during the paper feed-and-cut cycle which is now being completed, while the "cut-mark-old" status indicates whether a cut mark was sensed during the immediately preceding paper feed-and-cut cycle. If cut marks were sensed during both cycles, microprocessor 170 causes the maximum number of permissible missing cut marks to again be stored in the cut-mark-yet-to-miss counter which is decremented by the NOCTM routine. In addition, the total feed length of the paper feed-and-cut cycle just being completed is stored. In this way, microprocessor 170 continually updates the total feed length and the number of missing cut marks after each paper feed-and-cut cycle.

If a cut mark was missing in either the just completed paper feed-and-cut cycle or the immediately preceding cycle, the cut-mark-new status is transferred to the cut-mark-old status and stored. The stored total feed length is not changed if either cut mark status indicates a missing cut mark.

(8) RUN Mode - Paper Feed Under Nonautomatic Operation

The preceding description of operation of the paper cutter has assumed that the paper cutter will operate in an automatic mode with cut marks being sensed. The paper cutter, however, may also operate in the nonautomatic mode when Cut Mark/No Cut Mark switch 98 is in the "No Cut Mark" position. Under these conditions, the total feed length for a feed-and-cut cycle is the feed length stored in Feed Length switch 84.

The steps taken by stepper motor when nonautomatic (i.e. No Cut Mark) operation is selected are once again controlled by the MOVE routine shown in FIGS. 24A and 24B and the TEST routine shown in FIGS. 25A–25D. When nonautomatic operation is selected, the test counter is loaded with three different numbers during the cycle: (1) the number of steps until the end of the print as derived from Feed Length switch 84; (2) the number of steps before ramp down (determined after completion of the up ramp); and (3) the number of steps until the end of the print.

At the start of a cycle, the total number of steps until the end of the print is first loaded into the test counter. This first number of steps corresponds to the feed length stored in the Feed Length switch 84.

After the up ramp is completed, the count in the test counter is corrected. Microprocessor 170 subtracts the ramp down steps stored in the L register from the number then contained in the test counter and substitutes this corrected second number of steps into the test counter. This operation is shown in FIG. 26C, which is a flow chart of a portion of the SMSPD routine.

When the test counter is decremented to zero, the RAMPD subroutine is commenced and the number of steps of the down ramp is retrieved. If this number is zero, the ENDPR routine is commenced. If, on the other hand, the number of steps of the down ramp is greater than zero, this number of steps is loaded into the test counter and the CTCHK routine is again performed. When the test counter again reaches zero, the ENDPR routine shown in FIGS. 27A–27F is performed.

It can be seen, therefore, that operation with no cut marks is generally similar to the operation when cut marks are being sensed. Microprocessor 170 monitors the step status signal, counts the number of steps which have been taken and determines the number of steps which stepper motor 40 may take. When no cut marks are being used, the feed length is determined by the number stored by feed length switch 84, rather than being determined by the sensing of a cut mark together with the stored feed-after-sense length stored in feed-after-cut-mark switch 96.

(9) Stepper Motor Speed Control

Figure 26B:
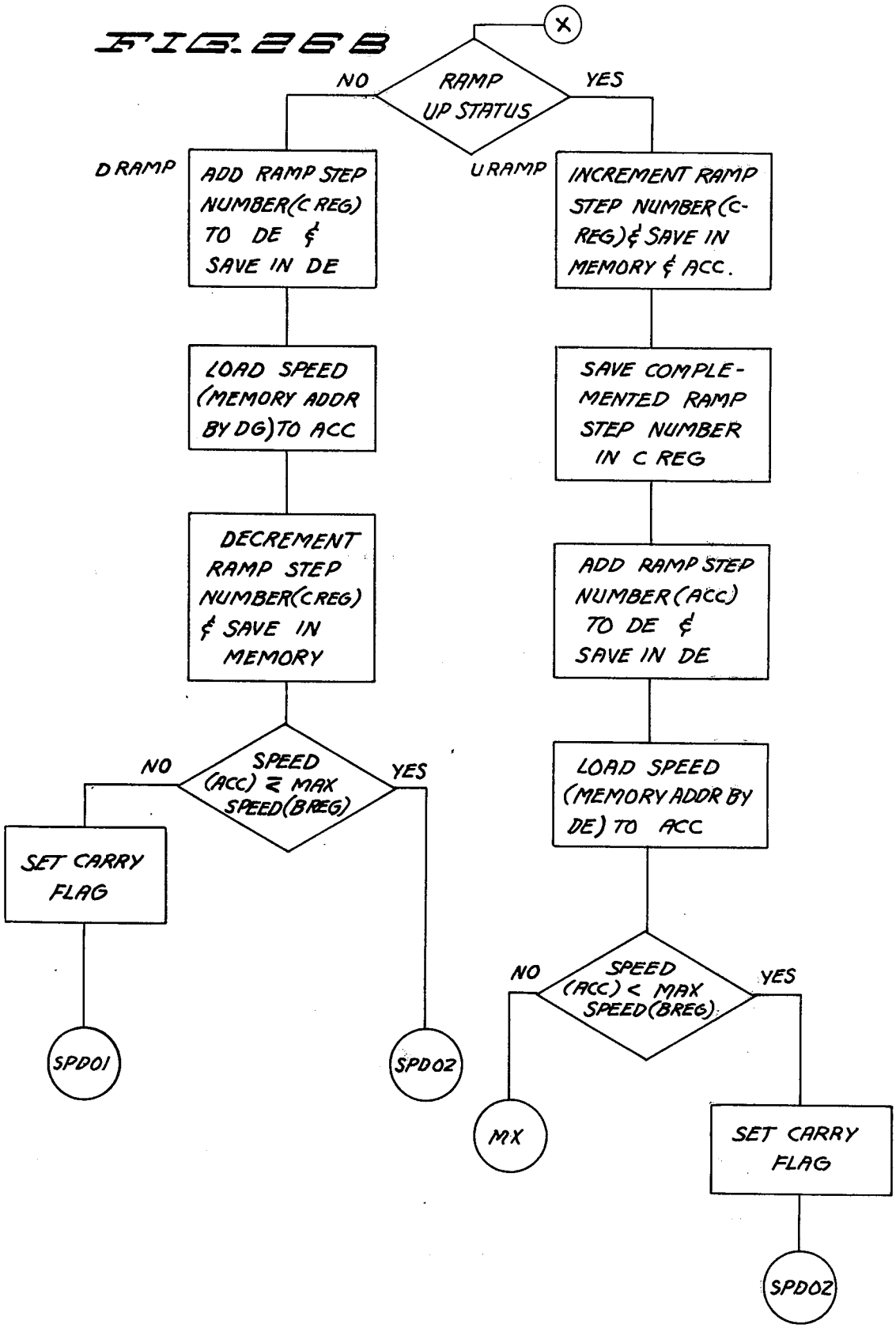

FIGS. 26A, 26B, and 26C, and Table 1 illustrate the SMSPD routine, which is the subject of the previously mentioned co-pending application entitled "Stepper Motor Control". This routine controls the speed of stepper motor 40 and determines whether stepper motor 40 is ramping up, ramping down, or is at a maximum or fixed speed.

When a paper feed-and-cut cycle is commenced, the speed of stepper motor 40 must be increased by an up ramp from the initial speed supplied by the MOTON call (FIG. 20A) to the desired maximum speed. This maximum speed is then maintained until it is desired to stop the paper feed. A down ramp in stepper motor drive frequency is then generated so that the stepper motor decelerates before being brought to a complete stop.

Until the initial up ramp conditions, the number associated with a particular maximum speed selected by speed select switch 80 its retrieved from a lookup table and stored in the B register. Table 1 illustrates a lookup table for selected maximum speeds utilized in one preferred embodiment of the present invention. Ten possible stepper motor speeds are available from the lookup table shown in Table 1.

Table 1 also includes a lookup table used for both up ramp and down ramp operation of the stepper motor. A total of 40 numbers ranging from 16 to 99 are contained in the ramp lookup table shown in Table 1. The numbers are in a sequence which is generally increasing from 16 to 99. It should be noted, however, that on occasion, two numbers in a sequence may be the same, or a later number in a sequence may be less than the number preceding it. These variations in the generally increasing pattern of the sequence are required to provide the proper up ramp or down ramp associated with each of the numbers contained in the maximum speed lookup table shown in Table 1.

In the SMSPD routine, the number of steps taken to reach the maximum speed is monitored and stored in the C register. If the maximum speed has not been attained and an up ramp is not being generated, the ramp step number saved in the C register is incremented and saved in the memory and in the accumulator. The ramp step number is then complemented and stored in the C register, so that the number of steps in the reverse order required to reach that particular ramp step is known and stored. This information is necessary during down ramp operation since the same lookup table is used for generating both up ramps and down ramps, with the numbers of the ramp lookup table being used in reverse sequential order during down ramp conditions.

If the speed which has been loaded into the accumulator is less than the maximum speed stored in the B register, the speed in the accumulator is outputted to programmable I/O device 184, and ultimately to the stepper motor clock 186. Since the maximum speed has not been attained, a conditional return causes the routine to return to the beginning.

If, on the other hand, the speed in the accumulator is greater than or equal to the maximum speed stored in the B register, the maximum speed is moved to the accumulator, and the maximum speed is outputted to programmable I/O device 184. The complement of the ramp step number at which the speed in the accumulator first reaches or exceeds the maximum speed is saved in the L register for use during the down ramp.

Once maximum speed has been attained, the maximum speed is maintained until it is time to begin the dowm ramp. The down ramp proceeds in generally the same manner as the up ramp, except that the numbers from the ramp lookup table are taken from memory in reverse order, and the number in the sequence at the beginning of the down ramp is determined by the ramp down steps stored. If the speed in the accumulator is less than the maximum speed, the speed in the accumulator is outputted to programmable I/O device 184. Conversely, if the speed in the accumulator is greater than or equal to the maximum speed, the maximum speed is transferred to the accumulator and then outputted to programmable I/O device 184.

(10) End of Print Operations

At the end of every paper feed-and-cut cycle, the ENDPR routine shown in FIGS. 27A–27F is performed. This routine performs the necessary functions required to complete the paper feed-and-cut cycle.

The portions of the ENDPR routine shown in FIG. 27A and a portion of FIG. 27B are concerned primarily with the enabling of paper cutter-knife assembly 58. During this portion of the ENDPR routine, stepper motor 40 is stopped and the knife is enabled. Enabling of the knife assembly 58 will occur after the stepper motor is stopped unless the highest speed has been selected by speed select switch 80. In that case, an early cut has been selected and knife assembly 58 is actually energized earlier than it normally would be energized. FIG. 27F shows the TRIM routine which energizes and de-energizes the knife solenoid during the ENDPR routine.

FIG. 27B also shows a portion of the ENDPR routine which is concerned primarily with displaying the number of prints cut in a particular order. This portion of the ENDPR routine is described in greater detail in a later section.

Figure 28:
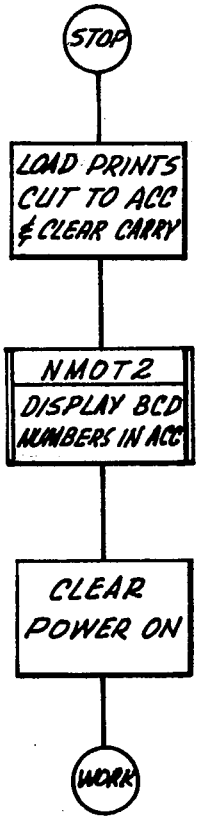
Figure 29:
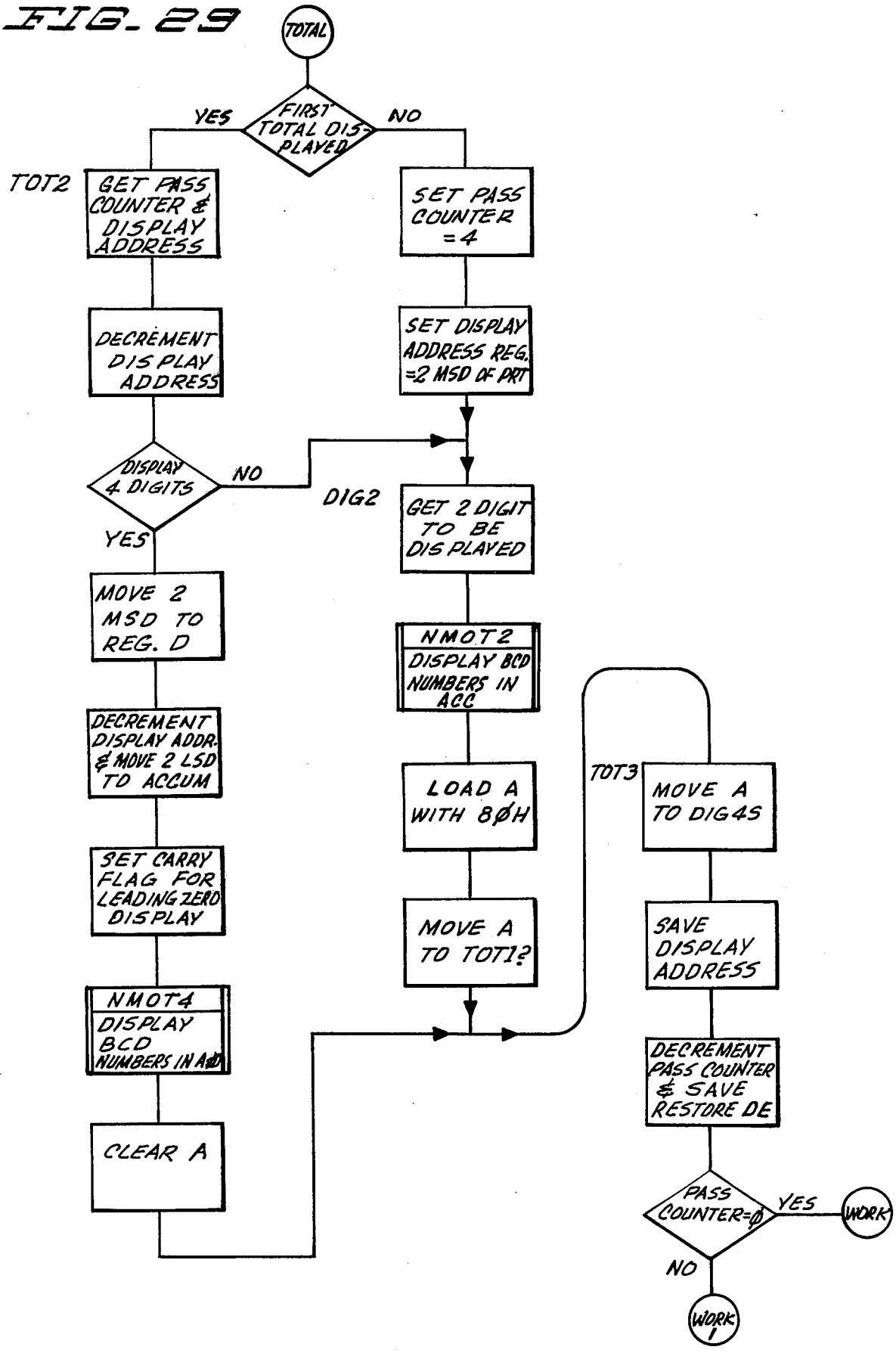

FIG. 27C illustrates a portion of the ENDPR routine which determines whether the maximum number of prints have been cut. If the maximum number of prints have been cut, which is determined by the setting of maximum-number-of-prints switch 94, the STOP routine shown in FIG. 28 is commenced. No further paper feed-and-cut cycles can be commenced without some action being taken by the operator.

The remaining portion of FIG. 27C is concerned with the determination of the number of consecutive cut marks that have been missing and total feed length of the last cycle in which both ends of the cycle were defined by valid cut marks. This function has been described previously in conjunction with the operation of the cutter under occasional missing cut mark conditions.

Figure 27D:
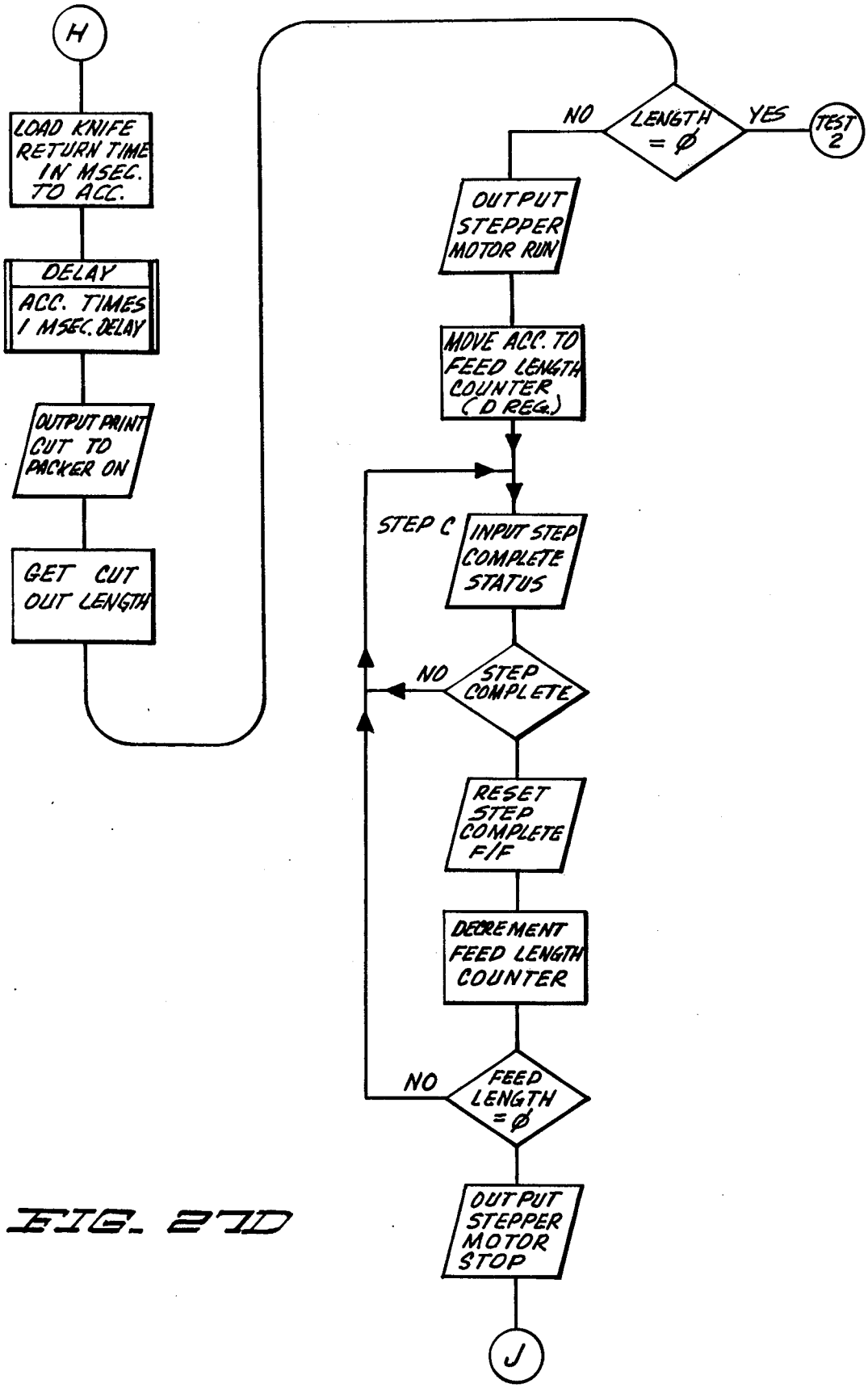
Figure 27E:
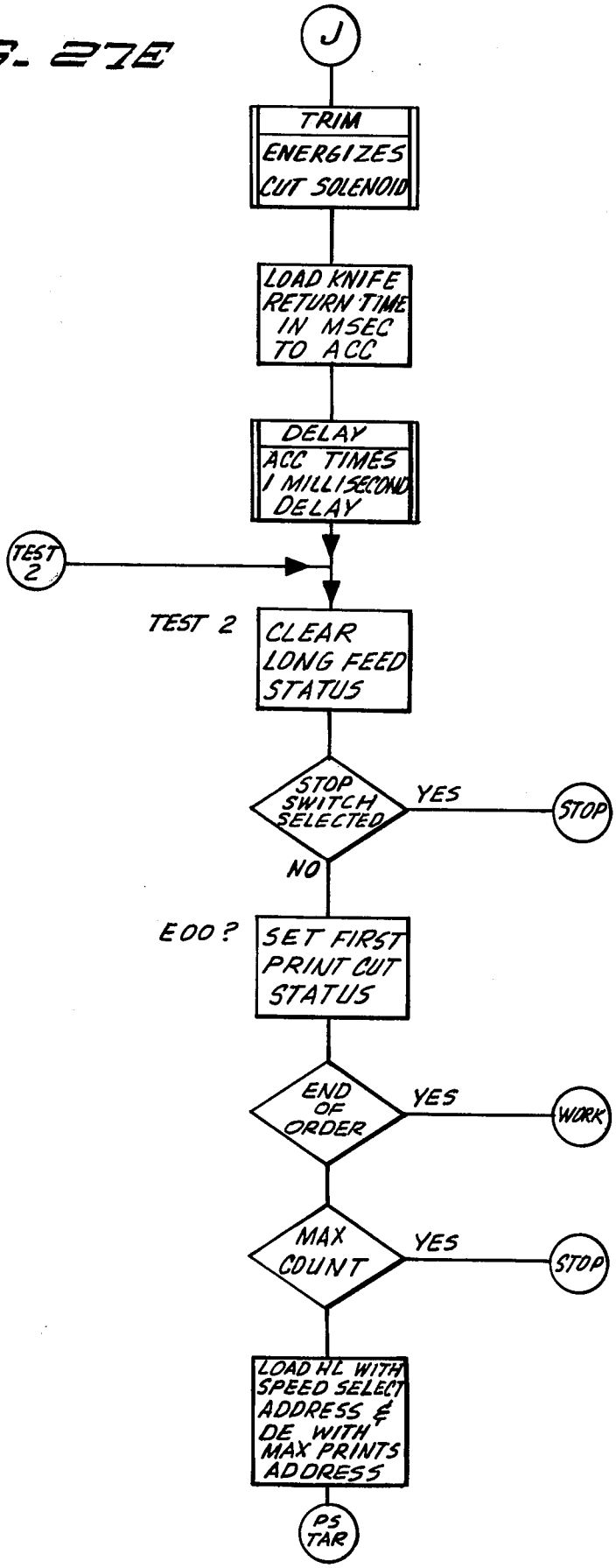

FIGS. 27D and 27E are concerned with the operation of the paper cutter if a slug must be cut out of the paper between prints. This function is performed if the cutout length stored in Length of Cut Out switch 92 is nonzero. In that case, stepper motor 40 is again operated to drive the paper by the number of steps indicated by Length of Cut Out switch 92. When this distance has been completed, stepper motor 40 is stopped and the TRIM routine is performed to energize the knife assembly.

FIG. 27E also illustrates the portion of the ENDPR routine which determines whether another feed-and-cut cycle should be commenced with the PSTAR routine. If Start/Stop switch 88 is in the Stop position or the maximum number of prints has been cut, the STOP routine is performed. If the end-of-order status circuit 294 indicates that an end-of-order signal has been received, microprocessor 170 returns to the WORK routine and another order will be commenced when the operator places Start/Stop switch 88 in the Start position. If the end of an order has not been reached, the maximum number of prints has not been cut, and the Start/Stop switch 88 is not in the Stop position, microprocessor 170 returns to the PSTAR routine and another feed-and-cut cycle is commenced.

(11) Display Operations

In the system shown in the preceding FIGS., the information displayed by display 76 depends upon the particular mode selected by mode switch 82. When the FEED LENGTH CALIBRATE mode is selected, the feed length from cut mark to cut mark is displayed so that the operator can set that length into Feed Length switch 84. When the FEED AFTER SENSE mode is selected, the feed-after-sense length is displayed so that the operator can enter that length into Feed-After-Cut-Mark switch 96. When either the RUN mode or the TOTAL mode is selected, display 76 functions as a part of a print and order totalizer system which is the subject of the previously mentioned co-pending application entitled "Print and Order Totalizer for Automatic Photographic Paper Cutter".

When the RUN mode is selected, display 76 displays the number of prints cut in a particular order. If the automatic paper cutter is being used in conjunction with an automatic print packing device (i.e. packer 164 is connected), the print count displayed is incremented as each print is cut. If, on the other hand, the automatic paper cutter is not being used in conjunction with an automatic print packing device, display 76 displays the number of prints cut in an order, and holds that number while the next order is being cut. This provides the operator with sufficient time to record the number of prints in the previous order.

If the cutter is stopped in the middle of an order, the number of prints in the order cut up to that time is displayed. Paper cutter control 154 then returns to scanning the states of the switches on main and auxiliary control panels 72 and 74 to determine whether any of the switch settings have been changed and whether the operator has initiated another paper feed-and-cut cycle.

When the TOTAL mode is selected, display 76 displays the number of prints cut and orders completed since powder was turned on. Because display 76 contains only four digits, and the number of prints or orders cut may exceed 10,000, the two most significant digits of the print count are first displayed, followed by the four least significant digits. Next, the two most significant digits of the order count are displayed, followed by the four least significant digits. This sequence continues as long as the TOTAL mode is selected. If a display having a large number of digits is used, the sequence in the TOTAL mode may, of course, be changed.

As shown in FIG. 27B, the print count for each order is incremented and saved in the C register each time ENDPR routine is performed. If packer 164 is connected, the print count is moved from the C register to the accumulator, and displayed on display 76. Similarly, if packer 164 is not connected, but the end of an order has been sensed, the print count is moved from the C register to the accumulator and displayed on display 76.

The effect of this routine is that the print count in an order will be displayed each time a print is cut if an automatic packer or sorter is used with the automatic print cutter. If, on the other hand, the automatic paper cutter is being used without an automatic packer or sorter, display 76 only displays the print count at the end of an order and holds that print count throughout the next order until that order is completed. This allows the operator sufficient time to record the number of prints in the previous order. Since this information is necessary only when the cutter is being used without an automatic packing device, maintaining the previous print count throughout the next order is only performed when no automatic packing is connected to the automatic paper cutter.

FIG. 28 shows the STOP routine, which occurs if the paper cutter is stopped in the middle of an order. This may occur due to some malfunction in the system because the maximum number of prints permitted by Maximum Number of Prints switch 94 have been cut, or because the operator depresses the stop switch. In the STOP routine the number of prints cut thus far in the order is loaded in the accumulator and displayed. The "power on" status is cleared and the microprocessor 170 returns to the WORK routine (not shown) in which the state of the various switches on main and auxiliary control panels 72 and 74 are interrogated to determine whether any change in switch settings has been made and to determine whether the operator has initiated another print-and-cut cycle by depressing the start switch.

The TOTA routine displays the totals of prints cut and orders completed since power was turned on. In the embodiment shown in FIG. 29, the two most significant digits of prints cut is first displayed, followed by the four least significant digits of prints out. Then, the two most significant digits of orders completed are displayed, followed by the four least significant digits. This sequence is repeated, as long as the TOTAL mode is selected by the mode select switch 82.

In the TOTAL mode, therefore, the total number of prints cut and the total number of orders completed is counted, stored, and then displayed. The information provided by the TOTAL mode is particularly useful to management, since it permits an accurate determination of the performance of both the automatic paper cutter and the particular operator assigned to that paper cutter. As long as power remains on continuously, the print and order totalizer system continues to count the total number of prints and orders. It is possible, therefore, to determine the total number of prints and orders processed for each shift, or for each day, depending upon whether the power to the automatic paper cutter is turned off between shifts.

Figure 30C:
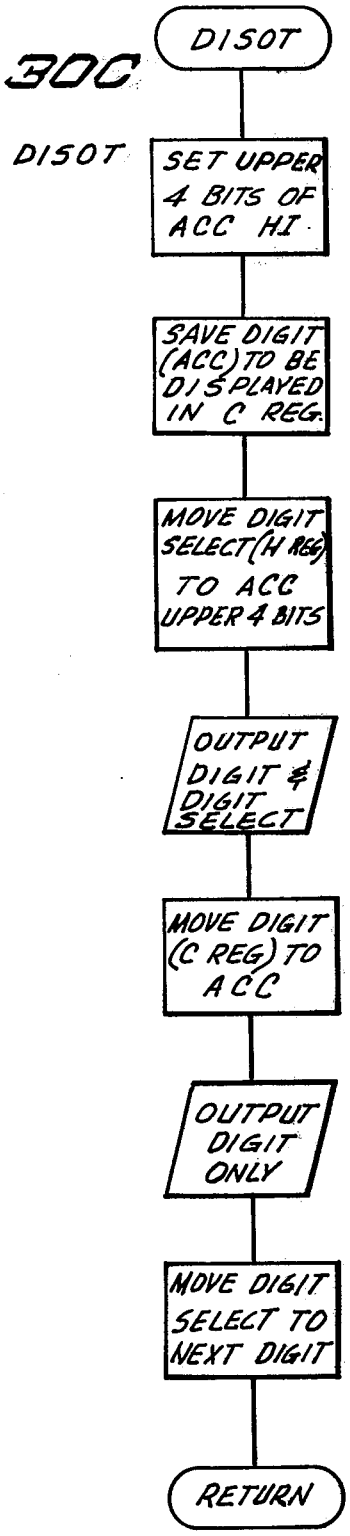
Figure 30A:
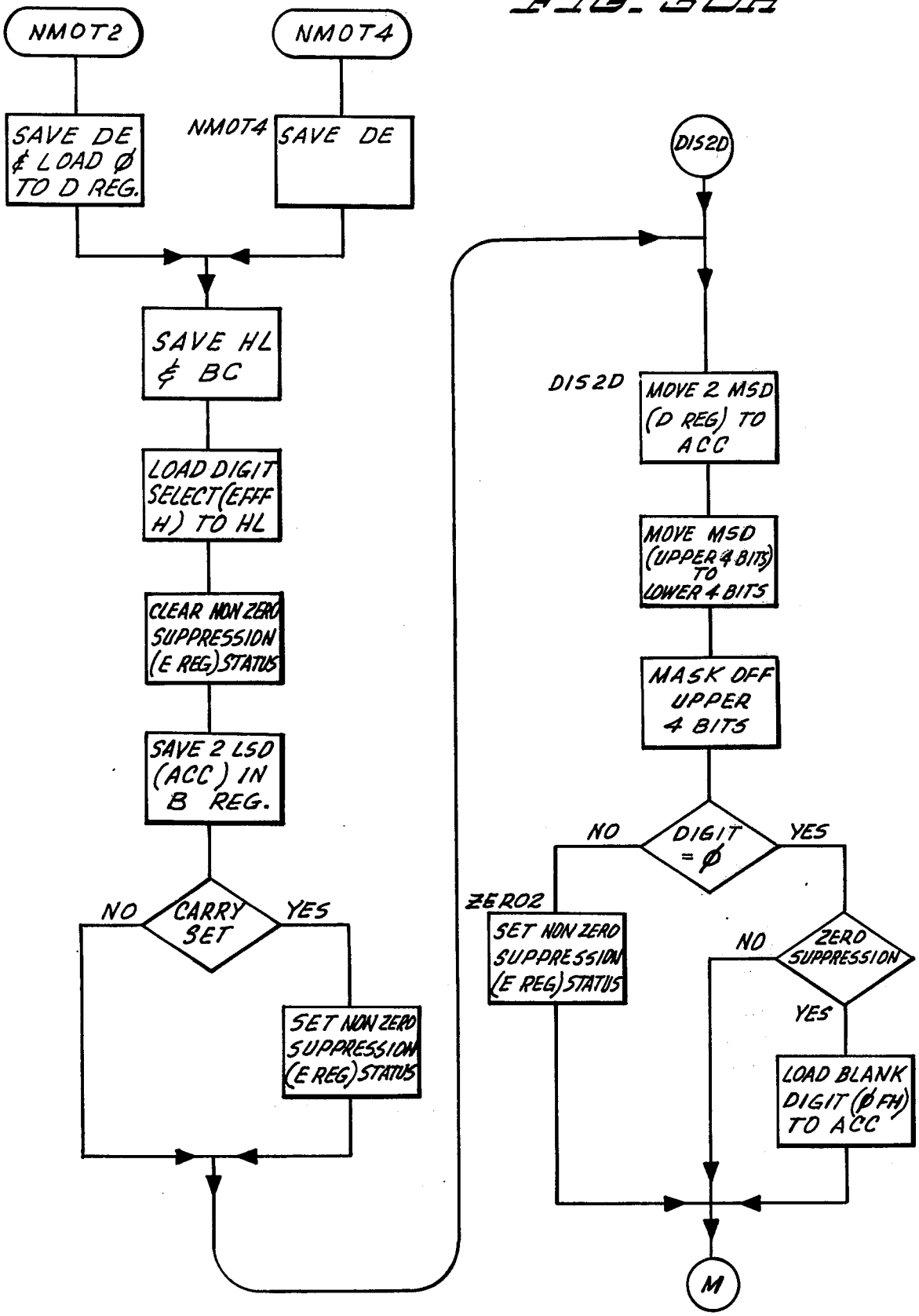
Figure 30B:
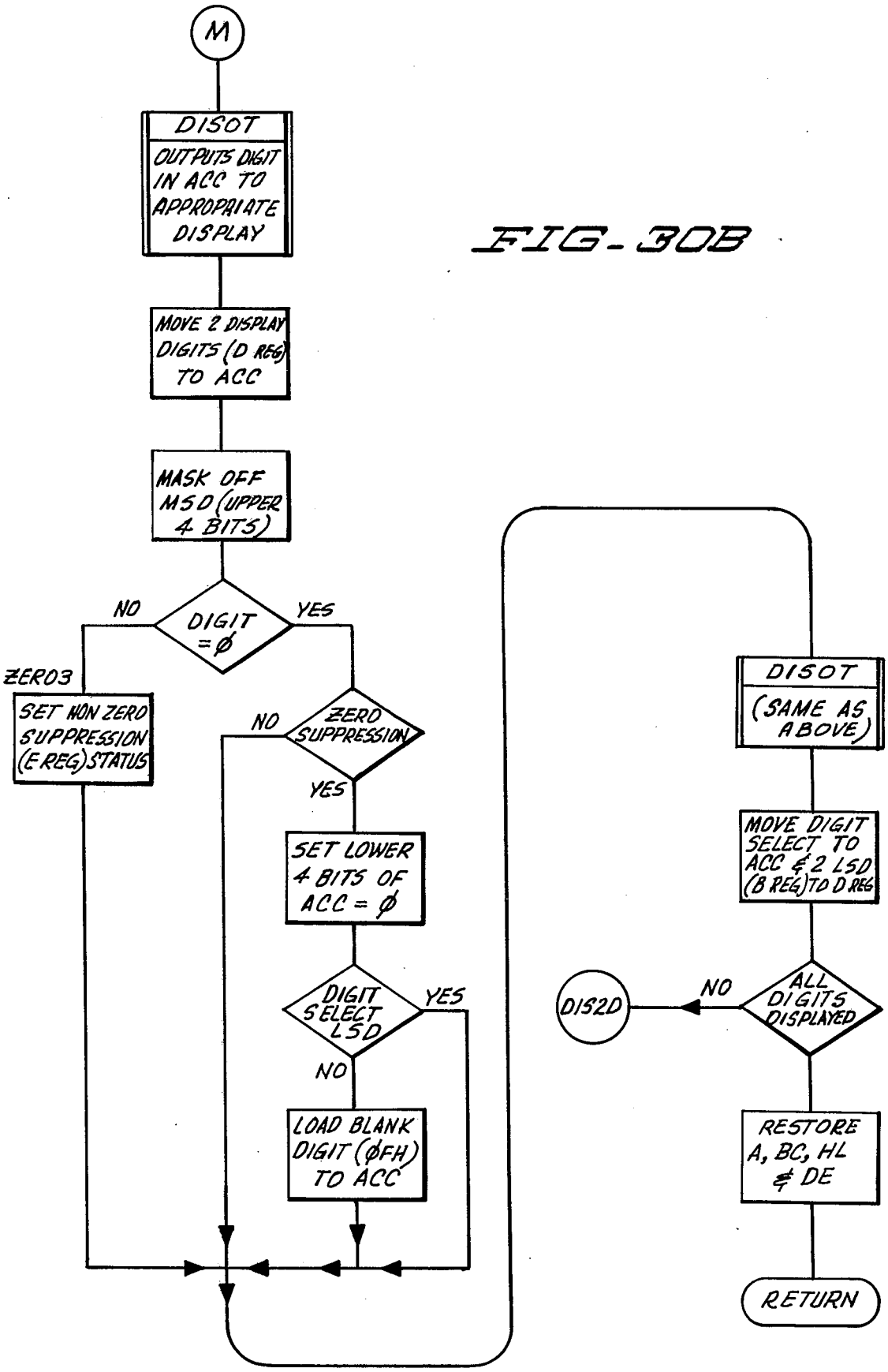

FIGS. 30A–30C illustrate the DISP routine. This routine allows either two or four digits to be displayed on digital display 76. The DISP routine is used in conjunction with the various routines which involve control of display 76.

Conclusion

The present invention is an electrical control system for controlling advancement of photographic strip material (i.e. either photographic print paper or photographic film) which makes use of the information handling and control capabilities of a digital processor (preferably a microprocessor). The operation of the strip feed mechanism, the knife assembly, and the display is coordinated and controlled by the digital processor as a function of various status signals which are received by the digital processor, together with control information which is stored in memories associated with the processor (i.e. RAM 180 and ROM 182 and switches on main and auxiliary control panels 72 and 74). As a result, the present invention provides highly accurate, efficient, flexible and high-speed control.

Although the present invention has been described with reference to preferred embodiments, workers skilled in the art will recognize that changes may be made in form and detail without departing from the spirit and scope of the invention. For example, although a specific automatic photographic paper cutter has been described which uses the present invention to control operation of the cutter, it will be recognize that the present invention may also be used to control photographic film cutters, film notchers, and printers. Similarly, the present application has described several specific functions of the control system of the automatic paper cutter which form the subject matter of the various previously mentioned co-pending applications. The present invention is not concerned with these specific functions and may be used in cutters which do not include any of these specific functions merely by using different stored control information.

TABLE 1

```
;ROUTINE;EQU
;
;EQUATES FOR 451 PAPER CUTTER
;
;MEMORY INPUT PORTS
;
PAFD1   EQU     1000H   ;2 LSD OF PAPER FEED LENGTH
PAFD2   EQU     1001H   ;MSD OF PAPER FEED LENGTH
CTFD1   EQU     1002H   ;2 LSD OF FEED AFTER CUT MARK
CTFD2   EQU     1003H   ;MSD OF FEED AFTER CUT MARK
CTOUT   EQU     1004H   ;2 DIGITS,CUT OUT BETWEEN PRINTS
SPDSL   EQU     1005H   ;LSD-SELECTS MAX SPEED OF MTR
                        ;MSD-4 SWITCHES ON SENSOR AMP
MAPRS   EQU     1006H   ;MAX NUMBER OF PRINTS PER ORDER
IDVSW   EQU     1007H   ;INDIVIDUAL SWITCHES:
                        ;0-NO CUT MARK,1-TRIM,2-START,
                        ;4-7-MODE SELECTION
;
;ISOLATED INPUT PORTS
;
CORREC  EQU     0DFH    ;MACHINE KNIFE TO PRINT
                        ;EDGE CORRECTION SWITCH
;
;BITS 0-6 OF THE FOLLOWING INPUT PORTS ARE LOW AND
; CONTAIN NO DATA.
;
STEPC   EQU     0F0H    ;BIT 7 HI FOR STEP COMPETE
CTSIG   EQU     0F1H    ;BIT 7 HI FOR CUT MARK
PREOO   EQU     0F2H    ;BIT 7 HI FOR PRINT END OF ORDER
PACK    EQU     0F3H    ;BIT 7 LO FOR PACKER CONNECTED
KNIFE   EQU     0F4H    ;BIT 7 LO FOR PACKER KNIFE ENABLE
CTCP    EQU     0F5H    ;BIT 7 LO FOR CUT COMPLETE
RJECT   EQU     0F6H    ;BIT 7 HI FOR REJECT THIS PRINT
RMAKE   EQU     0F7H    ;BIT 7 HI FOR REMAKE THIS PRINT
;
;ISOLATED OUTPUT PORTS
;
;PORT ADDRESSES BEGINNING WITH B AND E DO NOT USE
;INFORMATION ON THE DATA BUS.
;THE MOST SIGNIFICANT HEXADECIMAL DIGIT OF THE PORT
;ADDRESS SELECTS AN ADDRESSABLE LATCH AND BITS 0-2 SELECTS
;A SINGLE BIT IN THE LATCH. THE STATE OF THE SELECTED BIT
;IS DETERMINED BY BIT 3 OF THE PORT ADDRESS.
;
RCKOF   EQU     0B0H    ;RESET STEP COMPLETE F/F OFF
REOOF   EQU     0B1H    ;RESET END OF ORDER F/F OFF
RCSOF   EQU     0B2H    ;RESET CUT SIGNAL F/F OFF
SMCCW   EQU     0B3H    ;STEP MTR CCW(REVERSE)
SMSTP   EQU     0B4H    ;STEPPER MOTOR STOP
RRCOF   EQU     0B5H    ;RESET REMAKE/REJECT COUNTER OFF
RCKON   EQU     0B8H    ;RESET STEP COMPLETE F/F ON
REOON   EQU     0B9H    ;RESET END OF ORDER F/F ON
RCSON   EQU     0BAH    ;RESET CUT SIGNAL F/F ON
SMCW    EQU     0BBH    ;STEP MTR CW(FORWARD)
SMRUN   EQU     0BCH    ;STEPPER MOTOR RUN
RRCON   EQU     0BDH    ;RESET REMAKE/REJECT COUNTER ON
;
SPDGN   EQU     0DCH    ;SET FREQ OF STEPPER CLK SPD GEN
DISPY   EQU     0DDH    ;BCD TO 2 DIGIT DISPLAY
;
```

```
SMOFF   EQU     0E0H    ;STEPPER MOTOR OFF
CTOFF   EQU     0E1H    ;CUT SOLENOID OFF
RRSOF   EQU     0E2H    ;REMAKE-REJECT SENSOR NOT ENABLED
AVCOF   EQU     0E3H    ;ADVANCE COMPLETE OFF
EOOOF   EQU     0E4H    ;END OF ORDER OFF
PCTOF   EQU     0E5H    ;PRINT CUT OFF
SMON    EQU     0E8H    ;STEPPER MTR ON
CTON    EQU     0E9H    ;CUT SOLENOID ON
RRSON   EQU     0EAH    ;REMAKE-REJECT SENSOR ENABLED
AVCON   EQU     0EBH    ;ADVANCE COMPLETE ON
EOOON   EQU     0ECH    ;END OF ORDER ON
PCTON   EQU     0EDH    ;PRINT CUT ON
;
;ROUTINE EQUATES
;
ADVSW   EQU     04      ;DIAGNOSTIC ADVANCE SWITCH
CUTL    EQU     15      ;CUTL*1.0 MSEC=CUT SOL ON TIME
CUTTM   EQU     52      ;CUTTM*1.0MSEC=KNIFE RET TIME
CWIND   EQU     10      ;+ OR - VARIATION OF CUT MARK
                        ;LOCATION(# OF STEPS)
DSTOR   EQU     0FF80H  ;START OF DATA STORAGE
INITC   EQU     40H     ;INITIATE CONTINUE
MXMCM   EQU     2       ;MAX NUMBER OF MISSING CUT MARKS
PEDGE   EQU     110     ;PRINT EDGE TO KNIFE FEED LENGTH
SPDTB   EQU     700H    ;START OF LOOK UP TABLES
STOPS   EQU     700     ;STOP SWITCH INTERRUPT
WHY0    EQU     0       ;TEST FOR NORMAL OPERATION
WHY4    EQU     STOPS   ;STOP SWITCH SELECTED
;
;ROUTINE:INIT
;
;THIS ROUTINE IS FOR INITIAL START UP AND THE
;INTERRUPTS.
;
INIT:
        LXI     H,DSTOR
        SPHL            ;INITIALIZE STACK POINTER
        JMP     INITC   ;ALLOW SPACE FOR FUTURE INTERRUPTS
        ORG     STOPS
STOPS:                  ;STOP SWITCH
        CALL    STOP    ;SAVE REASON FOR STOP & DISPLAY
                        ;PRINT COUNT
        POP     H       ;DUMP RETURN ADDRESS
        JMP     WORK
        ORG     INITC
INITC:                  ;INITIATE CONTINUED
        MVI     A,89H   ;A,B-OUTPUT C-INPUT
        OUT     DISPY+2 ;CONTROL TO PPI
        XRA     A       ;SET A =0
        CALL    NMOT2   ;SHOW DISPLAY=0
INITM:                  ;INITIALIZE MEMORY
        MOV     M,A     ;ALL DSTORE=0
        INR     L
        JNZ     INITM   ;IF HL=/0,JUMP
;
;ROUTINE:WORK
;
;THIS ROUTINE READS THE CONTROL SWITCHES AND STORES
;THE INFORMATION IN THE APPROPIATE LOCATION IN BINARY.
;
WORK:
        OUT     SMSTP   ;STOP STEPPER MOTOR
        OUT     SMOFF   ;TURN OFF STEPPER MOTOR
        OUT     REOON   ;RESET END OF ORDER F/F
        OUT     REOOF
        OUT     AVCOF   ;TURN OFF ADVANCE COMPLETE
        OUT     EOOOF   ;TURN OFF END OF ORDER
        XRA     A       ;A=0
        STA     TOT1?   ;CLEAR FIRST TOTAL DISPLAYED
        STA     STOPM   ;RESET STOP IF SET
        STA     REOCM   ;CLEAR CUT MARK REQUIRED
        LXI     H,DSTOR ;RE-INITIALIZE STACK POINTER
        SPHL
        EI              ;ALLOW STOP SWITCH TO INTERRUPT
```

```
WORK1:
        LXI     D,SWSTM ;SWITCH STORAGE MEMORY
        LXI     H,IDVSW ;LOCATION OF INDIVIDUAL SWITCHES
        LDAX    D       ;OLD SWITCH STATE TO A
        MOV     C,A     ;SAVE OLD SWITCH STATES
CHECK:
        MOV     A,M     ;GET PRESENT SWITCH STATES
        MOV     B,A     ;SAVE SWITCH STATES
        XRA     C       ;STATES CHANGED?
        JZ      CHECK   ;NO, TRY AGAIN
        RRC
        RRC             ;TRIM CHANGE SETS CARRY
        JNC     PAKIN
        MVI     A,20    ;LOAD A FOR 20 MILLISECONDS
                        ;IF TRIM CHANGED
        JMP     DEBON
PAKIN:                  ;PACKER INPUT
        RRC             ;START ON SETS CARRY
        JNC     DEBON-2
        IN      PACK    ;PACKER CONNECTED
        ANA     A       ;SET FLAGS
        JM      DEBON-2
        CALL    DMS2    ;DEBOUNCE PACKER START INPUT 0.5 MS
        JMP     DEBON+3
        MVI     A,2     ;LOAD A FOR 2 MILLISECONDS
DEBON:                  ;DEBOUNCE
        CALL    DELAY   ;YES,DEBOUNCE SWITCH
        MOV     A,M     ;GET PRESENT SWITCH STATES
        XRA     B       ;HAVE ANY SWITCHES CHANGED?
        JNZ     CHECK   ;YES,TRY AGAIN
        MOV     A,B     ;NO, SWITCH STATES TO ACCUM
        STAX    D       ;SAVE SWITCH POSITION
        RRC             ;NO CUT MARK TO CARRY & A7
        INX     D       ;DE=NCTMS(NO CUT MARK STATUS)
        STAX    D       ;STORE NO CUT MARK STATUS
        RRC             ;TRIM TO CARRY
        CC      TRIM
        RRC             ;START TO CARRY
        JNC     WORK1
        RRC             ;MODE TO A0-A3
        ANI     0FH     ;SAVE MODE # & SET FLAGS
        EI
PROT1:  IF      PROT
        JZ      BEGIN   ;MODE 0?(     )
        DCR     A
        JZ      BEG1    ;MODE 1?(RUN)
        DCR     A
        JZ      MLEGT   ;MODE 2?(FEEDL)
        DCR     A
        JZ      MFACM   ;MODE 3?(FEEDA)
        DCR     A
        JZ      TOTAL   ;MODE 4?(TOTAL)
        DCR     A
        JZ      SENSE   ;MODE 5?(SENSE)
        DCR     A
        JZ      DIAG    ;MODE 6?(     )
        DCR     A
        JZ      WORK    ;MODE 7?(     )
        DCR     A
        JZ      WORK    ;MODE 8?(     )
        DCR     A
        JZ      TEST    ;MODE 9?(TEST)
        ENDIF
BEGIN:                  ;BEGINNING OF ORDER (CUT MARKS REQUIRED)
        MVI     A,80H
        STA     REQCM   ;SET CUT MARK REQUIRED
BEG1:                   ;BEGINNING OF ORDER (MISSING CUT MARKS ACCEPTABLE)
        PUSH    H
        LXI     H,WHY   ;LOWER BYTE ADDRESS OF LAST STOP
        MVI     A,WHY2+3 AND 0FFH       ;LOWER BYTE OF CUT MARK
                                        ;WRONG LOCATION ADDRESS
        CMP     M       ;LOWER ADDRESS BYTES EQUAL?
        MVI     M,0     ;CLEAR LOWER ADDRESS BYTE
        INX     H       ;HIGH BYTE ADDRESS OF LAST STOP
```

```
        JNZ     TEST4   ;JUMP IF LOWER ADDRESS BYTES NOT EQUAL
        MVI     A,(MHY2+3) SHR 8        ;HIGH BYTE OF CUT MARK
                                        ;WRONG LOCATION ADDRESS
        CMP     M       ;HIGH ADDRESS BYTES EQUAL?
TEST4:
        MVI     A,0
        MOV     M,A     ;CLEAR HIGH ADDRESS BYTE
        POP     H       ;RESTORE H
        JZ      TEST5   ;SAVE PREVIOUS PRINT COUNT
        STA     PRCT    ;SET PRINT COUNT TO ZERO
TEST5:
        STA     STOPM   ;RESET STOP IF SET
        OUT     SMON    ;TURN MOTOR ON
        MVI     A,18
        CALL    DELAY   ;KEEP MOTOR ON 18 MSEC
        IN      PREDO   ;NEW ROLL OF PAPER IF SET
        MOV     B,A     ;SAVE STATUS
        LDA     PWRON   ;ZERO IF JUST TURNED ON
        XRI     80H     ;COMPLEMENT MSB
        ORA     B       ;BIT 7 HI IF LONG FEED REQUIRED
        INX     D       ;D=LCNFD(LONG FEED)
        STAX    D
        DCX     H       ;M=MXPRS(MAX PRINTS SW)
        INX     D       ;D=MXPRM(MAX PRINTS MEM)
        MOV     A,M     ;MAX NUMBER PRINTS TO A
        STAX    D       ;STORE MAX PRINTS
        DCX     H       ;M=SPDSL(SPEED SELECT SW)
;
PSTAR:                  ;PRINT START
;
;INPUTS:DE=MXPPM(MAX PRINTS MEMORY ADDRESS)
;       HL=SPDSL(SPEED SELECT SWITCH ADDRESS)
;
        OUT     REDON   ;CLEAR END OF ORDER F/F
        MOV     A,M     ;SPEED SELECT IN
        ANI     0FH     ;MASK OFF UPPER 4 BITS
        MOV     B,A     ;SAVE SPEED SELECT
        CPI     9       ;TOP SPEED SELECTED?
        MVI     A,0     ;A7=0
        JNZ     CONT1   ;NO, THAN JUMP
        IN      PACK    ;BIT 7 LO IF PACKER USED
        ANI     80H     ;SET BIT 7 HI IF PACKER
                        ;NOT USED
CONT1:                  ;CONTINUE 1
        STA     CTELY   ;STORE CUT EARLY
        MOV     A,B     ;RESTORE SPEED SELECTED
        PUSH    H
        LXI     H,SPDTB ;SPEED TABLE
        ADD     L
        MOV     L,A     ;SPDTB+A TO L
        MOV     A,M     ;LOOK UP MAX SPEED
        STA     MXSPD   ;STORE MAX SPEED
        POP     H
        DCX     H       ;M=CTOUT(CUT OUT LENGTH SW)
        MOV     B,M     ;GET CUT OUT LENGTH
        CALL    BCDBI   ;CHANGE TO BINARY
        INX     D       ;D=CTOTM(CUT OUT LENGTH MEM)
        STAX    D       ;STORE BINARY CUT OUT LENGTH
        DCX     H       ;M=CTFD2(FEED AFTER CUT 2)
        MOV     A,M     ;MSD OF SWITCH
        ANI     0FH     ;MASK OFF UPPER 4 BITS
        DCX     H       ;M=CTFD1(FEED AFTER CUT 1)
        MOV     B,M     ;2 LSD OF SWITCH
        CALL    BCDBI+2 ;CHANGE TO BINARY
        MOV     C,A     ;SAVE 2 LSD
        LDAX    D       ;GET CUT OUT LENGTH
        ANA     A       ;SET FLAGS
        CNZ     CDADJ   ;MAKE ADJUSTMENT FOR CUT OUT
        MOV     A,C     ;GET ADJUSTED 2 LSD
        INX     D       ;D=ACTF1(AFTER CUT MARK FEED 1)
        STAX    D       ;2 LSD BINARY STORED
        INX     D       ;D=ACTF2(AFTER MARK FEED 2)
        MOV     A,B     ;MSD TO A
        STAX    D       ;MSD BINARY STORED
        DCX     H       ;M=PAFD2(PAPER FEED LENGTH 2)
```

```
        MOV     A,M     ;MSD OF SWITCH
        DCX     H       ;M=PAFD1(PAPER FEED LENGTH 1)
        MOV     B,M     ;2 LSD OF SWITCH
        CALL    BCD9I+2 ;CHANGE TO BINARY
        MOV     C,A     ;SAVE 2 LSD OF BINARY PAPER FEED REQUIRED
        LDA     CTOTM   ;CUT OUT LENGTH
        ANA     A       ;SET FLAGS
        CNZ     CGADJ+1 ;MAKE ADJUSTMENT FOR CUT OUT
        LDA     NCTMS   ;NO CUT MARK STATUS
        RLC             ;STATUS TO CARRY
        XCHG            ;M=ACTF2(AFTER CUT MARK FEED 2)
        CALL    MOTON   ;TURN MOTOR ON AND SET
                        ;MOTOR DIRECTION TO FORWARD
        JC      MOV1    ;JUMP IF NO CUT MARK
        OUT     REOOF   ;ENABLE END OF ORDER MARK
        LDA     LONFD   ;LONG FEED
        ANA     A       ;SET FLAGS
        JP      MINFD   ;IF NOT LONG FEED, JUMP
        LXI     B,1500
        JMP     MOV1+2
;
;THIS ROUTINE DETERMINES THE  MINIMUM FEED
;ALLOWED FOR A CUT MARK TO BE ACCEPTED.  IT SUBTRACTS THE
;FEED AFTER CUT MARK AND HALF THE "WINDOW" THE CUT MARK
;SHOULD BE PRESENT IN FROM THE TOTAL PRINT FEED LENGTH.

;
MINFD:                  ;MINIMUM FEED
        MOV     A,C     ;GET 2 LSD OF FEED LENGTH
        DCX     H       ;M=ACTF1(AFTER CUT MARK FEED LENGTH 1)
        SUB     M       ;2 LSD OF FEED BEFORE CUT MARK
        JNC     CONT2   ;IF NO CARRY SKIP NEXT 2
        DCR     B       ;SUBTRACT BORROW
CONT2:                  ;CONTINUE 2
        SUI     CWIND   ;2 LSD OF FEED BEFORE CUT
                        ;MARK WINDOW
        MOV     C,A     ;C=2 LSD OF FEED BEFORE CUT MARK WINDOW
        INX     H       ;M=ACTF2(AFTER CUT MARK FEED 2)
        MOV     A,B     ;MSD OF FEED LENGTH
        SBB     M       ;MSD OF FEED BEFORE CUT MARK WINDOW
        MOV     B,A     ;B=MSD OF FEED BEFORE CUT MARK WINDOW
;
;ROUTINE:MOVE
;
;THIS ROUTINE DETERMINES THE MOVEMENT OF THE STEPPER
;MOTOR.  IF CUT MARK IS USED, BC CONTAINS THE NUMBER OF STEPS
;TO BE MOVED(1)BEFORE A CUT MARK IS VALID (OMITTED ON FIRST
;PRINT IN A ROLL OF PAPER OR AFTER POWER IS TURNED ON),
;(2)WHILE A CUT MARK IS VALID,(3)BEFORE RAMP DOWN,
;(4)UNTIL THE END OF PRINT.  IF NO CUT MARK IS
;USED, BC CONTAINS THE NUMBER OF STEPS TO BE
;MOVED(1)UNTIL THE END OF PRINT,(2) BEFORE RAMP
;DOWN(CORRECTED AFTER RAMP UP IS COMPLETE),(3) UNTIL
;THE END OF PRINT.
;
;INPUTS:BC-SEE ABOVE
;
;OUTPUTS:DE-TOTAL STEPS MOVED
;
MOV1:
        OUT     RCSON   ;DISABLE CUT SIGNAL IN
        OUT     RRSON   ;ENABLE REMAKE-REJECT SENSOR
        XRA     A       ;A=0
        MOV     D,A     ;D=0
        MOV     E,A     ;E=0
        INX     H       ;M=MSPDS(MAX SPEED STATUS)
        MOV     M,A     ;CLEAR MAX SPEED STATUS
        INX     H
        INX     H       ;M=RSTPN(RAMP STEP NUMBER)
        MOV     M,A     ;RAMP STEP #=0
        INX     H       ;M=URAPS(UP RAMP STATUS)
        MVI     M,80H   ;UP RAMP STATUS SET
        INX     H       ;M=RRPDN(READY RAMP DOWN)
        MOV     M,D     ;CLEAR READY TO RAMP DN
        INX     H       ;M=ACTM(AFTER CUT MARK)
```

```
        MOV     M,0         ;CLEAR AFTER CUT MARK
        INX     H           ;M=CTVAL(CUT MARK VALID)
        LDA     LONFD       ;BIT 7 HI IF LONG FEED
        MOV     M,A         ;CUT MARK VALID IF LONG
                            ;FEED, OTHERWISE NOT VALID
CLK1:
        CALL    CLK         ;CHECK STEP & CUT SIGNAL
        JP      STEP        ;IF NO CUT SIGNAL JUMP
        OUT     RCSON       ;RESET CUT SIGNAL F/F ON
        STA     CTMNW       ;STORE CUT MARK THIS PRINT
        CALL    CMARK       ;CHANGE APPROPIATE FLAGS
        LHLD    ACTFI       ;FEED AFTER CUT MARK
        MOV     B,H         ;MOVE TO BC
        MOV     C,L
STEP:
        CALL    SMSPD       ;YES,CHECK SPEED
        INX     D           ;MOTOR STEP TOTAL
        DCR     C           ;DECREMENT BC
        JZ      BC0?
        MVI     A,0FFH
        CMP     C           ;C=FF?
        JNZ     CLK1
        DCR     B
        JMP     CLK1
BC0?:                       ;BC=0?
        XRA     A           ;A=0
        CMP     B
        JNZ     CLK1        ;JUMP IF BC=/0
;
;ROUTINE:TST
;
;THIS ROUTINE DETERMINES IF A CUT MARK IS ACCEPTABLE
;AND ALSO DETERMINES THE FEED LENGTH IF THERE IS NO
;CUT MARK.  IF THE CUT MARK OR ITS SUBSTITION HAS BEEN
;SENSED, AN INDICATION IS PROVIDED.
;
TEST1:
        LDA     NCTMS       ;NC CUT MARK STATUS
        ANA     A           ;SET FLAGS
        MVI     A,0         ;ZERO A REG, NO FLAG CHANGE
        LXI     H,RPPDN     ;READY TO RAMP DOWN
        JM      RAMPD       ;JUMP IF NO CUT MARK STATUS
        CMP     M           ;READY TO RAMP DOWN
        JZ      ENDP?       ;NO, THEN CHECK END OF PRINT
RAMPD:                      ;RAMP DOWN
        MOV     M,A         ;CLEAR READY TO RAMP DOWN
        DCX     H
        DCX     H           ;M=RSTPN(RAMP STEP NUMBER)
        MOV     B,A         ;B=0
        MOV     C,M         ;C=NUMBER STEPS TIL END OF PRINT
        CMP     C           ;C=0
        JZ      ENDPR       ;YES,END  OF PRINT
        DCX     H
        DCX     H           ;M=MSPDS(MAX SPEED STATUS)
        MOV     M,A         ;CLEAR MAX SPEED
        LDA     CTELY       ;CUT EARLY
        ANA     A           ;SET FLAGS
        JP      CLK1        ;JUMP IF NOT EARLY CUT
        OUT     CTON        ;TURN ON CUT SOLENOID
        JMP     CLK1
ENDP?:                      ;CHECK FOR END OF PRINT
        INX     H           ;M=ACTM(AFTER CUT MARK)
        CMP     M
        JNZ     ENDPR       ;JUMP IF AFTER CUT MARK
        INX     H           ;M=CTVAL(CUT MARK VALID)
        CMP     M           ;LOOKING FOR CUT MARK?
        JNZ     NOCTM       ;YES, GO TO NO CUT MARK SENSED
        OUT     RCSOF       ;ENABLE CUT SIGNAL
        LXI     B,2*CWIND           ;BC=CUT MARK WINDOW
        MVI     A,80H
        MOV     M,A         ;SET CUT VALID
        JMP     CLK1
NOCTM:                      ;NO CUT MARK SENSED
        MOV     M,A         ;CLEAR CUT MARK VALID
        OUT     RCSON       ;DISABLE CUT SIGNAL
```

```
        STA     CTMNW   ;CLEAR CUT MARK THIS PRINT
        DCX     H       ;M=ACTM(AFTER CUT MARK)
        LDA     LONFD   ;LONG FEED STATUS
        ANA     A       ;SET FLAGS
        JP      WHY1+6
WHY1:
        CALL    STOP    ;NO CUT MARK YET SO STOP
        JMP     WORK
        INX     H
        INX     H       ;M=MISCM(CUT MARK YET TO MISS)
        DCR     M
        LDA     REQCM   ;BIT 7 HI IF CUT MARK REQUIRED
        ORA     M
        JP      WHY2+6
WHY2:
        CALL    STOP    ;STOP IF TOO MANY MISSING MARKS
        JMP     WORK
        INX     H       ;M=PFD1(PAPER FEED 1)
        MOV     A,M
        SUB     E
        MOV     C,A
        INX     H       ;M=PFD2(PAPER FEED 2)
        MOV     A,M
        SBB     D
        MOV     B,A     ;BC=STEPS TO END OF PRINT
        LDA     RSTPN   ;GET NUMBER OF RAMP DOWN STEPS
        CMA
        MOV     L,A
        CALL    RPDNA   ;CORRECT FOR RAMP DOWN STEPS
        MVI     A,80H   ;SET BIT 7
        CALL    CMARK   ;CHANGE APPROPIATE FLAGS
        JMP     CLK1
;
;THIS ROUTINE SETS APPROPIATE FLAGS AFTER A CUT
;MARK HAS BEEN SENSED OR AFTER A MISSING CUT MARK
;HAS BEEN ACCEPTED.
;
;INPUTS:BIT 7 OF A REG IS SET HI
;
CMARK:                  ;CUT MARK
;
        LXI     H,RRPDN ;READY TO RAMP DOWN
        MOV     M,A     ;STORE READY TO RAMP DN
        INX     H       ;M=ACTM(AFTER CUT MARK)
        MOV     M,A     ;STORE AFTER CUT MARK
        INX     H       ;M=CTVAL(CUT MARK VALID)
        XRA     A       ;A=0
        MOV     M,A     ;CLEAR CUT MARK  VALID
        RET
;
;ROUTINE:SETUP
;
;THIS ROUTINE CONTAINS THE NECESSARY FUNCTIONS FOR
;INITIAL SET UP CALIBRATION OF THE PAPER CUTTER.THESE
;FUNCTIONS ARE:
;       MLEGT-MEASURES THE LENGTH OF THE PRINT FROM CUT
;MARK TO CUT MARK.
;       MFACM-MEASURES THE DISTANCE THE PAPER MOVES AFTER
;THE CUTMARK IS SENSED UNTIL IT IS CUT.  IT REQUIRES THE
;OPERATOR TO POSITION THE LEADING EDGE OF THE PRINT TO A
;PREDETERMINED POINT.
;
MLEGT:                  ;MEASURE LENGTH
        CALL    MOTON
        LXI     D,0     ;RESET FEED LENGTH
CLK1C:                  ;CLOCK CALL 1
        CALL    CLK     ;TAKE STEP
        JM      CLK2C-3 ;IF CUT MARK,JUMP
        CALL    CT999   ;INCREMENT FEED LENGTH DE
        JZ      FEEDL   ;FEED TOO LONG
        JMP     CLK1C
        LXI     D,0     ;RESET FEED LENGTH
CLK2C:                  ;CLOCK CALL 2
        CALL    CLK     ;TAKE STEP
        JM      FEED1   ;IF CUT MARK SENSED,JUMP
```

```
        CALL    CT999   ;INCREMENT FEED LENGTH DE
        JZ      FEEDL   ;FEED TOO LONG
        JMP     CLK2C   ;TAKE A STEP
FEED1:                  ;MEASURED FEED LENGTH
        OUT     SMSTP   ;STOP STEPPER MOTOR
        MOV     A,E     ;SET UP FOR DISPLAY
        CALL    NMOT4
        XCHG            ;MOVE MEASURED FEED LENGTH TO HL
        SHLD    MFDL    ;SAVE MEASURED FEED LENGTH
        JMP     FEEDL
MFACM:                  ;MEASURE FEED AFTER CUT MARK
        CALL    MOTON
        IN      CCREC   ;GET KNIFE TO PRINT EDGE CORRECTION
        ANI     01FH    ;MASK OUT UPPER 3 BITS
        MVI     B,PEDGE ;GET PRINT EDGE TO KNIFE LENGTH
        ADD     B       ;ADD CORRECTION
        MOV     B,A     ;SAVE LENGTH
CLK3C:                  ;CLOCK CALL 3
        CALL    CLK     ;TAKE STEP
        DCR     B       ;B=DISTANCE TO KNIFE
        JM      CLK4C-6 ;IF EDGE AT KNIFE JUMP
        JMP     CLK3C   ;IF NOT, TAKE A STEP
        LXI     D,0
        CALL    CT999   ;INCREMENT DE
        JZ      FEEDL   ;FEED TOO LONG
CLK4C:                  ;CLOCK CALL 4
        CALL    CLK     ;TAKE STEP
        JM      FEED2   ;IF CUT MARK JUMP
        JMP     CLK4C-6
FEED2:
        OUT     SMSTP   ;STOP STEPPER MOTOR
        LHLD    MFDL    ;MEASURED FEED LENGTH
        MOV     A,D     ;BCD FEED BEFORE CUT MARK
        MOV     B,E
        CALL    BCDBI+2 ;CONVERT TO BINARY
        MOV     D,B     ;BINARY FEED BEFORE CUT
        MOV     E,A
        MOV     A,H     ;BCD FEED LENGTH
        MOV     B,L
        CALL    BCDBI+2 ;CONVERT TO BINARY
        SUB     E       ;DETERMINE 2 LSD
        MOV     E,A     ;SAVE 2 LSD
        MOV     A,B     ;MSD OF BINARY FEED LENGTH
        SBB     D       ;DETERMINE MSD
        MOV     D,A
        CALL    BIBCD   ;CONVER TO BCD
        MOV     E,A     ;SAVE 2 LSD
        CALL    NMOT4   ;DISPLAY MEASURED FEED AFTER CUT
                        ;MARK LENGTH
        XCHG
        SHLD    MFDAC   ;SAVE MEASURED FEED AFTER
                        ;CUT MARK LENGTH

FEEDL:                  ;FEED LONG
        XRA     A       ;A=0
        STA     PWRON   ;CLEAR  PWRON
        JMP     WORK
MOTON:                  ;MOTOR ON
        MVI     A,14H   ;SLOW SPEED SELECT
        OUT     SPDGN   ;SLOW SPEED OUT
        OUT     SMCW    ;STEPPER MTR CW(FORWARD)
        OUT     SMON    ;TURN ON STEPPER MTR
        OUT     SMRUN   ;RUN STEPPER MOTOR
        OUT     RCKON   ;RESET STEP COMP F/F
        OUT     RCKOF
        OUT     RCSON   ;CLEAR CUT SIGNAL F/F
        OUT     RCSOF
        RET
;
;THIS CALL LOOKS FOR THE STEPPER MOTOR TO COMPLETE
;ONE STEP.  IF THE STEP HAS NOT BEEN COMPLETED WITHIN
;APPROXIMATELY 5 MILLISECONDS, CONTROL WILL BE
;RETURNED TO "WORK" WHERE THE STACK WILL BE INITILIZED
;TO REMOVE THE RETURN ADDRESS & DATA SAVED ON THE
;STACK.  UPON STEP COMPLETION, THE MINUS FLAG IS SET
```

```
;IF A CUT MARK HAS BEEN SENSED.
;
CLK:                        ;STEPPER MOTOR CLOCK
        PUSH    B
        MVI     B,0         ;TIME OUT COUNTER
        INR     B           ;INCREMENT TIMER
        JNZ     WHY3+6
WHY3:
        CALL    STOP
        JMP     WORK
        IN      STEPC       ;STEP COMPLETE
        ANA     A           ;SET FLAGS
        JP      CLK+3       ;NO, TRY AGAIN
        POP     B
        OUT     RCKON       ;RESET STEP COMP F/F
        OUT     RCKOF
        IN      CTSIG       ;GET CUT SIGNAL
        ANA     A           ;SET FLAGS
        RP                  ;IF NO SIGNAL, RETURN
        OUT     RCSON       ;CLEAR CUT SIGNAL F/F
        OUT     RCSOF
        RET
;
;THIS CALL INCREMENTS THE BCD CONTENTS OF REGISTER
;PAIR DE BY ONE COUNT.  IF THE COUNT IS LESS THAN
;1000, ZERO IS NOT SET ON RETURN.
;
CT999:                      ;COUNT DE TO 999
        ANA     A           ;CLEAR CARRY
        MOV     A,E         ;GET 2 LSD
        INR     A           ;INCREMENT 2 LSD
        DAA                 ;MAKE SURE THEY ARE BCD
        MOV     E,A         ;SAVE 2 LSD
        RNC                 ;IF NO CARRY RETURN
        MOV     A,D         ;GET MSD
        INR     A           ;INCREMENT MSD
        MOV     D,A         ;SAVE MSD
        CPI     0AH         ;ZERO FLAG SET IF DE=1000
        RET
;
;ROUTINE:TOTA
;
;THIS ROUTINE DISPLAYS THE TOTALS OF PRINTS CUT
;& ORDERS COMPLETED SINCE POWER ON. THE FOLLOWING
;SEQUENCE IS USED TO DISPLAY THE DATA:(1) 2 MSD OF
;PRINTS CUT,(2) 4 LSD OF PRINTS CUT,(3) 2 MSD OF
;ORDERS CUT,(4) 4 LSD OF ORDERS CUT.  AFTER (4) HAS
;BEEN DISPLAYED, THE SEQUENCE STARTS OVER AT (1).
;
;DESTROYS:A,B
;
TOTAL:
        LDA     TOT1?       ;BIT 7 HI IF THIS IS
                            ;FIRST TOTAL DISPLAYED
        ANA     A           ;SET FLAGS
        JM      TOT2        ;JUMP IF NOT FIRST DISP
        MVI     B,4         ;SET NUMBER OF PASSES
        LXI     H,PRCT1+2       ;2 MSD OF PRINTS CUT
DIG2:                       ;DISPLAY 2 DIGITS
        MOV     A,M         ;GET 2 DIGITS
        CALL    NMOT2       ;DISPLAY 2 DIGITS
        MVI     A,80H
        STA     TOT1?       ;SET FIRST TOTAL DISPLAYED
TOT3:
        STA     DIG4S       ;STORE DISPLAY 4 DIGITS STATUS
        PUSH    H           ;SAVE LOCATION OF LAST
                            ;DIGITS DISPLAYED
        DCR     B           ;DECREMENT PASS COUNTER
        LXI     D,SWSTM     ;SWITCH STATUS MEMORY
        PUSH    B           ;SAVE PASS COUNTER
        JNZ     WORK1       ;JUMP IF NOT LAST PASS
        JMP     WORK        ;CLEAR TOT1? THIS TIME.
TOT2:
        POP     B           ;GET PASS COUNTER
        POP     H           ;GET LOCATION OF LAST DIGITS DISPLAYED
```

```
        DCX     H           ;LOCATION OF NEXT 2 DIGITS
                            ;TO BE DISPLAYED
        LDA     DIGAS       ;BIT 7 HI IF 4 DIGITS
        ANA     A           ;SET FLAGS
        JP      DIG2        ;JUMP IF 2 DIGITS TO BE DISPLAYED
        MOV     D,M         ;2 MSD TO BE DISPLAYED TO D
        DCX     H
        MOV     A,M         ;2 LSD TO A
        STC                 ;SHOWING LEADING ZEROS
        CALL    NMOT4       ;DISPLAY 4 DIGITS
        XRA     A           ;A=0
        JMP     TCT3
;
;ROUTINE:SENS
;
;THIS ROUTINE ALLOWS THE CUT MARK TO BE
;MOVED BACK AND FORTH IN FRONT OF THE SENSOR
;SO THAT IT MAY BE PROPERLY ADJUSTED.
;
SENSE:
        CALL    MOTON       ;TURN MOTOR ON
        LXI     D,400       ;START COUNT AT 400
NMARK:                      ;CHECK FOR MARK
        CALL    CT999
        JZ      FEEDL       ;FEED TOO LONG
        CALL    CLK
        JP      NMARK       ;IF NO CUT MARK JUMP
        MVI     B,50        ;PRELOAD STEP COUNT
FWD:                        ;FORWARD DIRECTION
        CALL    CLKS
        JM      FEEDL       ;GO BACK IF STOP SW SELECTED
        OUT     SMCCW       ;GO BACKWARDS
REV:                        ;REVERSE DIRECTION
        CALL    CLKS
        JM      FEEDL       ;GO BACK IF STOP SW SELECTED
        OUT     SMCW        ;GO TOWARDS KNIFE
        JMP     FWD
CLKS:                       ;SENSOR CLOCK
        CALL    CLK
        DCR     B           ;DECREMENT STEP COUNT
        JNZ     CLKS        ;IF STEP COUNT =/ 0 TAKE
                            ;ANOTHER STEP
        MVI     B,100       ;PRELOAD STEP COUNT
        LDA     STOPM       ;BIT 7 HI IF STOP SWITCH
                            ;ENERGIZED
        ANA     A           ;SET FLAGS
        RP                  ;GO BACK IF NOT READY TO STOP
        MVI     A,0         ;A=0 & FLAGS NOT CHANGED
        STA     STOPM       ;CLEAR STOP
        RET
;
;ROUTINE:STOP
;
;THIS ROUTINE WILL DISPLAY THE NUMBER OF PRINTS
;CUT IN THE PRESENT ORDER IF THE CUTTER HAS
;STOPPED.  IT WILL STORE THE ADDRESS THAT CAUSED
;IT TO STOP.
;
STOP:
        XRA     A           ;A=0
        STA     PWRON       ;ALLOW LONG FEED NEXT TIME
        STA     CTMNW       ;NO CUT MARK ON LAST PRINT
STOP1:
        LDA     PRCT        ;NUMBER OF PRINTS CUT
                            ;THIS ORDER
        ANA     A           ;CLEAR CARRY FOR LEADING
                            ;ZERO SUPPRESSION
        CALL    NMOT2       ;DISPLAY PRINTS CUT
        POP     H           ;WHAT ADDRESS CAUSED STOP
        SHLD    WHY         ;SAVE FOR FUTURE CHECK
        PUSH    H           ;PUT BACK FOR RETURN
        RET
;
;ROUTINE:ENDP
;
```

```
;THIS ROUTINE PERFORMS THE NECESSARY FUNCTIONS THAT TAKE
;PLACE AT THE END OF A PRINT.
;
ENDPR:                          ;END OF PRINT
        OUT     RRSOF           ;DISABLE REMAKE-REJECT SENSOR
        OUT     AVCON           ;TELL PACKER READY TO CUT
        OUT     SMSTP           ;STEPPER MOTOR STOP
        IN      PREOO           ;PRINT END OF ORDER
        ANA     A
        MOV     B,A             ;SAVE END OF ORDER STATUS
        JP      NEOO
        OUT     EOOON           ;END OF ORDER TO PACKER
NEOO:                           ;NO END OF ORDER
        IN      PACK            ;PACKER STATUS
        ANA     A               ;SET FLAGS
        JM      NPAC1
        LXI     H,0
NIFEN:                          ;KNIFE ENABLE
        LDA     STOPM           ;OPERATOR TIRED OF WAITING?
        CPI     80H
        JNZ     WHY6+6
WHY6:   CALL    STOP1
        JMP     WORK
        INR     L               ;DELAYS UNTIL HL OVERFLOWS
        JNZ     NIFIN
        INR     H
        JNZ     NIFIN
        OUT     SMOFF           ;TURN OFF STEPPER MTR IF
                                ;TOO LONG A WAIT
NIFIN:                          ;INPUT KNIFE ENABLE
        IN      KNIFE           ;PACKER KNIFE ENABLE
        ANA     A               ;SET FLAGS
        JM      NIFEN           ;SIGNAL HERE?
        CALL    DMS2            ;YES, DEBOUNCE 0.5 MSEC.
        IN      KNIFE
        ANA     A
        JM      NIFEN
        OUT     SMON            ;TURN MOTOR ON FOR CUT
NPAC1:                          ;NO PACKER
        OUT     AVCOF           ;TURN OFF ADVANCE COMPLETE
        PUSH    PSW
        LDA     CTFLY           ;CUT EARLY
        ANA     A               ;SET FLAGS
        OUT     PCTON           ;PRINT CUT (ON) TO PACKER
        CP      TRIM            ;IF NOT EARLY CUT
        CM      TRIM1           ;IF EARLY CUT, TAKE LESS TIME
        POP     PSW
        LXI     H,PRCT          ;PRINTS CUT THIS ORDER
        MOV     A,M             ;GET PRINTS CUT THIS ORDER
        INR     A               ;NEW PRINT COUNT
        DAA
        MOV     M,A             ;SAVE NEW COUNT
        MOV     C,A             ;PRINTS THIS ORDER
        IN      PACK            ;PACKER CONNECTED?
        CMA
        ORA     B               ;COMBINE STATUS CONDITIONS
        JP      DSPRT+3         ;JUMP IF NEITHER
        MOV     A,C             ;GET COUNT BACK FOR OUTPUT
DSPRT:                          ;DISPLAY PRINT COUNT
        CALL    NMOT2           ;SHOW NEW COUNT
        LXI     H,MXPRM         ;M=MX NUMBER OF PRINTS THIS ORDER
        MOV     A,M
        CPI     0               ;CONTINOUS CUT IF 0
        JNZ     MXPR?
        MOV     C,A
        INR     A               ;MAKE A>C
MXPR?:                          ;MAXIMUM NUMBER OF PRINTS
        SUB     C               ;A=0 IF MAX COUNT
        MOV     C,A             ;SAVE MAX COUNT STATUS
        LXI     H,ORDCT-1
        MOV     A,B             ;END OF ORDER STATUS
        XRI     80H             ;COMPLEMENT MSB
        PUSH    D               ;SAVE FEED LENGTH
        CALL    BCDIN+1         ;INCREMENT END OF ORDER
                                ;TOTAL IF APPROPIATE
```

```
        CALL    BCDIN   ;INCREMENT TOTAL PRINT COUNT
        POP     D       ;GET FEED LENGTH
        INX     H       ;M=CTMNW(CUT MARK NEW)
        MOV     A,M     ;CUT MARK THIS CUT
        ANA     A       ;SET FLAGS
        INX     H       ;M=CTMOD(CUT MARK OLD)
        JP      CTDLY   ;IF NO CUT MARK JUMP
        CMP     M
        JNZ     CTDLY   ;JUMP IF LAST PRINT NO CUT MARK
        MVI     A,MXMCM ;MAX MISSING CUT MARKS
        STA     MISCM   ;STORE ABOVE
        XCHG
        SHLD    PFD1    ;STORE FEED LENGTH OF LAST PRINT
        JMP     CTDLY+1
CTDLY:                  ;CUT DELAY FOR KNIFE RETURN
        MOV     M,A     ;CUT MARK STATUS FOR NEXT PRINT
        MVI     A,CUTTM ;CUT TIME AFTER SOLENOID IS
                        ;ENERGIZED
        CALL    DELAY   ;WAIT FOR KNIFE TO COMPLETE CYCLE
        OUT     PCTOF   ;PRINT CUT(OFF) TO PACKER
        LDA     CTOTM   ;CUT OUT LENGTH
        ANA     A       ;SET FLAGS
        JZ      TEST2   ;IF NO CUT OUT, JUMP
        OUT     SMRUN
        MOV     D,A     ;SAVE CUT OUT LENGTH
CLK2:
        CALL    CLK     ;CHECK STEP COMPLETE
        DCR     D       ;DECREASE CUT OUT LENGTH
        JNZ     CLK2    ;TO MOVE & IF NOT ZERO JUMP
        OUT     SMSTP
        CALL    TRIM
        MVI     A,CUTTM
        CALL    DELAY   ;WAIT FOR KNIFE TO COMPLETE CYCLE
TEST2:
        STA     LONFD   ;RESET LONG FEED
EOO?:                   ;END OF ORDER?
        MVI     A,30H
        STA     PWRON   ;SET FIRST PRINT CUT STATUS
        CMP     B       ;END OF ORDER?
        JZ      HOLD    ;YES, GO WAIT FOR NEXT ORDER
        MOV     A,C     ;MAX COUNT STATUS
        ANA     A       ;SET FLAGS
        JNZ     WHYS+6
WHYS:
        CALL    STOP1
        JMP     HOLD
        LXI     H,SPDSL ;SPEED SELECT
        LXI     D,MXPRM ;MAX PRINTS MEMORY
        JMP     PSTAR   ;START NEXT PRINT
HOLD:
        MVI     A,20
        CALL    DELAY
        JMP     WORK
;
;ROUTINE:BCDB
;
;THIS PROGRAM WILL TAKE 0-999 COMPLEMENTED DECIMAL AND
;CONVERT IT TO BINARY(0-3E7H). REGISTER A CONTAINS MSD
;AND REGISTER B CONTAINS THE TWO LSD.
;
;D1=MSD      D2=2MSD      D3=LSD
;
;FUNCTION:BCDBI
;
;INPUTS:A,B CONTAIN BCD DATA
;
;OUTPUTS:A=2LSD AND B=MSD IN BINARY
;
;DESTROYS:A,B,C,FLAGS
;
BCDBI:
        MVI     A,0H    ;START FOR TWO DIGITS
        ANI     0FH     ;START FOR THREE DIGITS
                        ;MASK OFF UPPER 4 BITS
        PUSH    D
```

```
        PUSH    H
        MOV     C,A         ;SAVE D1
        RLC                 ;A=2 D1
        RLC                 ;A=4 D1
        ADD     C           ;A=5 D1
        RLC                 ;A=10 D1
        MOV     L,A         ;STORE 10 D1
        MVI     H,0         ;H=0
        MOV     A,B         ;GET D2 AND D3
        ANI     0F0H        ;SAVE D2
        RRC
        RRC
        RRC
        RRC
        ADD     L           ;A=10 D1 + D2
        MOV     L,A         ;L=10 D1 + D2
        MOV     E,L         ;E=10 D1 + D2
        MOV     D,H         ;D=0
        DAD     H           ;HL=2(10 D1 + D2)
        DAD     H           ;HL=4(10 D1 + D2)
        DAD     D           ;HL=5(10 D1 + D2)
        DAD     H           ;HL=10(10 D1 + D2)
        MOV     A,B         ;GET D2 AND D3
        ANI     0FH         ;SAVE D3
        MOV     E,A         ;DE=D3
        DAD     D           ;HL=100 D1 + 10 D2 + D3
        MOV     B,H
        MOV     A,L
        POP     H
        POP     D
        RET
;
;ROUTINE:BCDI
;
;THIS ROUTINE INCREMENTS A SIX PLACE DECIMAL
;NUMBER IN MEMORY.  INCREMENTS OCCUR AT CONDITIONAL ENTRY
;POINT ONLY IF A=0.
;
;INPUTS:HL-POINTS TO TWO LSD LESS 1 LOCATION
;
;DESTROYS:A,D,H,L
;
BCDIN:                      ;BCD  INCREMENT
        XRA     A           ;A=0
        MVI     D,4         ;CONDITIONAL ENTRY POINT
        DCR     D
        RZ                  ;RETURN IF 4TH PASS
        INX     H           ;LOCATION OF NUMBER TO BE
                            ;INCREMENTED
        ANA     A           ;SET FLAGS
        JNZ     BCDIN+3     ;DON'T INCREMENT IF A =/ 0
        MOV     A,M         ;GET 2 DIGITS
        INR     A
        DAA
        MOV     M,A         ;RETURN 2 DIGITS
        JMP     BCDIN+3     ;CONTINUE
;
;ROUTINE:BIBC
;
;THIS ROUTINE CONVERTS A BINARY NUMBER NOT
;GREATER THAN 3CEH TO BCD FORM.
;
;INPUTS:DE-CONTAINS BINARY VALUE(0-3CEH) TO BE
;CONVERTED
;
;OUTPUTS:D-CONTAINS MSD BCD IN 4 LOWER BITS
;        A-CONTAINS 2 LSD BCD
;
;DESTROYS:B,C,D,E,H,L
;
;FUNCTION:BIBCD
;
BIBCD:
        LXI     B,100
        CALL    DIGIT
```

```
        PUSH    H           ;SAVE MSD BCD
        LXI     B,10
        CALL    DIGIT
        MOV     A,H
        RRC
        RRC
        RRC
        RRC
        MOV     L,A         ;SAVE DIGIT
        LXI     B,1
        CALL    DIGIT
        MOV     A,H         ;GET LSD BCD
        ADD     L           ;MERGE 2 LSD BCD
        POP     D           ;RETURN MSD BCD
        RET
;
;THIS ROUTINE SUBTRACTS THE CONTENTS OF REGISTER
;PAIR BC FROM THE CONTENTS OF REGISTER PAIR
;DE.  EACH TIME THE REMAINDER IS GREATER THAN OR EQUAL
;TO ZERO, THE H REGISTER(BCD DIGIT) IS INCREMENTED.
;WHEN THE REMAINDER IS LESS THAN ZERO, AN ADJUSTMENT
;IS MADE SO THAT A POSITIVE NUMBER REMAINS.
;
DIGIT:
        MVI     H,0         ;INITIALIZE DIGIT
DI0:
        MOV     A,E         ;SUBTRACT LOOP
        SUB     C
        MOV     E,A
        MOV     A,D
        SBB     B
        MOV     D,A
        JM      DI1
        INR     H           ;INCREMENT BCD DIGIT
        JMP     DI0
DI1:                        ;ADJUST FOR NEXT SEQUENCE
        MOV     A,E
        ADD     C
        MOV     E,A
        MOV     A,D
        ADC     B
        MOV     D,A
        RET
;
;ROUTINE:CORD
;
;THIS ROUTINE SUBTRACTS EITHER THE FULL VALUE OR HALF
;VALUE IN REG A FROM THE VALUE IN REG BC.  IT IS
;USED TO ADJUST THE TOTAL FEED LENGTH AND THE
;FEED AFTER CUT MARK LENGTH WHEN THERE IS A CUT OUT.
;
;INPUTS:A,B,C
;
;OUTPUTS:B,C
;
CCADJ:                      ;CUT OUT ADJUSTMENT
        RAR                 ;ENTRY POINT FOR HALF VALUE
        PUSH    D           ;ENTRY POINT FOR FULL VALUE
        MOV     D,A         ;SAVE VALUE
        MOV     A,C         ;GET 2 LSD
        SUB     C           ;SUBTRACT VALUE
        MOV     C,A         ;SAVE 2 LSD
        MOV     A,B         ;GET MSD
        SBI     0           ;SUBTRACT BORROW IF ANY
        MOV     B,A         ;SAVE MSD
        POP     D
        RET
;
;ROUTINE:DELAY
;
;THIS ROUTINE GENERATES DELAYS IN 1 MILLISECOND
;INCREMENTS.  ACCUMULATOR CONTAINS THE (HEXADECIMAL)
;LENGTH OF THE DELAY IN MILLISECONDS.
;
;INPUTS:A
```

```
;
DELAY:
        CALL    DMSEC
        DCR     A
        JNZ     DELAY   ;TRY TIL TIME IS UP
        RET
;
;ROUTINE:DMSEC
;
;THIS ROUTINE GENERATES A 1.0 OR 0.5 MILLISECOND
;DELAY AND RETURNS AFTER THE DELAY IS COMPLETE
;
DMSEC:                  ;DELAY 1 MILLISECOND
        PUSH    PSW
        MVI     A,124   ;A=124
        INR     A
        JNZ     DMSEC+3
        POP     PSW
        RET
DMS2:                   ;DELAY 0.5 MSEC.
        MVI     A,190
        INR     A
        JNZ     DMS2+2
        RET
;
;ROUTINE:DISP
;
;THIS ROUTINE ALLOWS EITHER 2 OR 4 DIGITS TO BE
;DISPLAYED ON THE DIGITAL READOUT.  IF CARRY IS
;SET ON ENTRY,LEADING ZEROS WILL NOT BE SUPPRESSED.
;IF CARRY IS NOT SET ON ENTRY, LEADING ZEROS WILL BE
;SUPPRESSED.  REGISTER E IS NON ZERO IF ZEROS ARE NOT
;SUPPRESSED.  REGISTER H CONTAINS A LOW BIT WHICH
;DETERMINES WHICH DIGIT IS OUTPUTTED TO(BIT 4
;SELECTS MSD AND BIT 7 SELECTS THE LSD).
;
;INPUTS: A - 2 LSD
;        D - 2 MSD
;        CARRY - HI IF NO ZERO SUPPRESSION
;
;DESTOYS: CARRY
;
NMOT2:                  ;ENTRY POINT FOR 2 DIGIT DISPLAY
                        ;A HAS THE 2 DIGITS
        PUSH    D
        MVI     D,0     ;2 MOST SIGNIFICANT DIGITS = 0
        JMP     NMOT4+1
NMOT4:                  ;ENTRY POINT FOR 4 DIGIT DISPLAY
                        ;D HAS UPPER 2,A HAS LOWER 2
        PUSH    D
        PUSH    H
        PUSH    B
        LXI     H,0FFFFH        ;SELECT FOR MSD

        MVI     E,0
        MOV     B,A     ;SAVE 2 LSD
        JNC     DIS2D   ;JUMP IF LEADING ZEROS SUPPRESSED
        MOV     E,H     ;SHOW LEADING ZEROS
DIS2D:                  ;DISPLAY 2 DIGITS
        MOV     A,D
        RRC
        RRC
        RRC
        RRC             ;GET UPPER 4 BITS TO LOWER 4 BITS
        ANI     0FH     ;MASK OUT UPPER 4 BITS
        JNZ     ZERO2   ;IF DIGIT (LOWER 4 BITS) IS
                        ;NOT EQUAL TO ZERO, JUMP
        CMP     E
        JNZ     ZERO2+1 ;IF ALL PREVIOUS 0, BLANK
        MVI     A,0FH   ;BLANK DIGIT
        JMP     ZERO2+1 ;SKIP NEXT INSTRUCTION
ZERO2:
        MOV     E,A     ;NON ZERO DIGIT
```

```
        CALL    DISOT   ;DISPLAY OUTPUT
        MOV     A,D
        ANI     0FH     ;GET DIGIT 2
        JNZ     ZERO3   ;IF DIGIT(LOWER 4 BITS) IS
                        ;NOT EQUAL TO ZERO, JUMP
        CMP     E
        JNZ     ZERO3+1 ;IF ALL PREVIOUS 0,BLANK
        ADD     H       ;ZERO UPPER 4 BITS IF DIGIT
                        ;SELECT IS FOR LSD
        MOV     A,D     ;SET A=X0H
        JP      ZERO3+1 ;IF LSD, DISPLAY 0
        MVI     A,0FH   ;BLANK DIGIT
        JMP     ZERO3+1
ZERO3:
        MOV     E,A     ;NON ZERO DIGIT TO E
        CALL    DISOT   ;DISPLAY OUTPUT
        MOV     A,H     ;GET DIGIT SELECT
        ANA     A       ;SET FLAGS
        MOV     D,B     ;2 LSD TO D
        JPO     DIS20   ;JUMP IF H HAS A LOW BIT
                        ;TO SELECT DIGIT
        MOV     A,B     ;RESTORE A FROM BEGINNING
                        ;VALUE
        POP     B
        POP     H
        POP     D
        RET
DISOT:                  ;DISPLAY OUTPUT
        ORI     0F0H    ;SET UPPER 4 BITS HI
        MOV     C,A
        ANA     H       ;MOVE DIGIT SELECT TO A UPPER 4 BITS
        OUT     DISPY   ;OUTPUT DIGIT
        MOV     A,C     ;RETURN DIGIT VALUE TO A
        OUT     DISPY   ;STORE DIGIT
        DAD     H       ;SHIFT DIGIT SELECT TO NEXT DIGIT
        RET
;
;ROUTINE:SMS
;
;STEPPER MOTOR SPEED
;
;THIS ROUTINE DETERMINES WHETHER THE STEPPER MOTOR IS TO
;BE RAMPING UP OR DOWN OR AT A MAXIMUM OR FIXED SPEED.
;
;DESTROYS:A,H,L,FLAGS
;
SMSPD:
        PUSH    B
        PUSH    D
        LXI     D,STPTB-1       ;STEP TABLE ADDR-1
        LXI     H,MSPDS ;MAX SPEED STATUS
        MVI     A,80H   ;A=80H
        CMP     M       ;CHECK STATUS
        INX     H       ;M=MAXIMUM SPEED
        MOV     B,M     ;B=MAXIMUM SPEED
        STC             ;SET CARRY SO THAT CONDITIONAL
                        ;RETURN WILL OCCUR IF AT MAX SPD
        JZ      SPD01   ;IF MAX SPEED, OUTPUT
        INX     H       ;M=RSTPN(RAMP STEP #)
        MOV     C,M     ;C=RSTPN
        INX     H       ;M=RAMP UP STATUS
        CMP     M       ;M=80?
        DCX     H       ;M=RAMP STEP #
        JZ      DRAMP   ;JUMP IF RAMP UP STATUS=80H
DRAMP:                  ;DOWN RAMP
        MOV     A,C     ;RAMP STEP # TO A
        ADD     E       ;ADD RAMP STEP # TO BASE
                        ;ADDRESS LOCATION
        MOV     E,A     ;BASE + RSTPN RETURNED
        LDAX    D       ;NEW SPEED TO A
        DCR     C       ;DECREASE RSTPN(RAMP STEP #)
        MOV     M,C     ;SAVE RSTPN
        CMP     B       ;CHECK MAX & NEW SPEED
        JC      SPD02   ;NWSPD<MXSPD THEN JUMP
        STC             ;CARRY CAUSES CONDITIONAL RET
```

```
        JMP     SPD01
URAMP:                          ;UP RAMP
        INR     C               ;INCREASE RSTPN(RAMP STEP #)
        MOV     M,C             ;SAVE RSTPN
        MOV     A,C             ;A=RSTPN
        CMA
        MOV     C,A             ;SAVE COMPLEMENTED STEP NUMBER
        CMA
        ADD     E               ;ADD RAMP STEP # TO BASE LOCATION
        MOV     E,A             ;BASE +RSTPN RETURNED
        LDAX    D               ;NEW SPEED TO A
        CMP     B               ;CHECK MAX & NEW SPEED
        JC      SPD02           ;NWSPD<MXSPD?
MX:                             ;MAXIMUM SPEED REACHED THIS
                                ;TIME
        INX     H               ;M=URAPS(UP RAMP STATUS)
        MVI     M,0             ;CLEAR RAMP UP STATUS
        LXI     H,MSPDS         ;M=MSPDS(MAX SPEED STATUS)
        MVI     M,80H           ;SET MAX SPEED STATUS
        MOV     L,C             ;SAVE RSTPN(RAMP STEP #)
SPD01:
        MOV     A,B             ;A=MXSPD(MAX SPEED)
SPD02:
        OUT     SPDGN           ;TO SPEED GENERATOR
        POP     D
        POP     B
        RC                      ;RETURN IF MAX SPEED HAS NOT
                                ;REACHED THIS TIME
        LDA     NCTMS           ;NO CUT MARK STATUS
        ANA     A               ;SET FLAGS
        JM      RPDNA           ;JUMP IF NO CUT MARK STATUS
        MOV     A,L             ;COMPLEMENTED RAMP DOWN STEPS
        INR     A               ;MAKE TWO'S COMPLEMENT
        LXI     H,ACTF1         ;LOCATION OF TWO LSD OF AFTER
                                ;CUT MARK FEED
        ADD     M               ;SUBTRACT RAMP DOWN STEPS
        MOV     M,A             ;SAVE NEW FEED LENGTH
        RC                      ;RETURN IF CARRY
        INX     H               ;LOCATION OF MSD OF AFTER
                                ;CUT MARK FEED
        DCR     M               ;REDUCE MSD BY ONE
        RET
RPDNA:                          ;RAMP DOWN ADJUSTMENT
        MVI     H,0FFH
        DAD     B               ;REDUCE TOTAL FEED BY RAMP
                                ;DOWN STEPS
        INX     H               ;ADJUST FOR CARRY
        MOV     B,H             ;FEED BEFORE RAMP DOWN
        MOV     C,L             ; TO BC
        RET
;
;ROUTINE:TRIM
;
;THIS ROUTINE ENERGIZES THE CUT SOLENOID FOR THE
;LENGTH OF TIME DETERMINED BY CUTL.  IF ENTRY IS
;MADE AT TRIM1 THE SOLENOID WILL BE TURNED OFF
;AFTER THE PROPER ENERGIZATION TIME.
;
TRIM:
        OUT     CTON            ;TURN CUT SOLENOID ON
        MVI     A,CUTL-3        ;CUT SOLENOID ON TIME
        CALL    DELAY
TRIM1:
        MVI     A,3             ;ENTRY POINT WHEN EARLY CUT
        CALL    DELAY
        OUT     CTOFF           ;TURN CUT SOLENOID OFF
        RET
;
;ROUTINE:DR
;
;THIS IS THE LOOK UP TABLE FOR THE SELECTED SPEED.
;THE STEP RATE IS (41.66 STEPS/SEC)(LOOK UP)
;
        ORG     SPDTB
SPDTB:  DB      1CH,20H,24H,29H,36H     ;SELECT 0-4
        DB      44H,54H,66H,81H,99H     ;SELECT 5-9
```

```
;THIS IS THE LOOK UP TABLE FOR THE STEPPER MOTOR RAMP.
;
;                SPEED(41.66 STEP/SEC)(LOOKUP)    STEP#
;
STPTB:   DB      16H,29H,49H,37H,44H,50H,58H      ;1-7
         DB      61H,63H,65H,68H,70H,72H,74H      ;8-14
         DB      76H,78H,79H,82H,83H,83H,84H      ;15-21
         DB      87H,87H,87H,90H,90H,91H,92H      ;22-28
         DB      92H,92H,93H,94H,94H,94H,96H      ;29-35
         DB      96H,97H,98H,98H,99H              ;36-40
;
;ROUTINE:DS
;
         CRG     DSTOR
SWSTM:   DS      1        ;STATUS OF PB & TOGGLE SWITCHES
NCTMS:   DS      1        ;BIT 7 HI,NO CUT MARK STATUS
LONFD:   DS      1        ;BIT 7 HI IF NEW PAPER ROLL
MXPRM:   DS      1        ;MAX NUMBER PRINTS THIS ORDER(BCD)
CTOTM:   DS      1        ;CUT OUT LENGTH-MEMORY(BINARY)
ACTF1:   DS      1        ;2 LSD,FEED AFTER CT MARK(BINARY)
ACTF2:   DS      1        ;MSD,FEED AFTER CUT MARK(BINARY)
MSPDS:   DS      1        ;BIT 7 HI,AT MAX SPEED
MXSPD:   DS      1        ;MAX SPEED
RSTPN:   DS      1        ;RAMP STEP #
URAPS:   DS      1        ;BIT 7 HI,RAMP UP STATUS
RRPDN:   DS      1        ;BIT 7 HI,READY TO RAMP DOWN
ACTM:    DS      1        ;BIT 7 HI,LOOKING FOR END OF PRT
CTVAL:   DS      1        ;BIT 7 HI,CUT MARK IS ACCEPTABLE
MISCM:   DS      1        ;CUT MARK YET TO MISS
PFD1:    DS      1        ;2 LSD OF FEED LAST CUT(BINARY)
PFD2:    DS      1        ;MSD OF FEED LAST CUT(BINARY)
PRCT:    DS      1        ;# OF PRINTS CUT THIS ORDER(BCD)
ORDCT:   DS      3        ;# ORDERS TOTAL(BCD)
PRCT1:   DS      3        ;# PRINTS CUT TOTAL(BCD)
CTMNW:   DS      1        ;BIT 7 HI,CUT MARK ON PRESENT
                          ;(NEW) CUT
CTMOD:   DS      1        ;BIT 7 HI,CUT MARK ON PREVIOUS
                          ;(OLD) CUT
STOPM:   DS      1        ;BIT 7 HI,STOP SELECTED SINCE
                          ;LAST CUT
MFDL:    DS      2        ;MEASURED FEED LENGTH(BCD)
MFDAC:   DS      2        ;MEASURED FEED LENGTH AFTER
                          ;CUT MARK(BCD)
PWRON:   DS      1        ;BIT 7 HI IF PRINTS HAVE BEEN CUT
                          ;SINCE POWER ON & NO ERROR IN LAST ADVANCE
TOT1?:   DS      1        ;BIT 7 HI IF FIRST TOTAL HAS
                          ;BEEN DISPLAYED
DIG4S:   DS      1        ;BIT 7 HI IF UPPER FOUR DIGITS ARE
                          ;TO BE DISPLAYED NEXT
CTELY:   DS      1        ;BIT 7 HI IF CUT SOLENOID IS TO BE
                          ;ENERGIZED EARLY WHEN RAMP DOWN BEGINS
REQCM:   DS      1        ;BIT 7 HI IF CUT MARKS REQUIRED ON ALL PRINTS
WHY:     DS      2        ;CONTAINS ADDRESS OF REASON FOR PAPER CUTTER STOP
         END
```

What is claimed is:

1. A photographic strip advancement system comprising:

stepper motor means for driving, by steps, a strip of photographic material;

stepper motor control means for causing, in response to control signals, the stepper motor means to take steps;

step status means for supplying a step status signal indicative of whether the stepper motor has taken a step;

storage means for storing control information, the control information including a stored program for directing control functions to be performed; and programmable digital processor means for receiving the step status signal and supplying the control signals to the stepper motor control means as a function of the step status signal and the control information.

2. The invention of claim 1 wherein the programmable digital processor means controls the number of steps taken and the rate at which the steps are taken.

3. The invention of claim 1 and further comprising:

knife means for cutting the strip, the knife means being controlled by the programmable digital processor means.

4. The invention of claim 3 and further comprising:

cut indicia sensor means for sensing cut indicia on the strip;

cut status means for supplying a cut status signal indicative of whether a cut indicium on the strip has been sensed; and wherein the programmable digital processor means also receives the cut status signal and supplies control signals to the stepper motor control means also as as function of the cut status signal.

5. The invention of claim 4 and further comprising:

start switch means for initiating operation of the system.

6. The invention of claim 5 wherein the programmable digital processor means comprises:
means for beginning a feed-and-cut cycle in response to the start switch means initiating operation;
means for causing the stepper motor means to take steps;
means for monitoring the step status signal;
means for counting steps taken;
means for monitoring the cut status signal;
means for determining a distance that the strip will be fed based upon the cut status signal, the step status signal, the steps counted, and the control information;
means for stopping the stepper motor means when the strip has been fed the distance determined; and
means for enabling the knife means.

7. The invention of claim 6 and further comprising:
end-of-order sensor means for sensing end-of-order indicia on the strip; and
end-of-order status means for supplying an end-of-order status signal indicative of whether an end-of-order indicium on the strip has been sensed.

8. The invention of claim 7 wherein the programmable digital processor means further comprises:
means for monitoring the end-of-order status signal;
means for initiating another feed-and-cut cycle if an end-of-order indicium has not been sensed; and
means for halting further feed-and-cut cycles until the start switch again initiates a cycle if an end-of-order indicium has been sensed.

9. The invention of claim 6 and further comprising:
mode switch means for selecting a mode of operation of the cutter.

10. The invention of claim 9 wherein the mode switch means may select a first mode for feed-and-cut cycles, a second mode for determining operating parameters, and a third mode for displaying information regarding operation of the cutter.

11. The invention of claim 10 wherein the start switch means initiates the mode selected by the mode switch means.

12. The invention of claim 6 wherein the strip of photographic material is a photographic paper strip bearing a pluality of photographic prints.

13. The invention of claim 12 and further comprising:
maximum-number-of-prints means for storing a maximum number of prints to be cut.

14. The invention of claim 13 wherein the prgrammable digital processor means further comprises:
means for counting feed-and-cut cycles;
means for initiating another feed-and-cut cycle if the feed-and-cut cycles counted have not reached the maximum number; and
means for halting further feed-and-cut cycles until the start switch means again initiates a cycle if the feed-and-cut cycles counted have reached the maximum number.

15. The invention of claim 12 and further comprising:
cut-out length means for storing a desired cut-out length of photographic paper to be cut out between adjacent prints on the strip.

16. The invention of claim 15 wherein the programmable digital processor means further comprises:
means for causing, at the end of a feed-and-cut cycle after the strip has been stopped and cut, the stepper motor to take steps sufficient to drive the strip by the desired cut-out length; and
means for again enabling the knife means.

17. The invention of claim 6 wherein the means for enabling the knife means enables the knife means a predetermined number of steps before the strip is stopped.

18. The invention of claim 6 wherein the digital processor means further comprises:
means for controlling the rate at which the stepper motor means takes steps.

19. A photographic system comprising:
step drive means for driving a strip of photographic material in steps along a feed path;
step status means for supplying a status signal indicative of whether the strip has been driven by a step;
mode switch means for selecting a mode of operation of the photographic strip cutter;
start switch means for initiating the mode selected by the mode switch means;
intermittently activatable operating means positioned along the feed path;
storage means for storing control information for each mode, the control information including a stored program for directing control functions to be performed; and
programmable digital processor means for controlling operation of the step drive means and the intermittently activatable operating means as a function of the mode selected by the mode switch means, the control information for the mode selected, and the step status signal.

20. The photographic system of claim 19 wherein the digital processor means controls when the step drive means starts and stops driving the strip, the number of steps the strip is driven by the step drive means, and the rate at which steps are taken.

21. The photographic system of claim 19 and further comprising:
display means for displaying information, the display means being controlled by the digital processor means.

22. The photographic system of claim 19 and further comprising:
cut mark/no cut mark switch means for selecting cut mark or no cut mark operation;
cut mark sensing means for sensing cut marks on the strip; and
cut status means for supplying a cut status signal indicative of whether a cut mark on the strip has been sensed.

23. The photographic system of claim 22 wherein the digital processor means monitors the cut status signal and controls operation of the step drive means and the knife means as a function of the cut status signal when the cut mark/no cut mark switch means selects cut mark operation.

24. The photographic system of claim 19 wherein the intermittently activatable operating means comprises:
knife means for cutting the strip.

25. A photographic paper cutter for photographic paper bearing cut indicia, the photographic paper cutter comprising:
cut indicia sensor means for sensing the cut indicia and providing a CUT signal when a cut indicium is sensed;
paper drive means for driving the photographic paper;
paper drive control means for causing the paper drive means to drive the photographic paper until a cut indicium is sensed and beyond by a predetermined distance, and then causing the paper drive means to stop driving the photographic paper;
knife means for cutting the photographic paper in response to an enable signal; and knife control means for providing the enable signal to the knife means after the CUT signal is received and before the paper drive means stops driving the photographic paper.

* * * * *